US008777020B2

(12) United States Patent
Winig et al.

(10) Patent No.: US 8,777,020 B2
(45) Date of Patent: Jul. 15, 2014

(54) EYEWEAR DISPLAY SYSTEM

(71) Applicants: Alan Winig, Wynnewood, PA (US); Richard Winig, Villanova, PA (US); James Eldon, Barto, PA (US)

(72) Inventors: Alan Winig, Wynnewood, PA (US); Richard Winig, Villanova, PA (US); James Eldon, Barto, PA (US)

(73) Assignee: Eye Designs LLC, Collegeville, PA (US)

( * ) Notice: Subject to any disclaimer, the term of this patent is extended or adjusted under 35 U.S.C. 154(b) by 0 days.

(21) Appl. No.: 14/039,491

(22) Filed: Sep. 27, 2013

(65) Prior Publication Data

US 2014/0096575 A1 Apr. 10, 2014

Related U.S. Application Data

(60) Continuation of application No. 13/613,128, filed on Sep. 13, 2012, now Pat. No. 8,573,414, and a continuation-in-part of application No. 13/441,527, filed on Apr. 6, 2012, now Pat. No. 8,646,619, and a continuation of application No. 13/249,488, filed on Sep. 30, 2011, now Pat. No. 8,235,223, and a division of application No. 12/420,293, filed on Apr. 8, 2009, now Pat. No. 8,127,946.

(51) Int. Cl.

| | |
|---|---|
| ***A47F 7/02*** | (2006.01) |
| *G07F 11/00* | (2006.01) |
| *E05B 65/00* | (2006.01) |
| *E05B 69/00* | (2006.01) |
| *E05B 73/00* | (2006.01) |

(52) U.S. Cl.

USPC ..... 211/85.1; 211/7; 248/902; 70/57.1; 70/58; 70/62

(58) Field of Classification Search

USPC ..... 211/4, 7, 8, 85.1, 85.9, 57.1, 59.1, 211/106.01, 100, 193, 94.01; 411/84, 85; 403/256, 350, 409.1; 248/902; 206/5; 70/57.1, 58–62, 85, 86

See application file for complete search history.

(56) References Cited

U.S. PATENT DOCUMENTS

| | | | | | |
|---|---|---|---|---|---|
| 1,661,516 | A | * | 3/1928 | Vineberg | 211/4 |
| 2,429,833 | A | * | 10/1947 | Luce | 411/84 |
| 2,913,952 | A | * | 11/1959 | Becker | 411/61 |
| 3,059,589 | A | * | 10/1962 | Schreyer | 104/111 |
| 3,220,078 | A | * | 11/1965 | Preziosi | 411/349 |
| 3,339,751 | A | * | 9/1967 | Bard | 211/193 |
| 3,346,124 | A | * | 10/1967 | Sobel | 211/193 |
| 3,836,007 | A | * | 9/1974 | Rosenwein | 211/85.1 |
| 3,858,726 | A | * | 1/1975 | Rosenwein | 211/85.1 |
| 3,924,750 | A | * | 12/1975 | Dunchock | 211/85.1 |

(Continued)

*Primary Examiner* — Joshua J Michener
*Assistant Examiner* — Devin Barnett
(74) *Attorney, Agent, or Firm* — Duane Morris LLP

(57) ABSTRACT

The present invention provides a lockable eyewear display system. Embodiments of the system include a frame holder on which the eyewear is placed, a locking mechanism that secures the eyewear to the holder, and a key that enables a user to holder unlock and to remove the eyewear from the holder. In one embodiment, frame holder includes an articulating joint allowing at least a portion of the holder and eyewear to be swiveled. The frame holder is removably attachable to a display rod of the system configured to hold a plurality of frame holders. The display rod includes a lock in one embodiment to prevent removal of the frame holders from the rod without use of a specially configured access key. The display rod is mountable to a surface of a fixture or display object such as a rack or furniture.

11 Claims, 46 Drawing Sheets

(56) References Cited

U.S. PATENT DOCUMENTS

| | | | | | |
|---|---|---|---|---|---|
| 3,955,681 | A * | 5/1976 | DeZinno | 211/85.1 |
| 4,339,045 | A * | 7/1982 | Bodin | 211/85.9 |
| 4,596,334 | A * | 6/1986 | Daulton | 211/64 |
| 4,750,310 | A * | 6/1988 | Holcombe | 52/844 |
| 4,805,781 | A * | 2/1989 | Tegel | 211/85.1 |
| 4,890,745 | A * | 1/1990 | Holden | 211/85.1 |
| 4,930,740 | A * | 6/1990 | Vogt | 248/309.1 |
| 5,018,253 | A * | 5/1991 | Oppenheimer | 24/458 |
| 5,025,931 | A * | 6/1991 | Berger | 211/85.1 |
| 5,056,668 | A * | 10/1991 | Berger | 211/85.1 |
| 5,069,416 | A * | 12/1991 | Ennis | 248/231.81 |
| 5,085,388 | A * | 2/1992 | Creutz | 248/288.31 |
| 5,144,345 | A * | 9/1992 | Nyman | 351/158 |
| 5,144,820 | A * | 9/1992 | Holmgren | 70/57.1 |
| 5,178,283 | A * | 1/1993 | Ennis | 211/4 |
| 5,248,048 | A * | 9/1993 | Dore | 211/74 |
| 5,275,027 | A * | 1/1994 | Eklof et al. | 70/14 |
| 5,316,252 | A * | 5/1994 | Charnow et al. | 248/224.51 |
| 5,370,488 | A * | 12/1994 | Sykes | 411/551 |
| 5,372,345 | A * | 12/1994 | Schmidt | 248/229.16 |
| D374,366 | S * | 10/1996 | Eldon et al. | D6/567 |
| 5,593,045 | A * | 1/1997 | Eldon et al. | 211/85.1 |
| 5,676,258 | A * | 10/1997 | Leyden et al. | 211/7 |
| 5,802,891 | A * | 9/1998 | Kahara et al. | 70/79 |
| 5,819,957 | A * | 10/1998 | Hahn | 211/85.1 |
| D401,450 | S * | 11/1998 | Ennis | D6/466 |
| D402,827 | S * | 12/1998 | Ennis | D6/466 |
| 5,864,924 | A * | 2/1999 | Rodriguez | 24/3.3 |
| D406,714 | S * | 3/1999 | Eldon et al. | D6/567 |
| 5,921,409 | A * | 7/1999 | Gerber et al. | 211/85.1 |
| 5,931,315 | A * | 8/1999 | Lorentz et al. | 211/40 |
| 6,182,840 | B1 * | 2/2001 | Tegel | 211/85.1 |
| 6,205,824 | B1 * | 3/2001 | Miao | 70/58 |
| 6,209,835 | B1 * | 4/2001 | Walrath et al. | 248/276.1 |
| 6,290,426 | B1 * | 9/2001 | van Gijsel et al. | 403/374.3 |
| 6,364,124 | B1 * | 4/2002 | Chen | 211/4 |
| 6,393,877 | B1 * | 5/2002 | Church | 70/62 |
| 6,401,371 | B2 * | 6/2002 | Martorella | 40/358 |
| 6,443,316 | B1 * | 9/2002 | Mao | 211/74 |
| 6,519,883 | B2 * | 2/2003 | Martorella | 40/358 |
| 6,622,979 | B2 * | 9/2003 | Valiulis | 248/220.42 |
| 6,644,608 | B1 * | 11/2003 | Begg | 248/229.16 |
| 6,695,270 | B1 * | 2/2004 | Smed | 248/274.1 |
| 6,702,128 | B2 * | 3/2004 | Winig et al. | 211/90.01 |
| 6,802,171 | B2 * | 10/2004 | McKinnon | 52/762 |
| 6,957,555 | B1 * | 10/2005 | Nagel et al. | 70/57.1 |
| 7,024,894 | B2 * | 4/2006 | Salonen | 70/58 |
| 7,134,559 | B2 * | 11/2006 | Zoueki | 211/85.1 |
| 7,147,113 | B2 * | 12/2006 | Obstfeld et al. | 211/85.1 |
| D536,563 | S * | 2/2007 | Smith | D6/567 |
| 7,269,983 | B1 * | 9/2007 | Mchatet | 70/14 |
| 7,270,241 | B2 * | 9/2007 | Nobili | 211/85.1 |
| D554,392 | S * | 11/2007 | Lane | D6/468 |
| D567,542 | S * | 4/2008 | Lane | D6/468 |
| D571,576 | S * | 6/2008 | Lane | D6/457 |
| 7,420,731 | B2 * | 9/2008 | Piontkowski | 359/382 |
| D579,705 | S * | 11/2008 | Winig et al. | D6/567 |
| D587,934 | S * | 3/2009 | Winig et al. | D6/449 |
| 7,976,257 | B2 * | 7/2011 | Kufner | 411/84 |
| 8,132,992 | B2 * | 3/2012 | van Walraven | 411/85 |
| 8,307,999 | B2 * | 11/2012 | Pintur | 211/85.1 |
| 2004/0026344 | A1 * | 2/2004 | Sedon et al. | 211/7 |
| 2004/0084386 | A1 * | 5/2004 | Huehner et al. | 211/4 |
| 2004/0200790 | A1 * | 10/2004 | Zoueki | 211/85.1 |
| 2004/0238709 | A1 * | 12/2004 | Lee et al. | 248/316.1 |
| 2005/0211649 | A1 * | 9/2005 | Nobili | 211/85.1 |
| 2005/0253034 | A1 * | 11/2005 | Bally et al. | 248/276.1 |
| 2007/0095641 | A1 * | 5/2007 | Yu | 200/334 |
| 2008/0209960 | A1 * | 9/2008 | Nagelski | 70/57.1 |
| 2008/0292424 | A1 * | 11/2008 | Kufner | 411/85 |
| 2009/0014604 | A1 * | 1/2009 | Pintur | 248/158 |
| 2010/0300992 | A1 * | 12/2010 | Surma et al. | 211/7 |

* cited by examiner

EYEWEAR DISPLAY SYSTEM

CROSS-REFERENCE TO RELATED APPLICATIONS

This application is a continuation of U.S. application Ser. No. 13/613,128, filed Sep. 13, 2012, which is a continuation in part of U.S. application Ser. No. 13/441,527 filed Apr. 6, 2012, which is a continuation of U.S. Pat. No. 8,235,233, issued on Aug. 7, 2012, which is a divisional of U.S. Pat. No. 8,127,946, issued on Mar. 6, 2012, which claims priority of U.S. Provisional Application Ser. No. 61/043,431, filed Apr. 9, 2008, the contents of each being incorporated herein by reference in their entireties.

FIELD OF THE INVENTION

The present invention relates to the field of product display devices, and more particularly to eyewear displays that aid in deterring theft and articulating displays.

BACKGROUND OF THE INVENTION

Retail displays are critical to the sales of consumer products as they are the means by which products are positioned in the view and reach of prospective purchasers. Product displays are therefore configured to hold and position as much product as possible in the view of consumers in an orderly and appealing arrangement. To this end, a great variety of product display racks and product support devices have been contrived for all types of products. As the number of different types of displays multiplies, greater amounts of store space is occupied to the extent that not all displays can be on the sales floor at the same time. For seasonal items such as sunglasses, display racks are moved about a store throughout the year, according to demand and sales results. In many stores, seasonal display racks are placed in storage during the off-season. In large stores, this can lead to permanent misplacement of some display racks and the inventory carried thereon. In the retail sale of expensive articles, it is usually important that each article be displayed in such a way that it appears attractive. This is particularly true in the case of eyewear, whether they be corrective glasses or sunglasses, since there are a large number of styles to put on display at the same time. Despite the large number of frames or complete glasses, it is still important that the prospective buyer be able to examine each item from all sides and, by displaying the merchandise properly, he or she may be able to do so without handling the item. The handling of a pair of sunglasses can cause it to be smeared with finger prints and these not only show on the surface of the glasses, but they also collect dust.

In the optical business, it is desirable to display a large variety of eyeglasses and eyeglass frames in a manner that is attractive and allows the prospective buyer easily to examine and compare a large number of different frames or eyeglasses. Advantageously, the frames or eyeglasses are supported such that they are readily seen from different perspectives. The supporting structure should not unduly interfere with the view of the frames or eyeglasses, and should make it easy for the customer to try them on, with minimal danger of upsetting other frames. A wide variety of such displays are known.

Eyeglasses and/or frames have a peculiar structure, namely that needed to fit in place on the wearer's head. Thus, the frames have temple pieces or earpieces to engage over a wearer's ears pivotally coupled to a lens support that typically has spaced pads to fit the bridge of the nose. These aspects are common to frames without lenses, sample frames with plain glass lenses, finished eyeglasses, sunglasses, reading glasses, goggles and the like, and the present invention is applicable to all these types, as well as other articles having similar needs or attributes.

It may be desirable to display frames with the temple pieces or earpieces folded wholly or partly closed against the lens frame, or alternatively, folded fully open to the position they occupy in use. The fixtures supporting the frames should preferably be amenable to one or more of such display alternatives, and should also be arranged to hold the frames in an attractive array. Potential purchasers typically make their selection of eyeglass frames very carefully, and an attractive but unobtrusive supporting fixture is important. While the eyeglass and eyeglass frame displays disclosed in the foregoing patents include a variety of different types of display structures, it would still be desirable to improve on the supporting structures to provide a display system that is more sturdy, light weight, simple but versatile, unobtrusive, attractive, inexpensive and easy to install. It would further be desirable to provide a security system for eyeglasses or eyeglass frames when displayed on supporting structures that secures the frames to the supporting structures such that the frames cannot be casually upset, for example when reaching for an adjacent frame in a compact array.

As the quality of the frames and/or lens inserts have increased, likewise so have their prices, making the ready to wear devices prime subject matter for thieves. To reduce the amount of pilferage, shop owners have taken to the procedure of displaying their eyeglasses in glass enclosed, locked cases. This approach not only greatly increases the overhead, but also presents a requirement that a salesperson be readily available to service the display to allow a prospective customer to look at and try on a designer set of eyeglasses. Providers that sell eyewear often carry product lines offered by designer labels. Designer eyewear tends to be relatively expensive. Most eyewear is relatively small, and easy to pocket or carry away discretely. Making eyewear products, especially large selections of expensive products, accessible to customers and passersby presents problems such as theft, loss, accidental displacement, and breakage. Such problems constitute a significant expense to providers.

Some attempts to overcome security problems include keeping model eyewear in glass display counters and locked display cases. Each counter or case typically holds multiple pairs of model eyewear. Such display systems require personnel to open, remove, and replace model eyewear each time a customer wants to see a product up close. Several shortcomings are present in these systems. Display cases present a barrier between the customer and the product. This barrier prevents the customer from seeing the product up close or viewing the product from different angles. Glass display cases create glares that further obscure a customer's view of the products within. Also, glass counters and countertop display cases are heavy and difficult to move, or are permanently affixed to a floor or wall. The limited mobility of display cases prevents providers from rearranging the displays, or increasing and decreasing the display space to accommodate the provider's changing inventory.

Other attempts to overcome security problems include connecting model eyewear to a weight or fixture using cables or chains. Such devices allow customers to handle the model eyewear, view them up close, and try them on without the assistance of personnel. The cable or chain connecting the model eyewear to the weight or fixture prevents a customer from stealing or carrying the eyewear away. Shortcomings are present in these systems as well. The cables or chains connected to the model eyewear can break or become tangled from customer handling. Tangled cables and chains prevent customers from fully accessing the model eyewear and make the display space look cluttered and disorganized. Cables or chains attached to eyewear also interfere with the customer's ability to wear the eyewear comfortably, and are sometimes removed by personnel to allow a customer to try on a product.

Another attempt to overcome security problems is shown in U.S. Pat. No. 5,593,045, which provides a removable security cable 45 having a lockable retainer portion on one end that slips over an eyewear display fixture 15 to lock the nose bridge of a pair of eyeglasses on the fixture. As shown in FIGS. 11-20 in this patent, the retainer portion 45 includes a rotary lock pin 54 that is rotatable by a user such that in alternating positions the retainer portion is either trapped on or freely removable from the fixture 15 to unlock the eyeglasses. The lock pin 54, however, may simply be engaged and rotated by an ordinary conventional slotted screwdriver or similar object by an unauthorized user which provides less than optimum security required in some situations.

Still other attempts to overcome security problems include affixing magnetic tags or Radio Frequency ID tags to the model eyewear. A magnetic or RFID tag is attached to each pair of model eyewear, and is used in conjunction with large detectors located at the entrances and exits of a store. Such systems allow customers to handle and try on model eyewear, but prevent customers from taking the eyewear out of the store. Some shortcomings associated with these systems are that magnets and RFID tags are bulky, and interfere with the customer's ability to try on the eyewear. Bulky tags are also awkward looking, and do not prevent eyewear from falling off of display racks or being misplaced within the store.

There exists a need for a display system that allows customers to see eyewear frames up close, has an aesthetically pleasing appearance, is free from bulky or awkward parts, provides a secure display platform, deters theft, and can be removed and re-secured by personnel quickly, easily, and repeatedly to allow customers to fully access model eyewear in a controlled manner.

SUMMARY OF THE INVENTION

The present invention relates to an eyewear display system, which in some embodiments may include a plurality of eyewear display assembles. In one embodiment, the eyewear display system includes a support frame, a removable lock engageable with the frame, and a specially-configured key operable to disengage the lock from the frame. The present invention also relates to a method of securely displaying eyewear. The steps of the method include placing eyewear on a support frame, attaching a lock to the support frame, and removing the eyewear from the support frame by removing the lock from the support frame with a key. The present invention also relates to an eyewear display kit. The kit includes an eyewear support frame, a lock attachable to the support frame, and a key operable to remove the lock from the support frame.

In one embodiment, the support frame has an anchor, a longitudinally-extending spine protruding from the anchor, a pair of resiliently movable locking members such as cantilever beams extending from the spine in one embodiment, a pair of arms extending outwardly in opposite directions from the spine for supporting the eyewear, and a tower extending outwardly from the spine. The cantilever beams may terminate in flanges configured and adapted to releasably engage complementary locking surfaces on the lock. In one embodiment, the locking surfaces may be disposed inside the lock which may include an axial central passageway. The arms preferably extend outwards from the spine at a location between the anchor and the cantilever beams to support a temple or earpiece of a pair of eyeglass support frames. The tower may extend from the spine at a location between the arm and the prongs. In one embodiment, the tower defines an opening configured for receiving a portion of the lock therethrough. In one embodiment, the spine may have an elongated curved s-shape. The support frame may further include a card holder. In one embodiment, the anchor includes a plate connected to the spine. The plate may define a pilot hole for receiving a mounting fastener for attaching the anchor and eyewear display assembly to a display object. In some embodiments, the anchor also includes at least two spaced-apart flexible tabs that may be engaged and expanded by the fastener. The tabs are each connected to the plate by a corresponding side panel in some embodiments.

The lock includes a barrel and a lockbar in one embodiment. The lockbar extends outwardly from the barrel and is configured to be received in the opening of the tower for securing eyeglass support frames to the support frame. In one embodiment, the lockbar defines an angled portion. The barrel preferably defines a ridge extending into an axially-extending central passageway extending through the barrel. The barrel further defines an eyehole intersecting central passageway in some embodiments for receiving a portion of the key therethrough. In one embodiment, the barrel has two opposing ridges and defines two eyeholes on opposite sides of the barrel.

The key includes a pair of user-operated flexible cantilevers arranged in opposing relationship to each other. In one embodiment, the key may also have a shaft protruding from between the pair of cantilevers. The shaft supports a guide or pilot at one end for engaging the lock to align the key with the lock. The pair of cantilevers has a pair of finger grips for grasping by a user. The cantilevers are configured to engage the cantilever beams of the support frame when the lock is applied to the support frame. In one embodiment, each cantilever on the key also defines a peg that extends inwardly in opposing relationship to the another peg defined on the opposite one of the cantilevers for engaging the cantilever beams of the support frame. In one embodiment, the lock includes an eyehole formed in opposite sides of the lock that is sized and configured to receive the pegs therethrough for accessing the cantilever beams of the support frame through the lock.

A method of using the lock generally includes applying the lock to the support frame by inserting the cantilever beams into the central passageway of the barrel and essentially simultaneously inserting the lockbar into the opening of the tower. The flanges on the cantilever beams engage the ridges in the lock to immobilize and secure the lock to the support frame. The key may be used to release the lock by engaging the cantilever beams through the eyeholes in the lock and disengaging the flanges from the ridges, wherein the lock may be axially removed from the support frame.

BRIEF DESCRIPTION OF THE DRAWINGS

All drawings are schematic and not to scale. Any reference to a figure number herein (e.g. FIG. 62) containing multiple sub figures (e.g. FIG. 62A, FIG. 62B, etc.) should be construed as a reference to all sub figures within the respective figure number unless expressly noted otherwise.

DETAILED DESCRIPTION OF PREFERRED EMBODIMENTS

Figure 1:
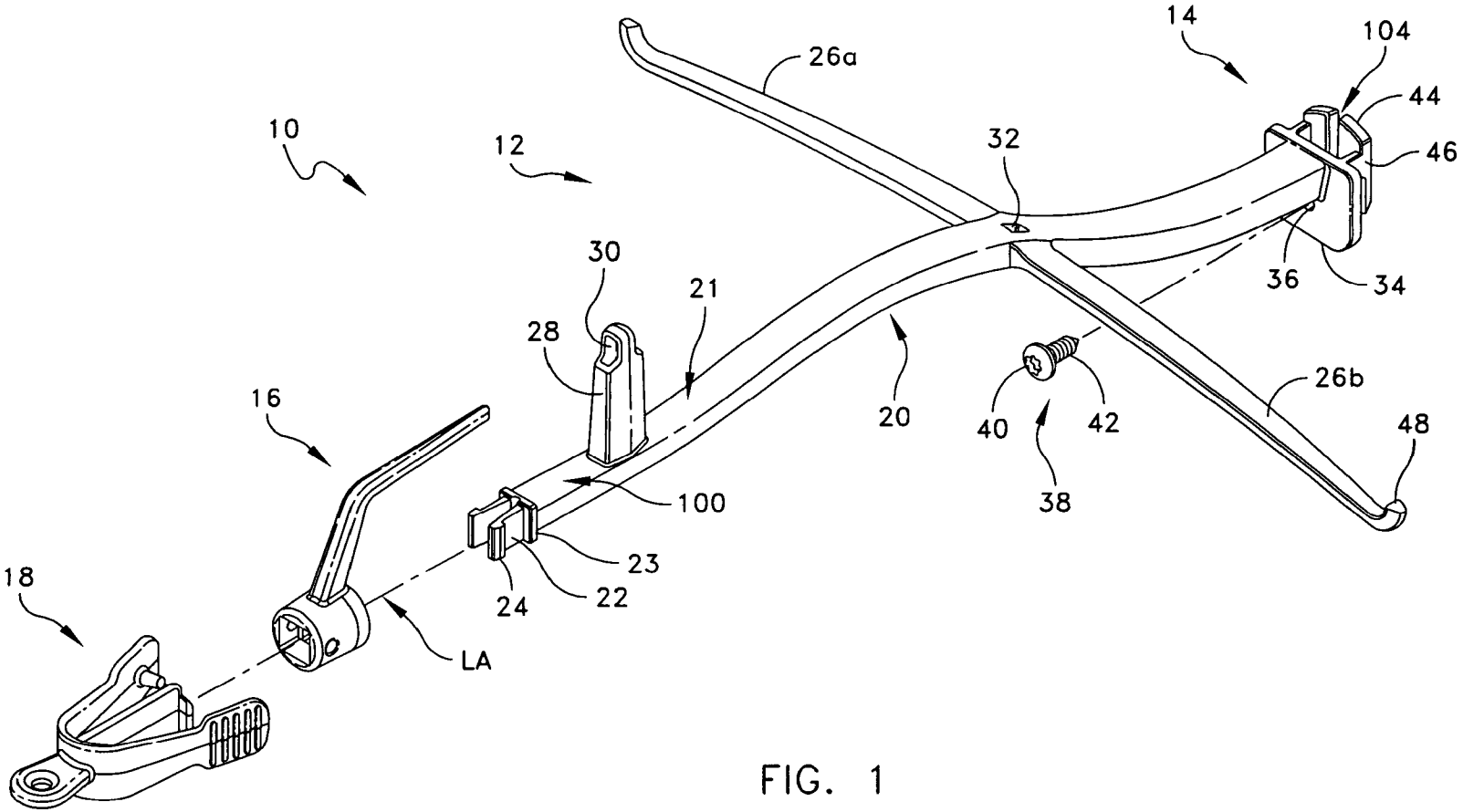
FIG. 1 is an exploded perspective view of a display assembly according to the present invention.

This description of preferred embodiments is intended to be read in connection with the accompanying drawings, which are to be considered part of the entire written description of this invention. The drawing figures are not necessarily to scale and certain features of the invention may be shown exaggerated in scale or in somewhat schematic form in the interest of clarity and conciseness. In the description, relative terms such as "horizontal," "vertical," "up," "down," "top" and "bottom" as well as derivatives thereof (e.g., "horizontally," "downwardly," "upwardly," "rearwardly," etc.) should be construed to refer to the orientation as then described or as shown in the drawing figure under discussion. These relative terms are for convenience of description and normally are not intended to require a particular orientation. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship. In the claims, means-plus-function clauses, if used, are intended to cover the structures described, suggested, or rendered obvious by the written description or drawings for performing the recited function, including not only structural equivalents but also equivalent structures.

As the terms are used herein, "eyewear," "eyeglasses," and "eyeglass frames" shall be broadly construed and may be used interchangeably to mean any type of conventional eyeglasses or eyeglass frames, with or without lenses inserted in the frames.

Figure 15:
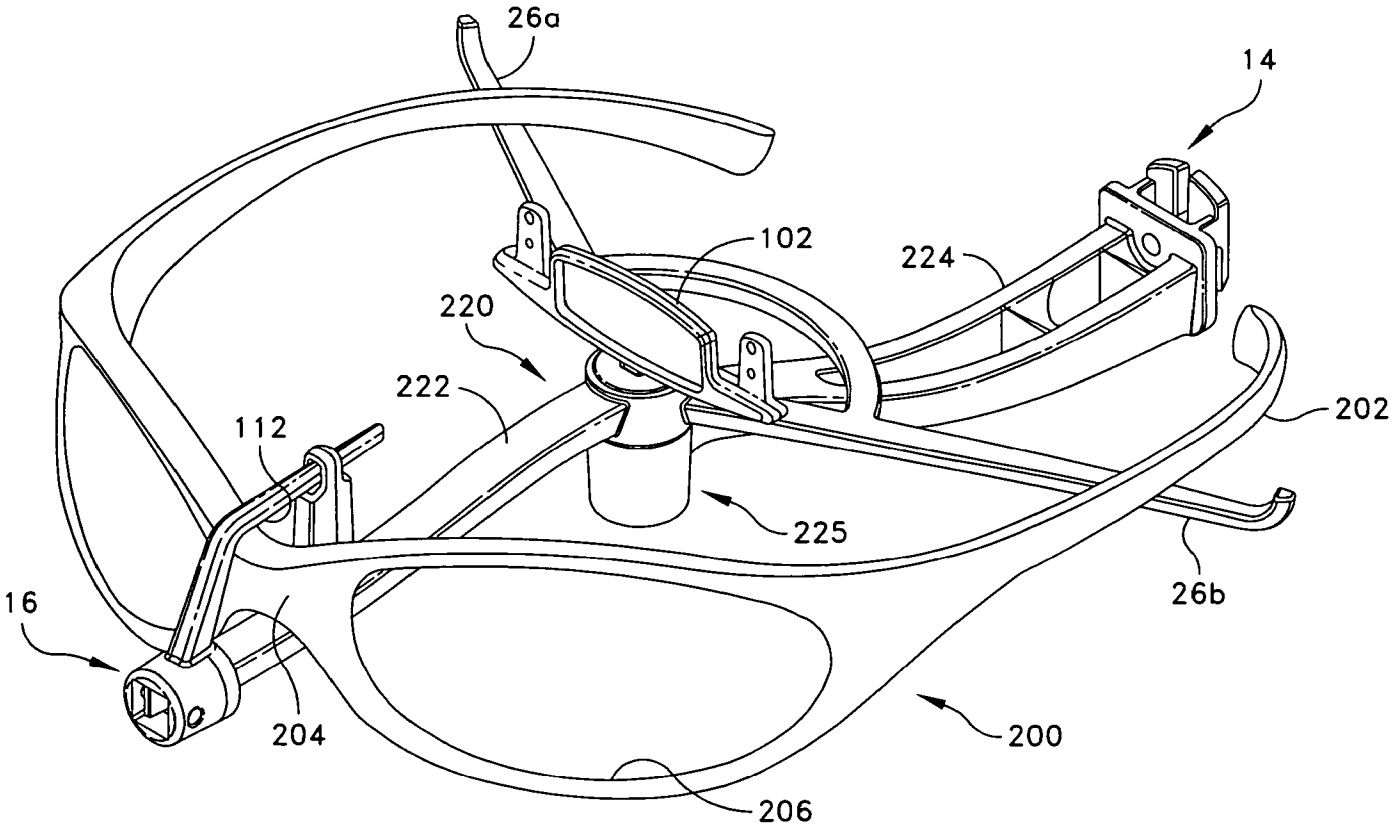
FIG. 15 is a perspective view of the fully assembled second embodiment of the display assembly shown with the lock installed and a pair of eyeglass frames secured in the display assembly.

Referring to FIG. 1, one embodiment of an eyewear display assembly 10 includes a support frame 12 having an anchor 14 attachable to a display object, a removably lock 16, and a key 18. Support frame 12 has a longitudinally-extending spine 20 that projects outwardly from anchor 14. Spine 20 may be curved upwardly so as to form an elongated S-shape in some embodiments. In one embodiment, spine 20 terminates with a pair of spaced-apart confronting locking members such as cantilever beams 22 formed on a free end of the spine. Preferably, cantilever beams 22 are flexible and resiliently disposed on spine 20 such that the beams are (1) compressible and movable inwards towards each other to an unlocked position and (2) expandable and movable outwards away from each other to a locked position. Each cantilever beam 22 respectively includes a wedge-shaped flange 24 located on an outer surface of its free end (see also FIG. 13). Wedge-shaped flanges 24 each have an inclined surface forming a ramp 25 and a shoulder defining a locking surface 27 disposed generally perpendicular to the longitudinal axis LA of spine 20. A tower 28 projects outwardly from a top surface 21 of spine 20, which in some embodiments may be in a generally vertical direction normal to spine 20 and arms 26*a* and 26*b*. Tower 28 may be located on spine 20 between the cantilever beams 22 and arms 26*a* and 26*b*. A through-bore or opening 30 is defined at a top end of tower 28 that preferably is arranged in substantially parallel relation to spine 20. The distance from opening 30 to the top surface 21 of spine 20 is preferably greater than the thickness or height of the nose bridge of a typical pair of eyeglass frames. In one embodiment, a portion of top surface 21 of spine 20 defines a generally horizontal supporting surface 100 which may be between tower 28 and cantilever beams 22 for supporting the nose bridge 204 of a pair of eyewear or eyeglass frames 200, as shown in FIG. 15.

Figure 13:
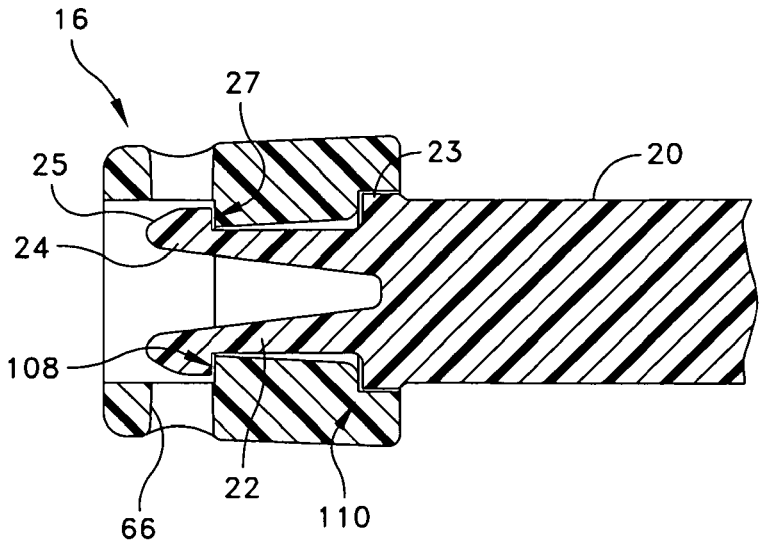
FIG. 13 is a cross sectional view taken of a portion of the lock shown in FIG. 12, taken along plane 13-13.

In one embodiment, spine 20 may include a through-bore 32 is defined in spine 20, which may be in close proximity to the intersection of arms 26*a* and 26*b* with spine 20 as shown in FIG. 1. A portion of a display card or price tag holder 102, or similar component to that shown in FIG. 7 configured to be received in through-bore 32, may be positioned within through-bore 32 so as to be disposed between tower 28 and anchor 14 in one embodiment. As shown in FIGS. 1 and 13, spine 20 may further include an enlarged boss 23 in some embodiments that engages a mutually configured shoulder portion 110 of lock 16 to limit the insertion depth of spine 20 into lock 16.

Figure 6:
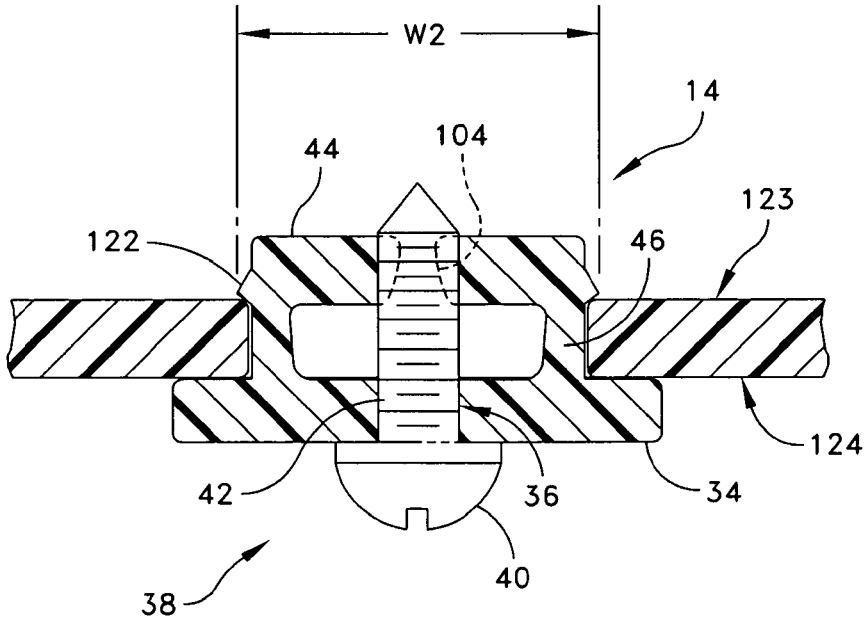
FIG. 6 is a top cross sectional view of an anchor of one embodiment of the display assembly shown in FIG. 5, taken along plane 6-6 and engaged with the display object.

Referring to FIGS. 1 and 6, anchor 14 in one embodiment includes a plate 34 that defines a pilot hole 36 that is sized to receive a fastener, such as without limitation screw 38 having head 40 and tapered shaft 42 (see FIG. 6). In one embodiment, plate 34 is preferably connected to at least two tabs 44 by respective side panels 46. Panels 46 may be arranged in spaced apart relationship to each other and oriented generally perpendicular to plate 34 and tabs 44. Tabs 44 may be spaced apart to define a gap 104 configured and adapted to receive a portion of shaft 42 of screw 38 therethrough, as further described herein. Gap 104 provides flexibility to tabs 44 such that the tabs may be compressed or expanded in relation to each other under an applied force, and will spring back to their original configuration and spacing when the force is removed.

With continuing reference to FIG. 1, support frame 12 also preferably includes a first arm 26*a* and a second arm 26*b*, each extending outwardly from spine 20 for supporting the ear pieces 202 of eyeglass frames 200. In one embodiment of the invention, arms 26*a* and 26*b* extend generally outwards from and transverse to a central portion of spine 20 at substantially right angles with respect to the spine 20. In other embodiments of the invention, arms 26*a* and 26*b* may be swept back toward anchor 14, or alternatively swept forward toward cantilever beams 22, at an angle to spine 20. In one embodiment, arms 26*a* and 26*b* may be swept back or forward at a representative angle without limitation to spine 20 at about twenty-five to sixty degrees. Also, the distance that each arm 26*a* and 26*b* extend outwards from spine 20 is preferably longer than about one half of the width of typical eyeglass frames 200 to rest the ear pieces 202 of the eyeglass frame thereon, as shown in FIG. 15. In some embodiments, a flare or upward bend may be formed at end 48 of each arm 26*a* and 26*b* to confine movement of the ear pieces 202 when positioned on the arms.

Figure 2:
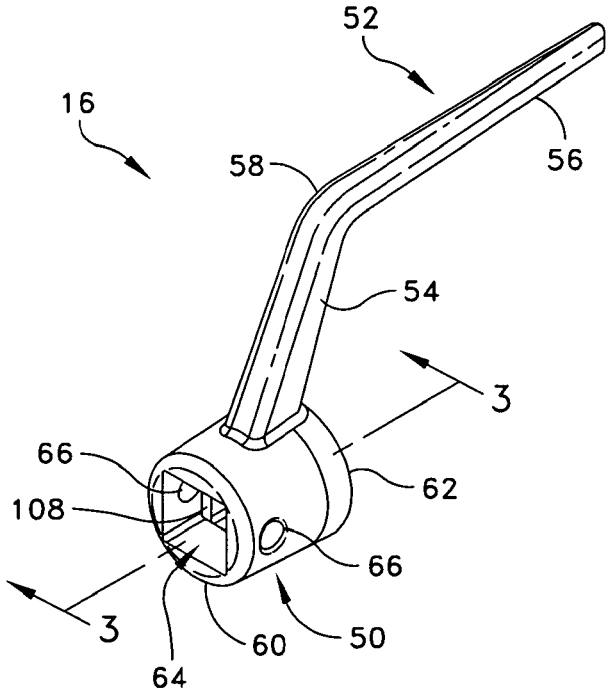
FIG. 2 is a perspective view of a lock of one embodiment of the display assembly.
Figure 3:
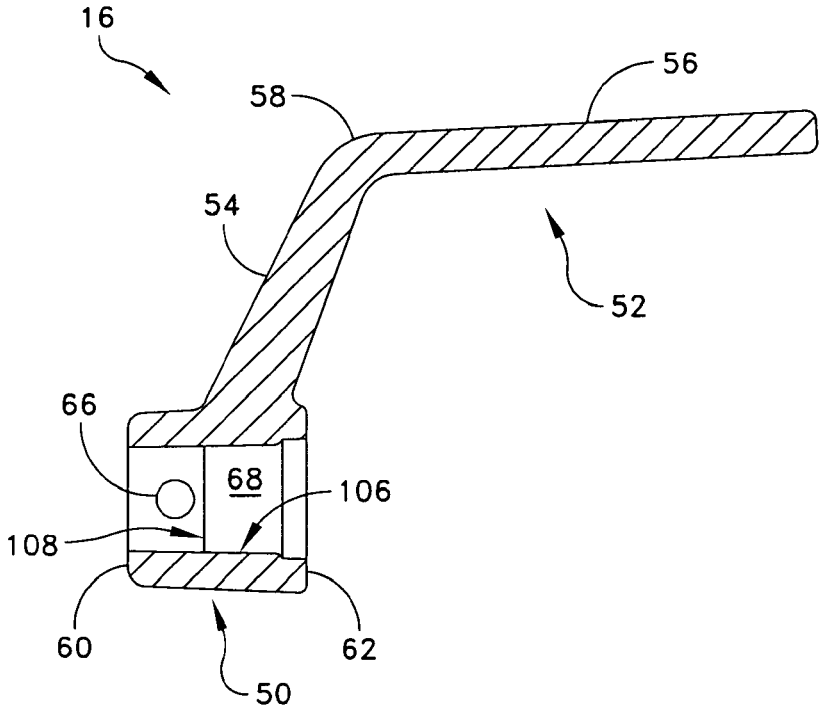
FIG. 3 is a cross sectional view of the lock shown in FIG. 2, taken along plane 3-3.

Referring to FIGS. 2 and 3, lock 16 includes a barrel 50 and a lockbar 52 that projects outwardly from an outer surface of barrel 50. Lockbar 52 has a proximal portion 54 that projects outwardly and upwardly from the outer surface of barrel 50 in a generally vertical direction, and a distal portion 56 that projects rearwardly and generally horizontally from a bend 58 that preferably is defined between them. Proximal portion 54 may be slightly angled rearwards with respect to barrel 50 in some embodiments as best shown in FIG. 3. Proximal portion 54 projects upwards from the outer surface of barrel 50 so as to define a height that is approximately equivalent to or slightly less than the height of opening 30 defined at the top end of tower 28 on spine 20.

Referring to FIGS. 2 and 3, barrel 50 has a key-receiving end 60 and a flange-receiving end 62, and defines an axial central passageway 64 that extends longitudinally through barrel 50 and communicates with both key-receiving end 60 and opposite flange-receiving end 62. In some other embodiments, central passageway 64 may extend only partially through barrel 50. Passageway 64 preferably is sized so as to receive cantilever beams 22 through flange-receiving end 62. Central passageway 64 defines an inner surface 106, which is preferably configured to engage wedge-shaped flanges 24 for locking barrel 50 onto spine 20 as further described herein. In a preferred embodiment, central passageway 64 has a square or rectangular cross-sectional shape as best shown in FIG. 2. Although the exterior surface of barrel 50 is preferably cylindrical, other cross-sectional profiles may be provided for functional and aesthetic reasons such as rectangular, oval, polygonal, hexagonal, octagonal, etc. Barrel 50 also defines at least one laterally-extending eyehole 66 that extends from the side of the outer surface of barrel 50 inwards so as to communicate with central passageway 64. In one embodiment, at least two eyeholes 66 are provided through the sides of barrel 50 and are preferably disposed in confronting coaxial relation to one another in barrel 50 as shown. A pair of raised portions or ridges 68 are located on opposite sides of inner surface 106 of barrel 50 that form a portion of central passageway 64 and project into central passageway 64 in confronting spaced apart relation to one another. Ridges 68 each define a locking surface 108 disposed generally perpendicular to a longitudinal axis extending axially through barrel 50 and inner surface 106. In one embodiment, locking surfaces 108 may be disposed adjacent to eyehole 66; however, other suitable locations may be used for the locking surfaces. As best shown in FIG. 13, ridges 68 are preferably spaced apart from each other by a distance such that the width of at least a portion of central passageway 64 between ridges 68 is slightly less than the normal undeflected width of cantilever beams 22 at wedge-shaped flanges 24. This ensures that cantilever beams 22 are securely engaged against ridges 68 when the beams are fully inserted and seated in lock 16.

Figure 4:
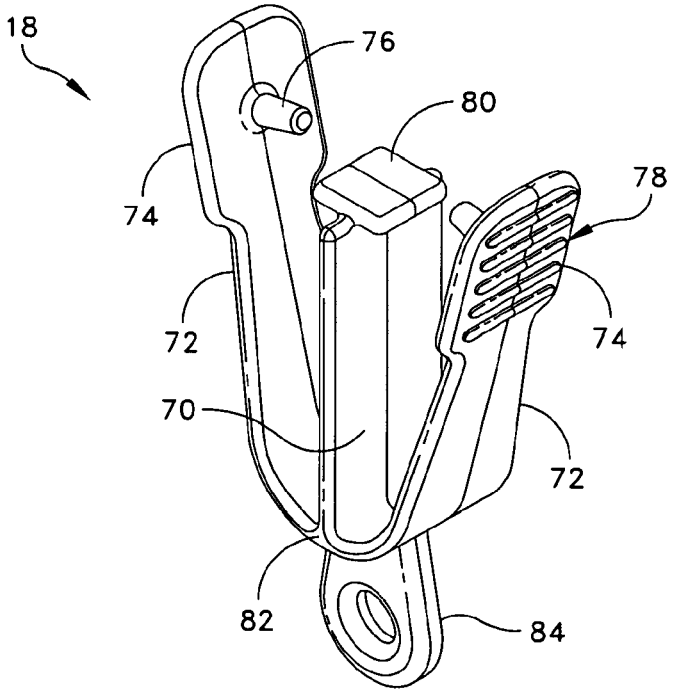
FIG. 4 is a perspective view of a key of one embodiment of the display assembly.

Referring to FIG. 4, key 18 may include a shaft 70 protruding outwards from and disposed between a pair of divergently spaced-apart operating extensions such as cantilevers 72. Cantilevers 72 are preferably flexible or resilient and formed on opposite sides of key 18 such that the cantilevers are compressible or movable inwards towards each other by squeezing key 18 and expandable or movable outwards away from each other by releasing inward pressure on the cantilevers. Cantilevers 72 form a generally U-shaped key 18 in one embodiment as shown. Cantilevers 72 may each have a finger grip pad 74 formed adjacent to its free end. Each grip pad 74 may have a textured surface 78 facing outwardly and away from shaft 70 for grasping by a user's fingers. Shaft 70 projects outwardly from a base 82 formed between cantilevers 72, and terminates at a free end located between finger grip pads 74 so as to define a guide or pilot 80. In one embodiment as shown, shaft 70 may have a generally rectangular cross-section. In other embodiments, shaft 70 may have other cross-sectional shapes or may be omitted entirely. Key 18 may include an eyelet 84 projecting outwardly from base 82 and away from shaft 70. Eyelet 84 may be attached to a lanyard or keychain (not shown) fastened to the eyelet.

Figure 21:
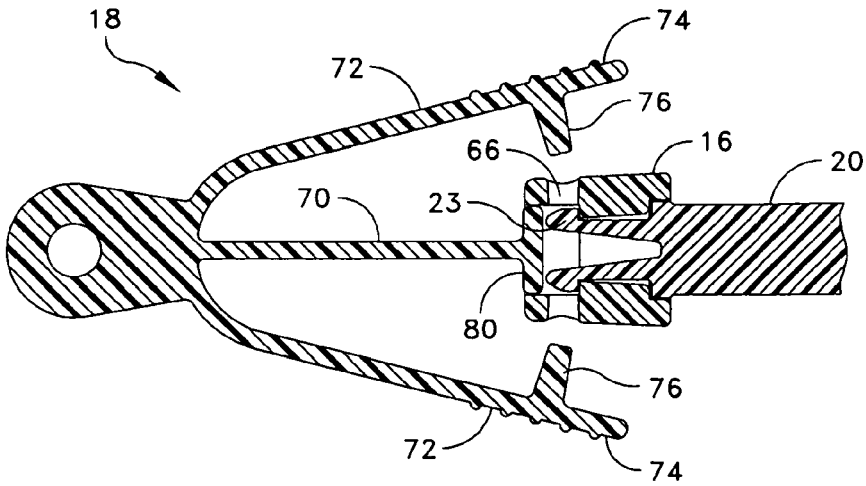
FIGS. 21-23 show sequential top cross-sectional views of the interaction between the key and lock during the process of removing the lock from the second embodiment of the display assembly.
Figure 22:
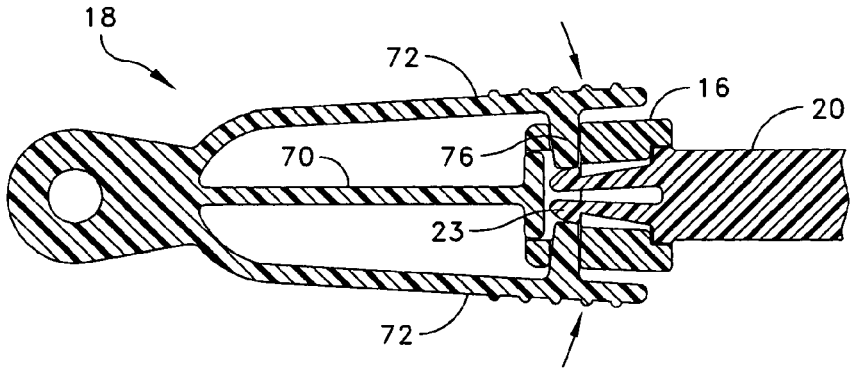
Figure 23:
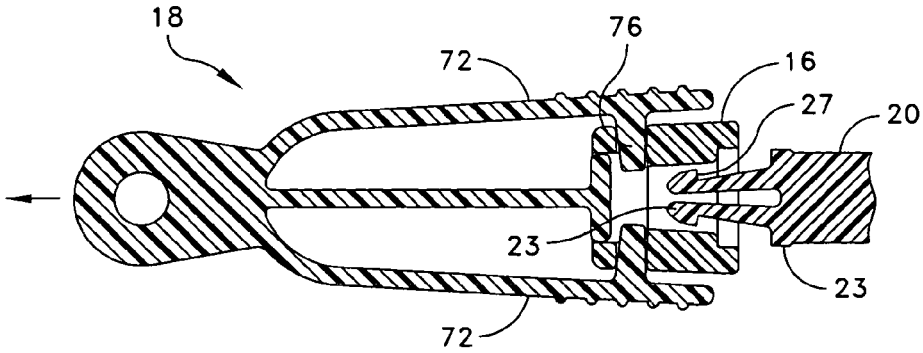

With continuing reference to FIG. 4, each cantilever 72 of key 18 further includes a releasing protrusion such as peg 76 or a similar member projecting inwardly from an inner surface of each grip pad 74 in a general direction towards each other and shaft 70. Accordingly, in one embodiment, pegs 76 are arranged in opposing relationship to each other such that the pegs are movable inwards and outwards towards each other by alternatingly squeezing and releasing cantilevers 72 by a user. The relative lengths of shaft 70 and cantilevers 72 are preferably such that pegs 76 are located on inner surfaces of pads 74 proximate to the free ends of cantilevers 72 at a point beyond the length of shaft 70 so that inward movement of the pegs will not be obstructed by the shaft, as best shown in FIGS. 21-23. Preferably, shaft 70 and pegs 76 are arranged and oriented in cooperation with the placement of eyeholes 66 in barrel 50 of lock 16 such that the pegs are transversely aligned with the eyeholes when pilot 80 engages or abuts key-receiving end 60 of lock 16. This advantageously eliminates or reduces the need for the store personal to carefully align each peg 76 with a corresponding eyehole 66, thereby simplifying and speeding up the peg and eyehole alignment process.

It will be appreciated that although pegs 76 on key 18 and eyeholes 66 in lock 16 may be generally circular or round in shape as shown, other suitable shaped pegs and eyeholes may be used so long as eyeholes 66 are configured to receive pegs 76 therethrough for engaging cantilevers 22 of spine 20 when lock 16 is seated on spine 20. Accordingly, the invention is not limited by the shape of the pegs and eyeholes.

Support frame 12 and lock 16 are preferably formed of a semi-rigid and flexible material such as a polymer in some embodiments, as are cantilever beams 22 such that cantilever beams 22 may be deflected or biased inwardly by engagement with lock 16. Preferably, the material selected for cantilever beams 22 is elastically deformable such that the beams may be deflected but will automatically return towards their undeflected original conformation. In other embodiments, support frame 12 and/or lock 16 may be made of a rigid, inelastic material so long as at least cantilever beams 22 are made of a flexible and resilient material for reasons further described herein. Key 18 is also preferably formed of a semi-rigid and flexible material such as a polymer material in some embodiments such that cantilevers 72 may similarly be deflected or biased inwardly toward each other and shaft 70 by a user. In other embodiments, key 18 may be made of a rigid, inelastic material so long as at least cantilevers 72 are made of a flexible and resilient material for reasons further described herein. In one embodiment, support frame 12, lock 16, and key 18 may be formed from an injection molded polymer such as a polycarbonate polymer such as Lexan™ plastic available from SABIC (Saudi Basic Industries Corp.) of Saudi Arabia. It will be appreciated, however, that other suitable polymers or non-polymeric materials may be used for these components provided that at least cantilever beams 22 and cantilevers 72 are formed of a resilient material that may be deflected or biased. In some embodiments, a combination of rigid materials and semi-rigid resilient materials may be variously used for key 18, lock 16, and support frame 12 so long as cantilever beams 22 and cantilevers 72 are formed of a resilient material.

A method of assembling and operating eyewear display assembly 10 to securely display eyewear will now be described with initial reference to FIG. 1.

Figure 14:
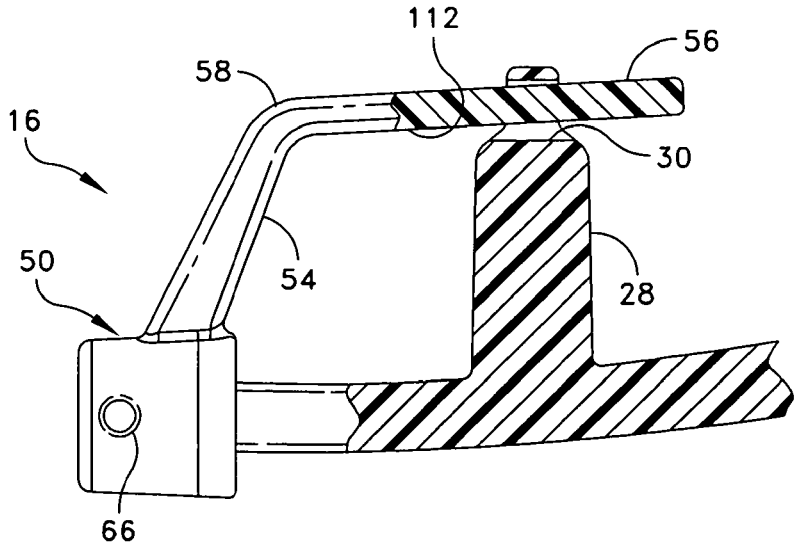
FIG. 14 is a cross sectional view of a portion of the lock and tower shown in FIG. 12, taken along plane 14-14.

Lock 16 is first aligned with and then assembled to the support frame 12 by inserting the cantilever beams 22 into the flange-receiving end 62 of the lock, and essentially simultaneously inserting the distal portion 56 of the lockbar 52 into the opening 30 of the tower 28. Lock 16 is applied or attached to the frame by pushing the cantilever beams 22 through central passageway 64 in the direction of the key-receiving end 60, and simultaneously pushing the lockbar 52 through the opening 30. The ridges 68 of lock 16 engage the tapered flanges 24 of the cantilever beams 22, causing the cantilever beams to deflect and be temporarily compressed and forced inwards towards each other as the cantilever beams 22 advance through central passageway 64. The cantilever beams 22 advance through central passageway 64 until the flanges 24 clear the ridges 68 towards end 60 of lock 16. When the flanges 24 clear the ridges 68, the cantilever beams 22 return to their uncompressed normal conformation due to the resilience of the cantilever beams that causes the flanges and cantilever beams to expand outwards and diverge. Locking surfaces 108 formed by ridges 68 of lock 16 become mutually engaged with locking surfaces 27 of cantilever beams 22, thereby locking lock 16 to support shaft 12 such that the lock cannot be removed from shaft by an unauthorized consumer. The lock 16 and the support frame 12 are now in a locked configuration, as shown in FIGS. 13 and 14. Distal portion 56 of the lockbar 52 is inserted into the opening 30 of the tower 28 such that the nose bridge 204 of a pair of eyeglass frames 200 are trapped between the lockbar 52 and spine 20. An axial force applied to pull lock 16 forward without extreme pressure that might otherwise damage support frame 12 will not disengage the lock from cantilever beams 22, thus securing the eyeglass frames 200 as shown in FIG. 15 between the lock and support frame.

In the locked configuration shown in FIGS. 13 and 14, the enlarged boss 23 formed on each cantilever beam 22 engages the shoulder portion 110 lock 16 limiting the insertion depth of the flanges 24 and cantilever beams 22 in central passageway 64 of the lock. The dimensions of the support frame 12 at the enlarged boss 23 location where the spine 20 meets the cantilever beams 22 are thus such that the spine 20 cannot advance through central passageway 64 past the ridges 68. This prevents the cantilever beams 22 from moving too far through central passageway 64 towards the key-receiving end 60 to ensure that the lockbar 52 remains inserted through opening 30 in tower 28 such that the eyeglass frames 200 cannot be removed without employing key 18. In other embodiments, central passageway 64 may not extend completely through the key-receiving end 60, thereby limiting the insertion depth of the flanges 24 and cantilever beams 22. In the locked configuration, the cantilever beams 22 and flanges 24 are preferably dimensioned and configured with ridges 68 of lock 16 such that the cantilever beams 22 cannot move a significant distance through central passageway 64 in either a rearward or forward direction (see FIG. 13). The barrel 50 of lock 16 is substantially immobilized around the cantilever beams 22, confining the lockbar 52 within the opening 30 of the tower 28. The spine 20, lock 16 with barrel 50 and lockbar 52, and tower 28 together form a selectively openable and closeable loop 112 as shown in FIG. 15. The diameter of the closed loop 112 may vary, but the diameter or size of the loop opening at every point along or around the perimeter of the closed loop is preferably smaller than the diameter at every point along the lens support portion 206 of the eyeglass frame 200. This traps nose piece 204 of eyeglass frames 200 in the closed loop 112 and prevents the eyewear frame from being removed laterally through the loop to defeat the lock 16. Accordingly, in one embodiment, loop 112 is movable between a closed position in which eyeglass frames 200 cannot be removed from the loop and an open position in which eyeglass frames 200 may be freely removed from the loop.

Figure 19:
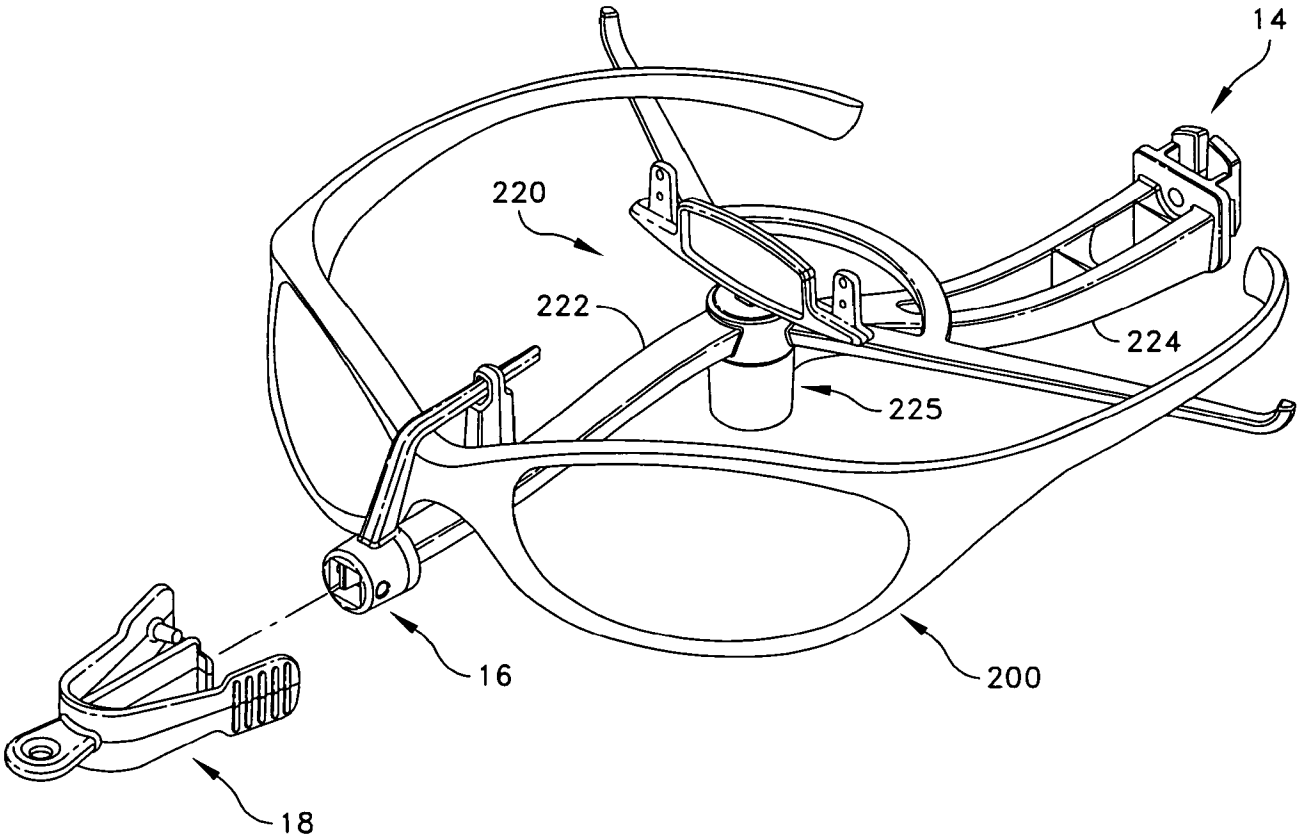
FIG. 19 is a perspective view of the fully assembled second embodiment of the display assembly shown with the lock installed and a pair of eyeglass frames secured in the display assembly, and the key aligned with the lock.
Figure 20:
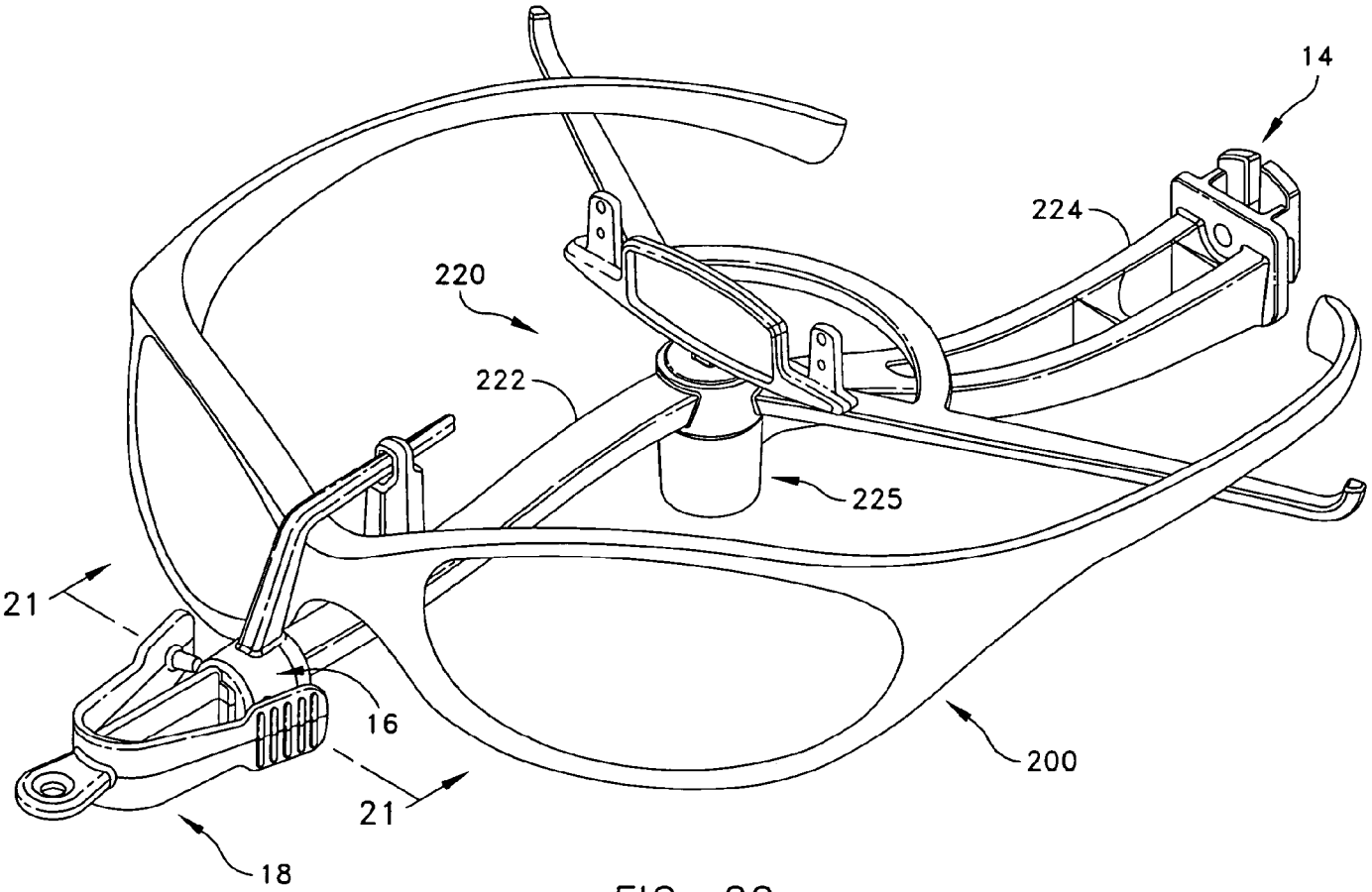
FIG. 20 is a perspective view of the fully assembled second embodiment of the display assembly shown with the lock installed and a pair of eyeglass frames secured in the display assembly, and the key engaged with the lock.
Figure 24:
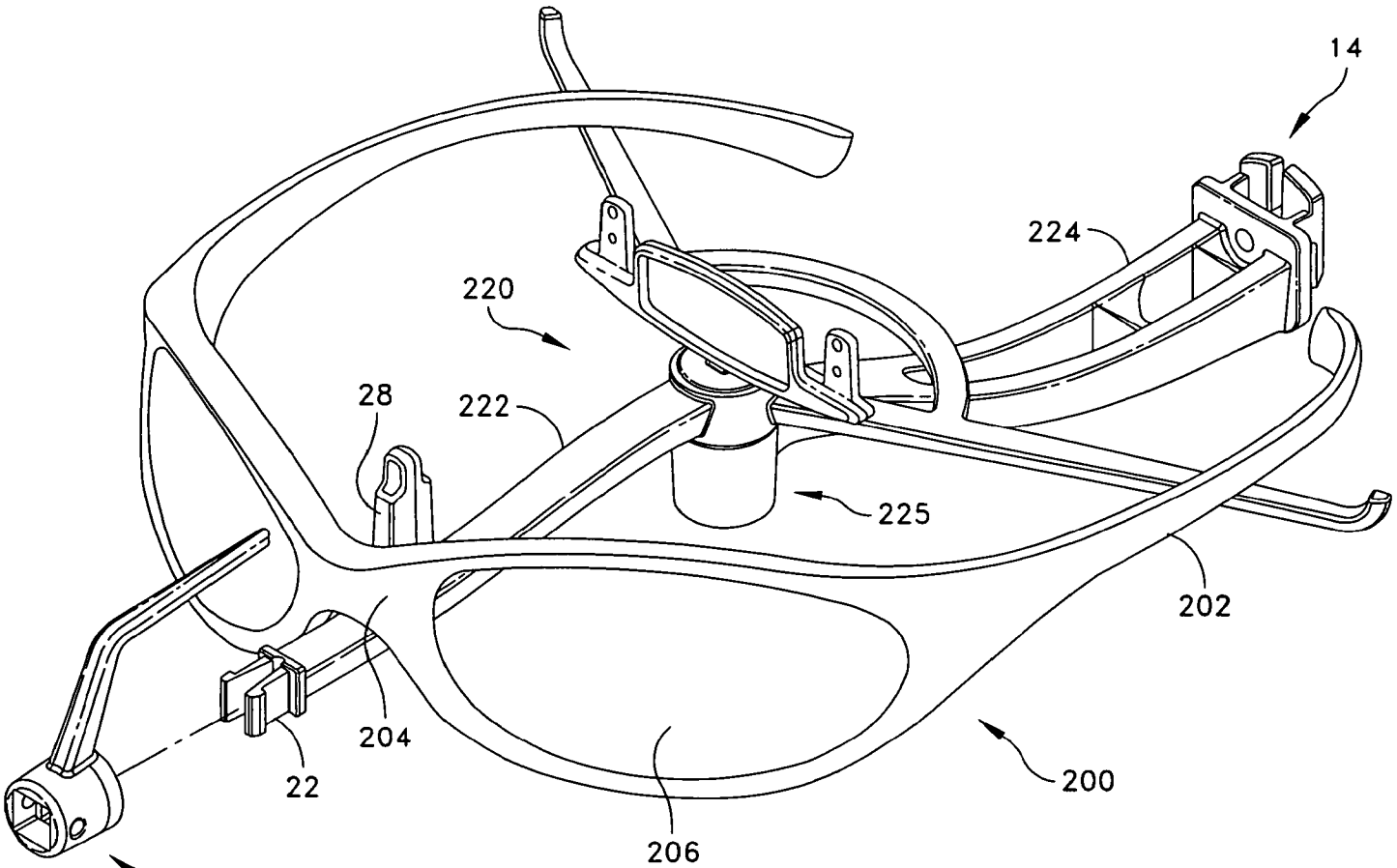
FIG. 24 is a perspective view of the fully assembled second embodiment of the display assembly shown with the lock removed from the display assembly and a pair of eyeglass frames openly supported in the display assembly.

To release the lock 16 from the support frame 12, a user selectively engages the cantilever beams 22 with the cantilevers 72 of the key 18. Reference is made to FIGS. 19-24. In one embodiment, a user holds the key 18 by the finger grip pads 74 between the fingers, and aligns the guide or pilot 80 of the key 18 with the key-receiving end 60 of the barrel 50 as shown in FIG. 19. The user then inserts and/or abuts the pilot 80 of key 18 against lock 16 as shown in FIGS. 20 and 21. Preferably, key 18 is mutually configured and dimensioned with lock 16 such that pegs 76 of the key are each aligned with a corresponding eyehole 66 in lock 16. As shown by the directional arrows in FIG. 22, the user next then squeezes cantilevers 72 of key 18 together which applies inward force on both cantilevers 72, causing the cantilevers 72 to move inwards towards each other in the direction of the shaft 70. As the cantilevers 72 move towards the shaft 70, the pegs 76 on key 18 enter the eyeholes 66 of the barrel 50. The pegs 76 move through the eyeholes 66 and preferably engage the cantilever beams 22 on spine 20, and more preferably in some embodiments engage flanges 24 of the beams 22. The user applies sufficient force to cantilevers 72 so that pegs 76 displace the cantilever beams 22 towards each other within central passageway 64, until the flanges 24 clear the ridges 68 as shown in FIG. 22. This disengages locking surfaces 108 of lock 16 from corresponding locking surfaces 27 of flanges 24. As shown in FIG. 23, the user then pulls the barrel 50 in a forward axial direction away from the spine 20 (as shown by the directional arrow) while maintaining the inward force on the cantilevers 72 of key 18, thereby removing the lock 16 from the support frame 12 as shown in FIG. 24. Lockbar 52 of lock 16 is concurrently disengaged from opening 30 of tower 28 to free the eyeglass frames 200 and allow the store personnel to remove the eyeglass frames from support frame 12 for inspection by the consumer.

Figure 5:
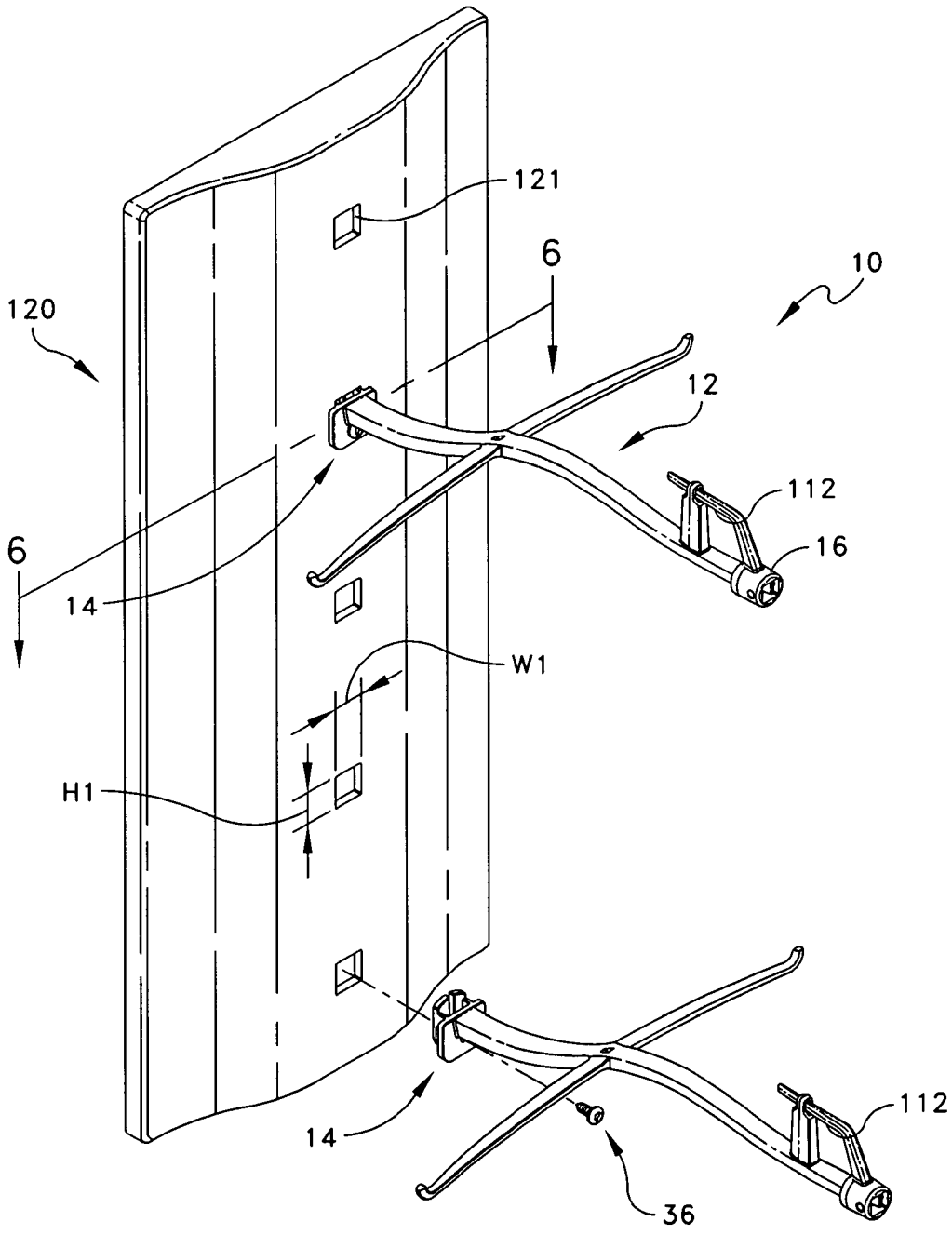
FIG. 5 is a perspective view of display assemblies shown mounted in and unmounted to a display object.

In use, one or more frames 12 may be anchored to a display object 120 such as the one shown in FIG. 5. The frames 12 are preferably anchored to a substantially vertical surface on the display object. In one embodiment, display object 120 may be columnar in shape; however, numerous other possible shapes. Accordingly, such display objects 120 may include furniture and fixtures such as without limitation racks, cabinets, counters, walls, easels, columns, and boards. The support frame 12 is anchored to the display object 120 by anchor 14. The anchor 14 is preferably applied to the display object such that the support frame 12 is oriented with the tower 28 extending generally upwards and vertically.

In one possible embodiment of the anchor 14 without tabs 44 and panels 46 (not shown), plate 34 of anchor 14 is simply positioned flush against the vertical surface of the display object 120. The screw 38 is inserted through the pilot hole 36 of anchor 14 and embedded into the display object 120, securing the support frame 12 to the display object.

In another possible embodiment, as shown in FIGS. 5 and 6, anchor 14 is provided with plate 34 having a pair of tabs 44 connected to the plate by a pair of space part side panels 46. Display object 120 may correspondingly define a plurality of portals 121 for receiving a portion of anchor 14 therethrough, including tabs 44 and panels 46 in some embodiments. The display object 120 preferably has a portal 121 extending completely therethrough, at the location where the support frame 12 is to be anchored. The part of the display object 120 to which the support frame 12 will be anchored preferably has a thickness that is less than the depth of the panels 46 so that at least a portion of the panels 46 may project rearwards from the display object when support frame 12 is inserted through portal 121. The dimensions of the portal 121 defined by width W1 and height H1 are preferably smaller than the dimensions of the plate 34. In one embodiment, width W1 of portal 121 may be smaller than the maximum width W2 of anchor 14 measured from the outside of one panel 46 to the other panel so that the panels and tabs 44 attached thereto may be inserted through the portal and secured therein as shown in FIG. 6. In some embodiments, panels 46 may have protrusions 122 that increase the width W2 of the panels at one location on each panel. Protrusions 122 are preferably arranged on panels 46 such that the protrusions will emerge from portal 121 on the side of display object 120 opposite plate 34 when support frame 12 is fully inserted in portal 121, and more preferably protrusion 122 will engage a rear surface 124 to further secure the frame to the display object.

To anchor the support frame 12, the tabs 44 and panels 46 are inserted through the portal 121 on one side of the display object 120 at an angle with respect to the direction such as width W1 in which the portal is smaller than the width W2 of the panels. The panels 46 and tabs 44 are temporarily compressed or flexed inwards towards each other and advance through the portal 121 until the tabs 44 and protrusions 122 emerge from the portal on rear surface 124 of the display object 120. The support frame 12 is then straightened by a user until at least a portion of the plate 34 and at least a portion of the tabs 44 are positioned approximately parallel and flush with opposite front and rear surfaces 124 and 123, respectively, of the display object 120. Panels 46 and tabs 44 expand and return to their original configuration. The panels 46 remain positioned within the portal 121 engaging the sides of the portal while protrusions 122 engage rear surface 123 of display object 120 as shown in FIG. 6 to secure support frame 12 to the display object. Although support frame 12 is already secured in portal 121 of display object 120, screw 38 may optionally be inserted through the pilot hole 36 and between tabs 44 into gap 104 to further secure the frame to the display object and prevent unauthorized removal of the frame. As the screw 38 is rotated by the user and advances axially between the tabs 44, the widening cross sections of the screw 38 engage and gradually force the tabs 44 to move apart, expanding panels 46 of anchor 14 to further engage side surfaces of portal 121. The expansion of the anchor in and around the portal 14 immobilizes the anchor 14 in the portal, further securing the support frame 12 to the display object 120.

In one embodiment of the screw 38, the head 40 preferably defines a slot configuration that that receives a tool other than a standard flathead or Phillip's screwdriver. In one embodiment, the slot configuration may be a star-shaped slot that is operated by a torx head screwdriver. Other suitable and secure conventional special-shaped slots and corresponding tools may be used. The requirement for a specialized or uncommon tool to insert and remove the screw 38 from display object 120 provides an added theft deterrent, because the support frame 12 is not otherwise removable from the display object 120 without damaging these components unless screw 38 is first removed.

In use, eyeglass frames 200 are placed on each of the one or more frames 12 anchored to the display object 120. In a preferred embodiment, the ear pieces 202 of the eyeglass frames 200 rest on the arms 26*a* and 26*b*. The nose bridge 204 of the eyeglass frames 200 rests on the supporting surface 100 of the spine 20 between the tower 28 and the cantilever beams 22, such that one of the lens support portions 206 of the eyeglass frame is disposed on either side of the spine. Once the eyeglass frames 200 is properly positioned on the support frame 12, the lock 16 may be applied to the support frame 12 in the manner described herein. When the lock 16 and support frame 12 are in the locked configuration, as shown in FIGS. 13 and 14, the nose bridge 204 of the eyeglass frames 200 sits in the closed loop 112 formed by the spine 20, barrel 50, lockbar 52, and tower 28. The size of the closed loop 112 prevents the lens support portions 206 of eyeglass frames 200 from passing through the closed loop, which prevents the eyewear from being removed from the support frame 12.

To remove the eyeglass frames 200 from support frame 12, key 12 is used to remove the lock 16 from the support frame 12 in the manner described herein which opens loop 112. The lock 16 and the key 18 may be held by store personnel while the eyeglass frames are handled by a consumer.

An advantage of the present invention is that locking eyeglass frames on a support frame 12 and anchoring the support frame 12 to a display object allows providers to display the eyewear without the risk of customers and passersby taking the eyewear off of the frames 12 and carrying it away. Securing eyewear to display objects avoids the need for glass display cases, and allows eyewear to be displayed where customers can see the eyewear up close. The eyewear display assembly 10 of the present invention further has an aesthetically pleasing appearance. The eyewear display assembly 10 further is free from bulky or awkward parts, and free from cumbersome chains or cables. The lock 16 can be removed with the key 18 and re-applied by personnel quickly, easily, and repeatedly to allow customers to fully access displayed eyewear in a controlled and efficient manner.

Another advantage of the present invention is that the eyewear display assemblies 10 are lightweight and can be anchored to display objects that are portable. Portable display objects can be rearranged, added, or removed from a display room to accommodate the provider's changing inventory. The eyewear display assemblies 10 can be removed from the display objects by removing the screw 38. Individual assemblies 10 can be rearranged on the display object or removed and stored for later use.

According to another embodiment, a support frame 220 is provided that allows at least a portion of the frame to be swiveled or articulated with respect to another portion of the frame and anchor 14. Referring to FIGS. 8-12, an articulating support frame 220 includes a longitudinally-extending stationary spine 224 coupled to anchor 14 and a longitudinally-extending movable spine 222. In one embodiment, movable spine 22 is preferably supported by stationary spine 224 and movable with respect to the stationary spine. In one embodiment, stationary spine 224 is rigidly coupled to anchor 14 so there is no relative movement between the stationary spine and the anchor. Anchor 14, lock 16, and key 18 may generally be similar in configuration and arrangement as described elsewhere herein, and function in a similar manner.

Figure 9:
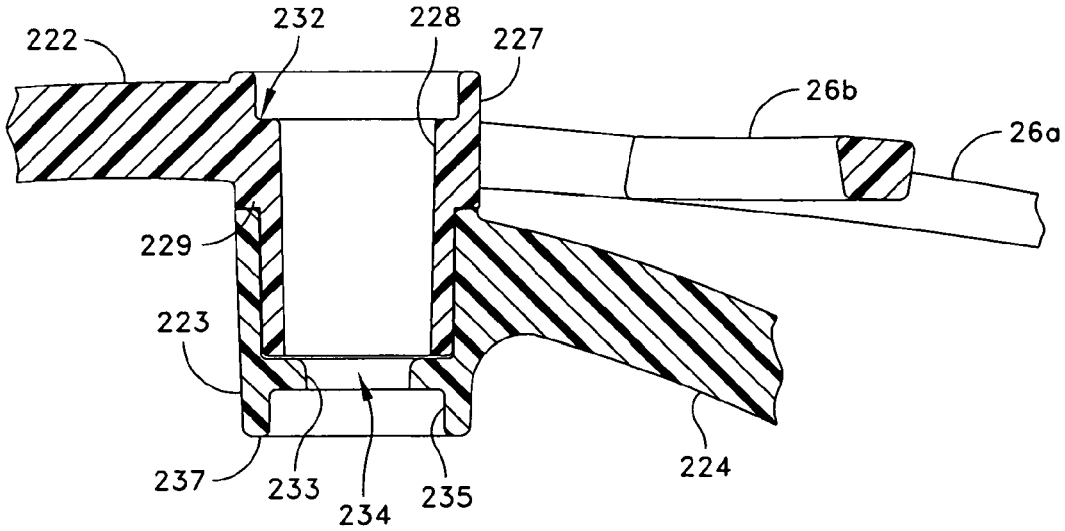
FIG. 9 is a cross sectional view of the articulating joint shown in FIG. 8, taken along plane 9-9.
Figure 10:
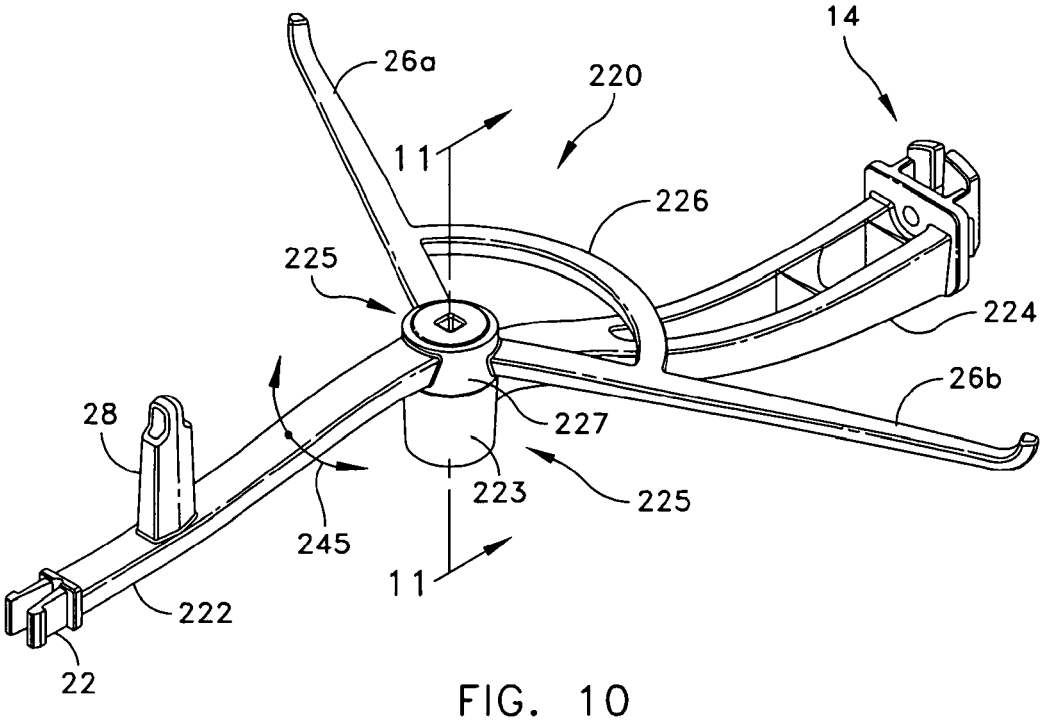
FIG. 10 is a perspective view of the fully assembled second embodiment of the display assembly.

Stationary spine 224 and movable spine 222 are rotatably coupled together by an articulating joint 225, as shown in FIG. 10. In one embodiment, joint 225 allows movable spine 222 to be rotated arcuately with respect to stationary spine 224. Referring to FIGS. 7-12, articulating joint 225 is formed by collar 223, sleeve 227, and pin 229 which may be assembled together as illustrated and further described herein. Joint 225 defines an axis of rotation Ar (see FIG. 11) that is generally perpendicular to the length of stationary and movable spines 224 and 222, respectively. Accordingly, in one possible embodiment as shown, movable spine 222 is pivotable about a vertical axis of rotation Ar through a generally horizontal plane defined perpendicular to the axis of rotation. This embodiment allows the movable spine 222 to be swiveled in two directions for displaying eyeglass frames 200 to consumers and allowing consumers to inspect different portions of the frames.

Figure 7:
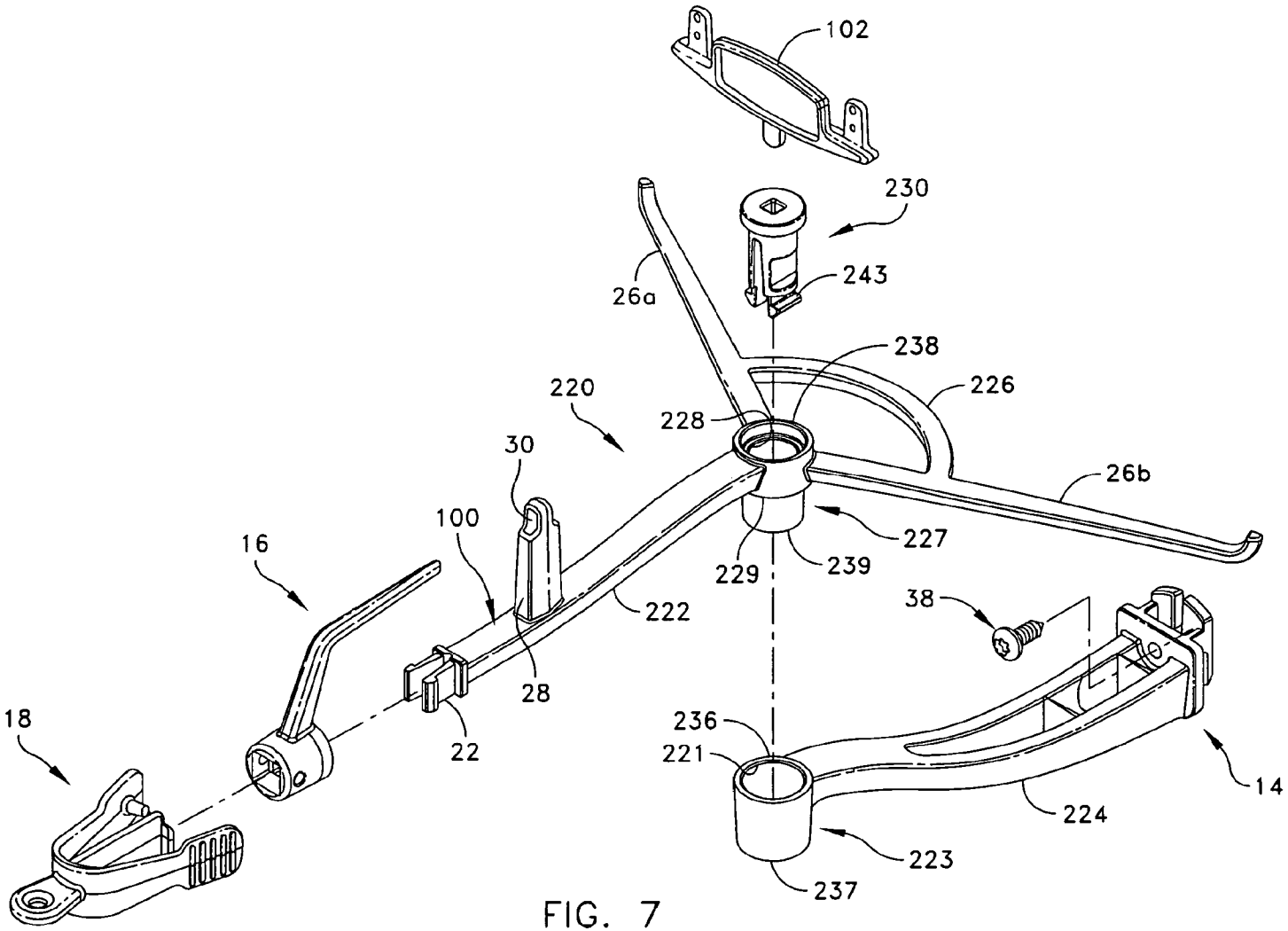
FIG. 7 is an exploded perspective view of a second embodiment of display assembly having an articulating joint.
Figure 8:
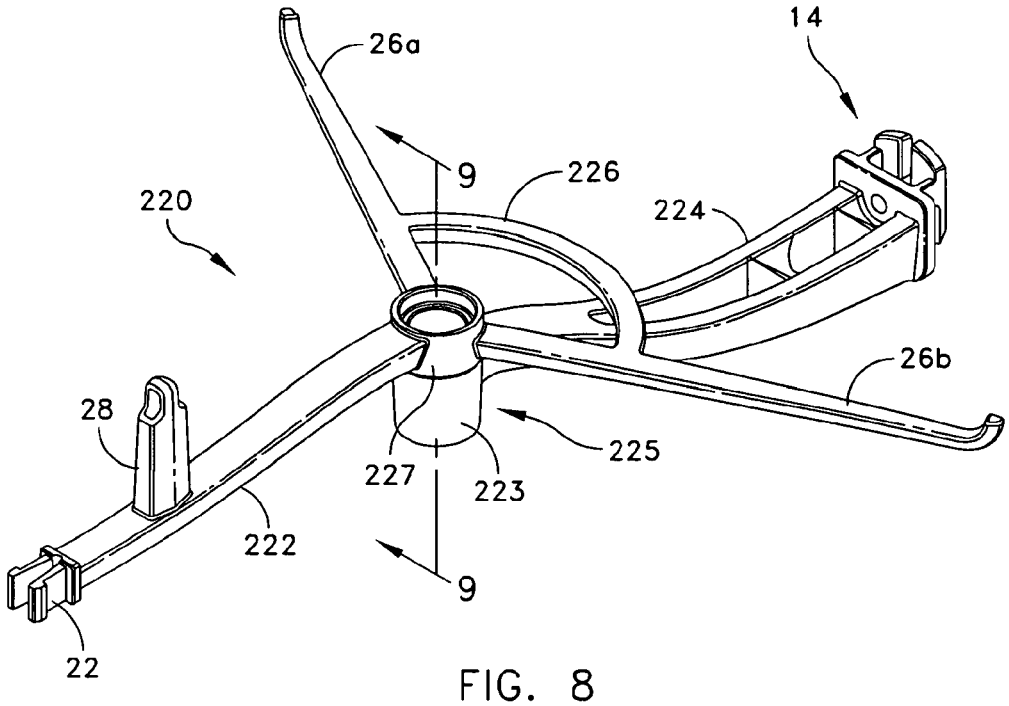
FIG. 8 is a perspective view of the partially assembled second embodiment of the display assembly.
Figure 11:
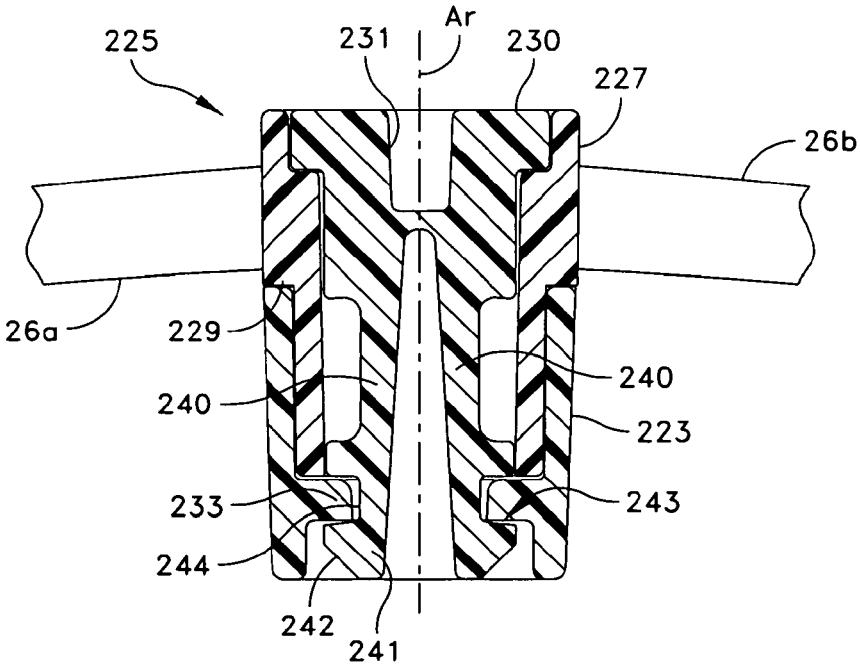
FIG. 11 is a cross sectional view of the articulating joint shown in FIG. 10, taken along plane 11-11.

Referring now particularly to FIGS. 7, 9, and 11, collar 223 may be generally cylindrical in shape; however, other suitable shapes are possible. Collar 223 includes an upper end 236, a lower end 237, and further defines an axial socket 221 configured to receive sleeve 227. In one embodiment, collar 223 may be formed on a terminal end of stationary spine 224. Socket 221 may extend completely through collar 223 as shown in FIG. 9 from upper end 236 of the collar to opposite lower end 237. Collar 223 may further define an annular ledge 233 disposed in socket 221 which defines a reduced diameter opening 234. Ledge 233 may engage and assist in supporting sleeve 227. In some embodiments, ledge 233 may be spaced inward from the lower end of collar 223 (as best shown in FIG. 9) to further define a receptacle 235 within socket 221 located below the ledge. Receptacle 235 preferably has a diameter larger than the diameter of reduced diameter opening 234.

Referring to FIGS. 7, 9, and 11, sleeve 227 may have a generally cylindrical shape in one embodiment and be disposed on movable spine 222. In one embodiment, sleeve 227 may be disposed on a terminal end of movable spine 222. Sleeve 227 is mutually dimensioned and configured with collar 223 so that at least a portion of the sleeve may be received in socket 221 to form a rotatable articulating joint 225. The exterior surface of sleeve 227 may include an annular step 229 configured and adapted to engage collar 223. Step 229 may both limit the insertion depth of sleeve 227 into collar 223 and serve to support sleeve 227 in collar 223. In one embodiment, sleeve 227 defines an axial opening 228 that preferably extends completely through the sleeve from upper end 238 to opposite lower end 239. As best shown in FIG. 9, sleeve 227 may further define an annular surface 232 disposed in opening 228.

Referring to FIGS. 7-12, arms 26*a* and 26*b*, which support the earpieces 202 of eyeglass frames 200, are preferably attached to or formed integral with movable spine 222 so that rotating spine 222 also articulates the arms in unison therewith. In one possible embodiment, arms 26*a* and 26*b* may be attached to or formed integral with sleeve 227 and extend outwards therefrom as best shown in FIG. 7. A lateral brace 226 may be provided extending between arms 26*a* and 26*b* to further stabilize and support the arms.

Referring to FIGS. 7 and 11, pin 230 includes a pair of resilient prongs 240 for pivotably coupling sleeve 227 to collar 223. Prongs 240 are preferably spaced apart from each other in a normal undeflected condition. Pin 230 is configured and adapted to be received through opening 228 of sleeve 227 and engage collar 223 while permitting pivotable movement between the sleeve and collar, and concomitantly between movable spine 222 and stationary spine 224. Conceptually, prongs 240 function in a similar manner to flanges 24 disposed on cantilever beams 22 shown in FIG. 13 and described herein. Each prong 240 includes a flange 241 having a wedge-shaped ramp 242 and an engaging surface 243 adapted to engage ledge 233 of collar 223 as shown in FIGS. 7 and 11. In some embodiments, as shown in FIG. 11, prongs 240 may each define a groove 244 configured to receive at least a portion of annular ledge 233 of collar 223. In some embodiments, pin 230 may have a recess 231 disposed in a top surface of the pin that is configured to receive and mount a display card or price tag holder 102 shown in FIG. 7.

Collar 223, sleeve 227, and pin 230 may be made of similar materials to support frame 12, lock 16, and key 18 as already described herein such as a flexible and semi-rigid polymer in some embodiments. Preferably, at least pin 230 is made of a flexible material to provide elastically deformable prongs 240. In some embodiments, collar 223 and sleeve 227 are formed as integral parts of stationary spine 224 and movable spine 222, respectively. In other embodiments, collar 223 and sleeve 227 may be separate components attached to stationary spine 224 and movable spine 222, respectively, by any means conventionally used in the art.

Figure 12:
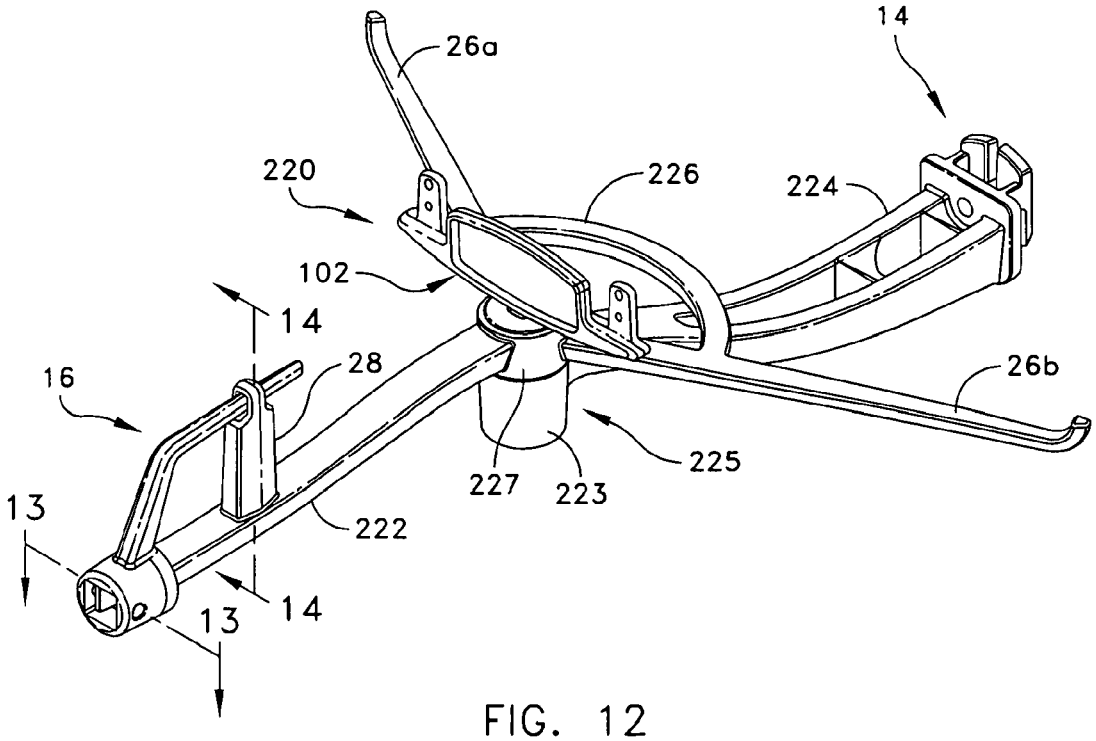
FIG. 12 is a perspective view of the fully assembled second embodiment of the display assembly shown with the lock installed.

Referring to FIGS. 7-12, articulating joint 225 may be assembled in the following manner either before or after stationary spine 224 is mounted to display object 120 via anchor 14. Sleeve 227 is first inserted into the top of collar 223 to form the assembly shown in FIGS. 8 and 9. Sleeve 227 engages ledge 233 of collar 223 and annular step 229 of the sleeve engages the upper end 236 of the collar. In other embodiments not shown, sleeve 227 may alternatively be shorter in height than that shown in FIG. 9 such that the sleeve will not contact or engage ledge 233 when annular step 229 engages collar 223. In either scenario, sleeve 227 is now in position to be rotatably secured or locked to collar 233. Pin 230 is next inserted through sleeve 227 to engage collar 223. Prongs 240 on pin 230 will be initially spaced apart in an undeflected condition before being inserted into sleeve 227. As prongs 240 advance through sleeve 227, ramps 242 on flanges 241 will first encounter and engage annular ledge 233 of collar 223 as the flanges enter the near side reduced diameter opening 233. This will cause prongs 240 to flex inward towards each other and be compressed together, thereby allowing the prongs to be further advanced into collar 223. Eventually, flanges 241 will emerge from the far side of reduced diameter opening 233. When the flanges 241 clear opening 233, prongs 240 will elastically spring back apart and outwards from each other to their initial undeflected conformation. Engaging surfaces 243 on flanges 241 will engage ledge 233 of collar 223 as shown in FIG. 11 to secure and lock pin 230, collar 223, and sleeve 227 together forming the completed articulating joint 225. Eyewear display assembly 10 will now generally appear as shown in FIG. 12 after lock 16 is secured to movable spine 222 or in FIG. 15 with a pair eyeglass frames 200 placed on assembly 10 before lock 16 is applied.

Although articulating support frame 220 is shown combined with lock 16 in the figures, it will be appreciated that in other embodiments the articulating support frame 220 may be provided without the locking feature. Accordingly, the invention is not limited to the combination of lock 16 with articulating support frame 220 alone.

Figure 16:
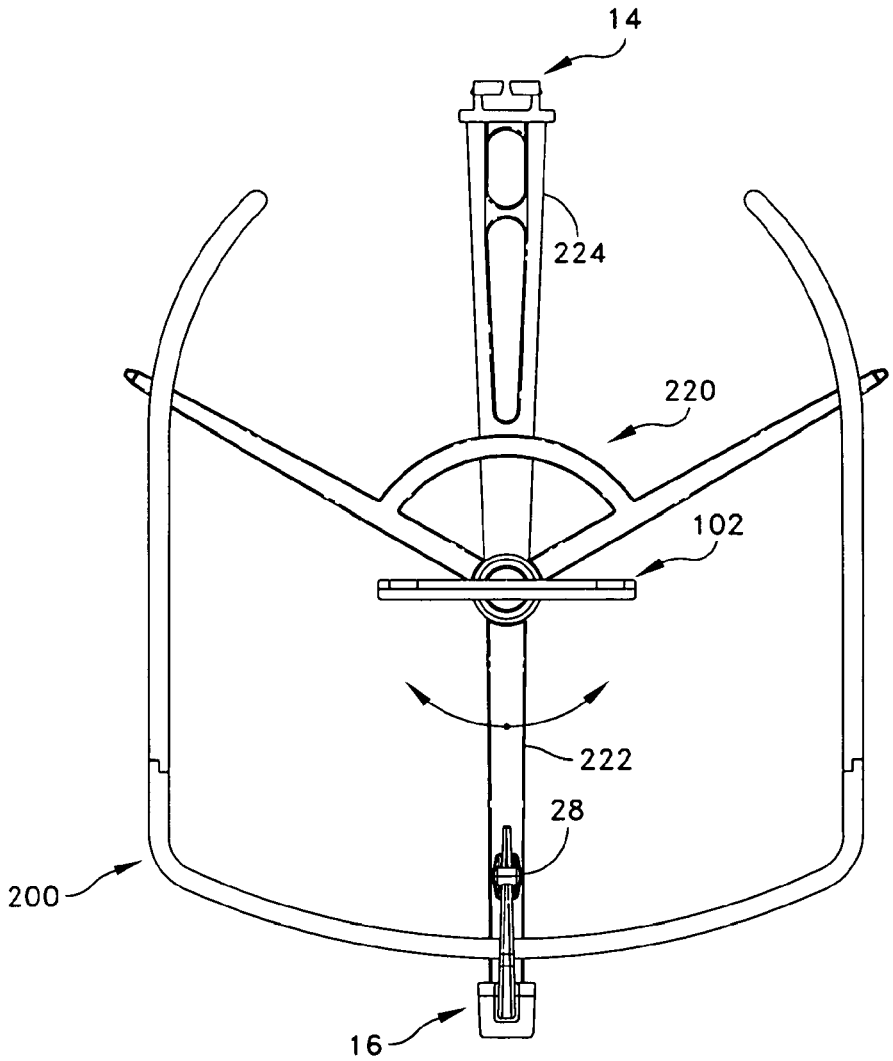
FIG. 16 is a top view of the second embodiment of the display assembly shown in a first position.
Figure 17:
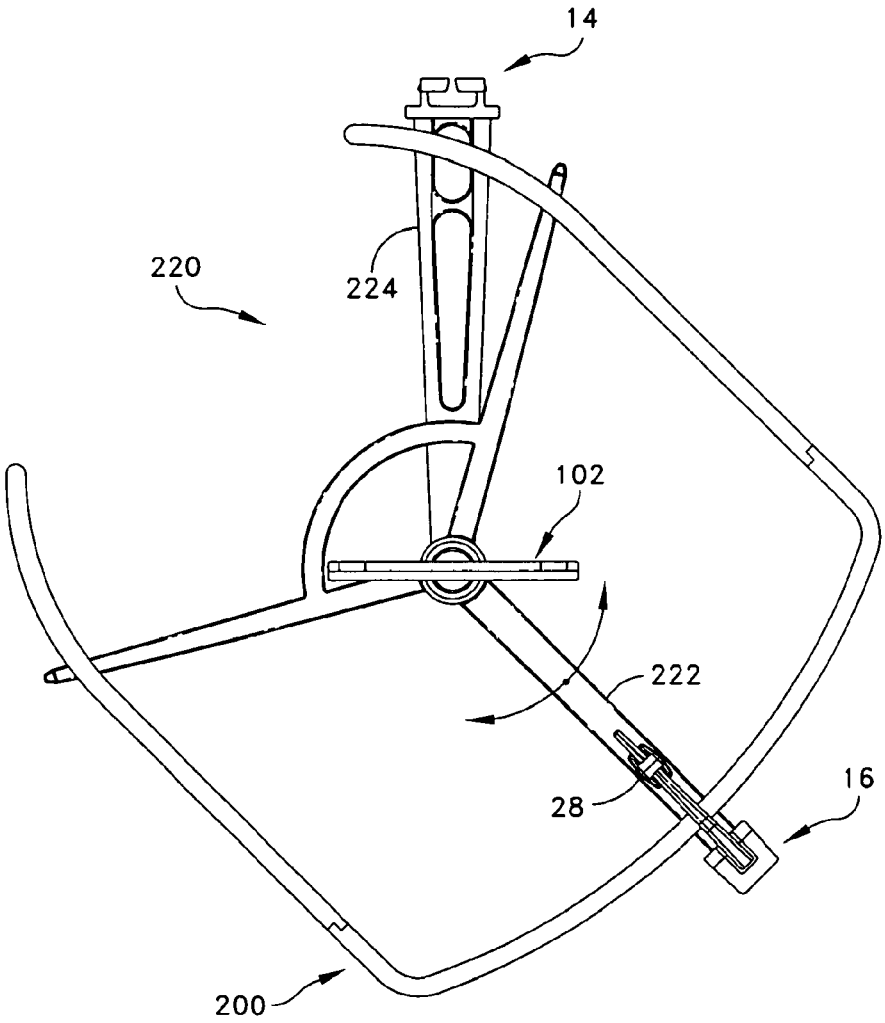
FIG. 17 is a top view of the second embodiment of the display assembly shown in an angled second position.
Figure 18:
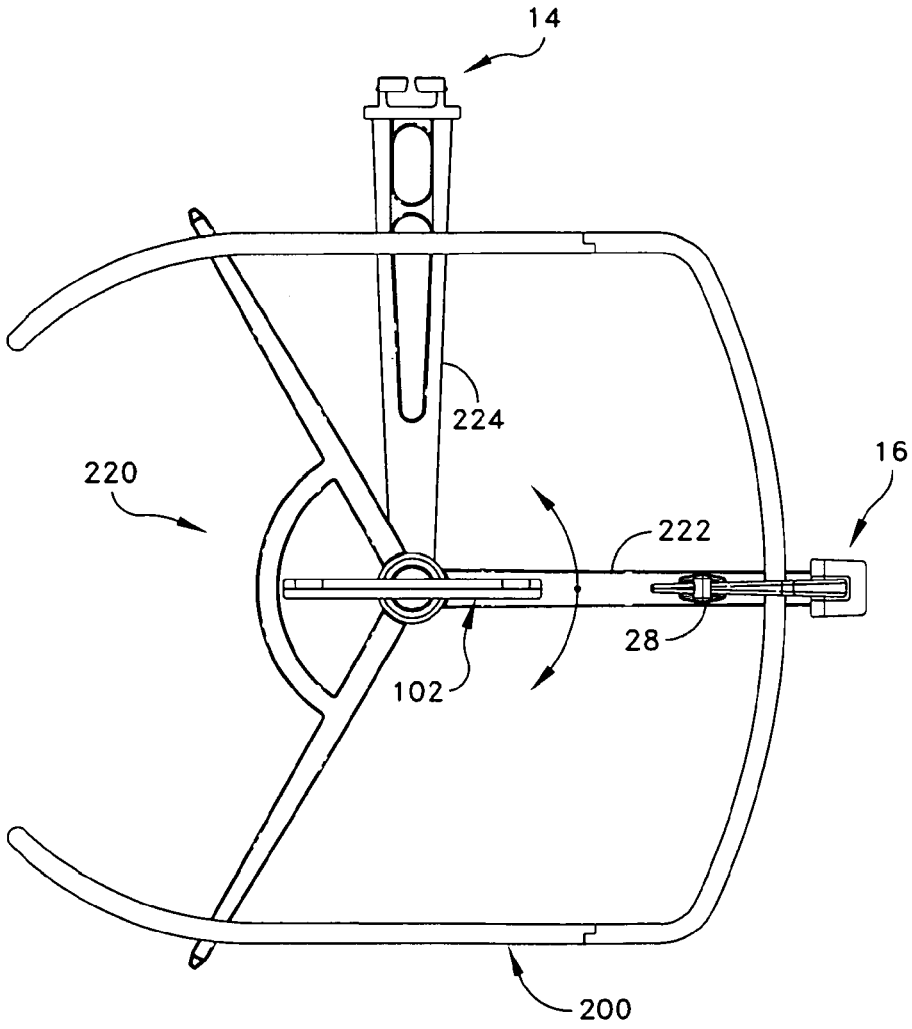
FIG. 18 is a top view of the second embodiment of the display assembly shown in an angled third position.

FIGS. 16-18 show articulating support frame 220 in various exemplary possible positions wherein movable spine 222 is selectively rotatable by a user with respect to stationary spine 224. FIG. 16 shows support frame 220 in a first fully forward position in which movable spine 222 is substantially aligned axially with stationary spine 224. In FIG. 17, movable spine 222 has been rotated laterally and angled approximately 45 degrees with respect to stationary spine 224 in a second possible position. FIG. 18 shows movable spine 222 rotated further laterally and angled approximately 90 degrees with respect to stationary spine 224 in a third possible position. Preferably, movable spine 222 may be rotated in either left or right lateral directions (as viewed in FIGS. 16-18) along a generally horizontal plane with respect to stationary spine 224. In a preferred embodiment, movable spine 222 is movable along a continuum of possible positions in either direction with respect to stationary spine 224. Accordingly, in this embodiment, it will be appreciated that movable spine 222 may be positioned at numerous possible positions with respect to stationary spine 224 between the exemplary positions shown in FIGS. 16-18 and beyond. In some embodiments, movable spine 222 may be completely rotated 360 degrees around articulating joint 225 so long as adequate clearance is provided to allow the mounted eyeglass frames 200, arms 26*a* and 26*b*, and movable spine 222 to be freely rotated without interfering with display object 120 (shown in FIG. 5).

Articulating support frame 220 advantageously allows unique temple or earpiece designs of eyeglass frames to be displays to consumers. Moreover, in some embodiments where articulating support frame 220 is combined with the lock 16 described herein, a consumer may rotate the eyeglass frames to inspect the front and sides while the eyeglass frames remain securely locked to support frame 220.

Figure 25:
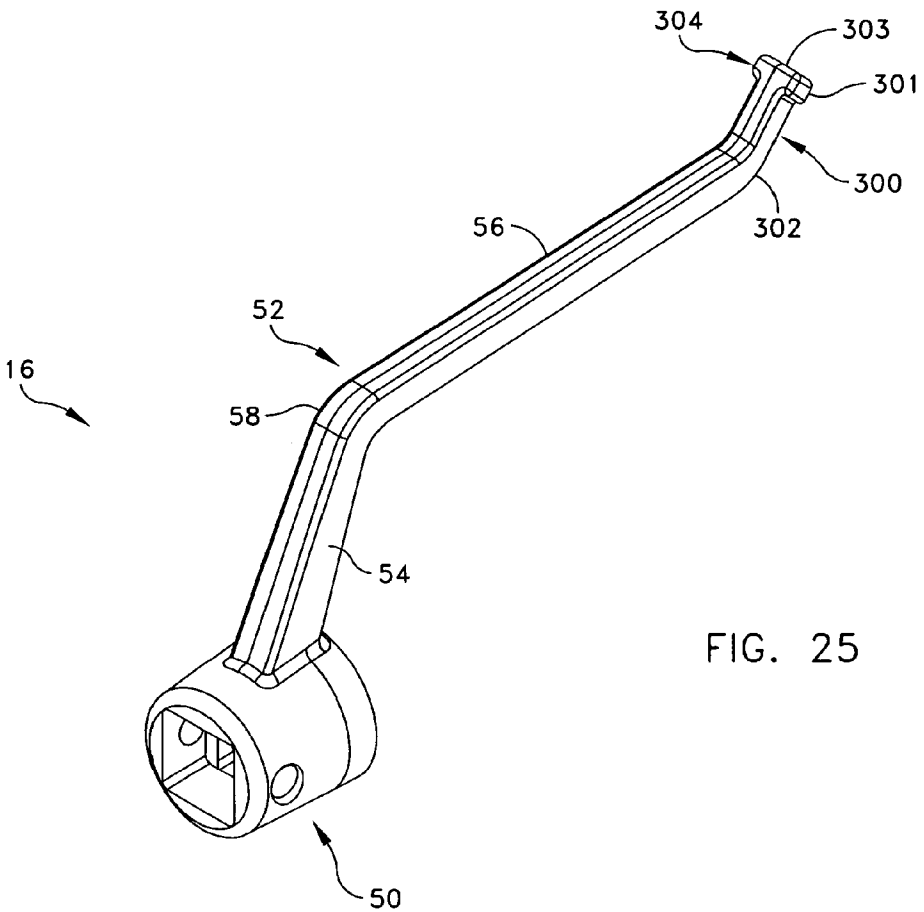
FIG. 25 is a front perspective view of a second embodiment of a lock of the display assembly.
Figure 26:
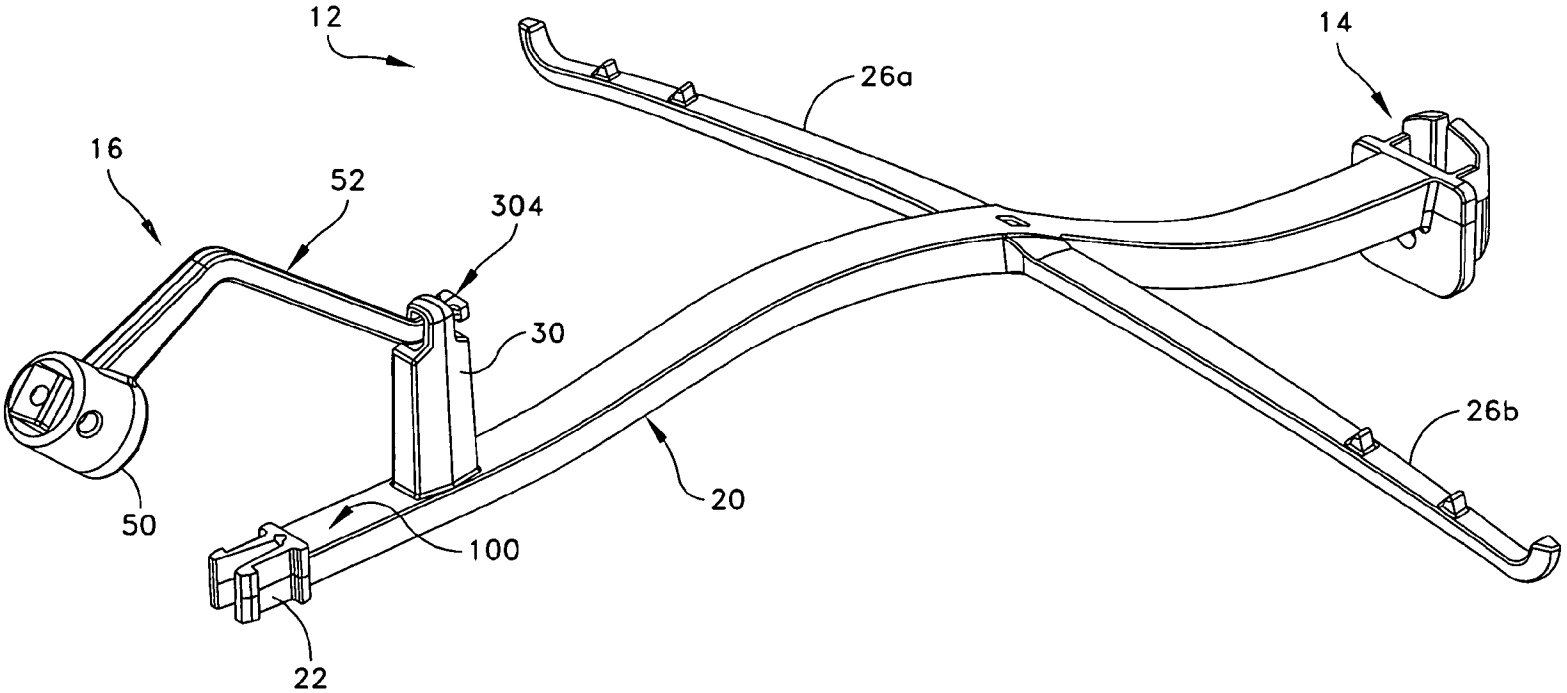
FIG. 26 is a front perspective view of the second embodiment of FIG. 25 in an open position attached on the display assembly.

FIG. 25 shows an alternative embodiment of a lock 16 which is configured to further secure the lock to spine 20 of display assembly 10. Barrel 50 is similar to that shown and described herein with respect to FIGS. 2 and 3 including the appurtenances and openings provided therein. Distal portion 56 of lockbar 52, however, is provided with an upward flared section 300 formed by an elbow 302 disposed near free end 303 of the lockbar. In a preferred embodiment, free end 303 includes a retaining member 304 that is configured and adapted to fit through opening 30 defined at the top end of tower 28 which is disposed on spine 20 (see, e.g. FIG. 1). In one possible embodiment, retaining member 304 is configured as a "T-shaped" section having opposing ends 301 that preferably extend laterally outwards farther than the sides of lockbar 52 near free end 303. T-shaped retaining member 304 is preferably sized in cooperation with opening 30 of tower 28 so that the retaining member will fit through the opening when oriented in at least one direction. For example, in some embodiments opening 30 may have a great height than width so that T-shaped retaining member 304 can readily be passed through the opening if the lockbar 52 is oriented 90 degrees sideways. After the T-shaped retaining member 301 passes through opening 30, lockbar 52 can be uprighted to the position shown in FIG. 26. The lockbar 52 is now secured through opening 30 in tower 28 so that the lockbar cannot be readily withdrawn from the tower when slid forwards towards cantilever beams 22 on spine 20. As shown in FIG. 26, opposing ends 301 of retaining member 304 will engage the tower 28 to advantageously prevent or at least hinder complete removal of lock 16 from spine 20 without undue force as an added measure of security if an unauthorized user attempts to withdraw the lockbar 52 from tower 28 with using the key 18 (see FIG. 4). When lock 16 is in this "open" position shown in FIG. 26, the eyeglasses and/or frame may be removed from spine 20 for viewing by a customer. Lock 16 may then be re-locked into a "closed" position similar to that shown in FIG. 12 (having alternatively a straight lockbar distal portion 56).

Referring to FIG. 26, elbow 302 of lockbar 52 in one embodiment is preferably configured and sized to create a snug friction fit between the lockbar and opening 30 in tower 28 when barrel 50 of the lock 16 is tilted upwards as shown. This allows the lockbar to be positioned and retained in the open position shown for convenience while a consumer is trying on eyewear.

Figure 27:
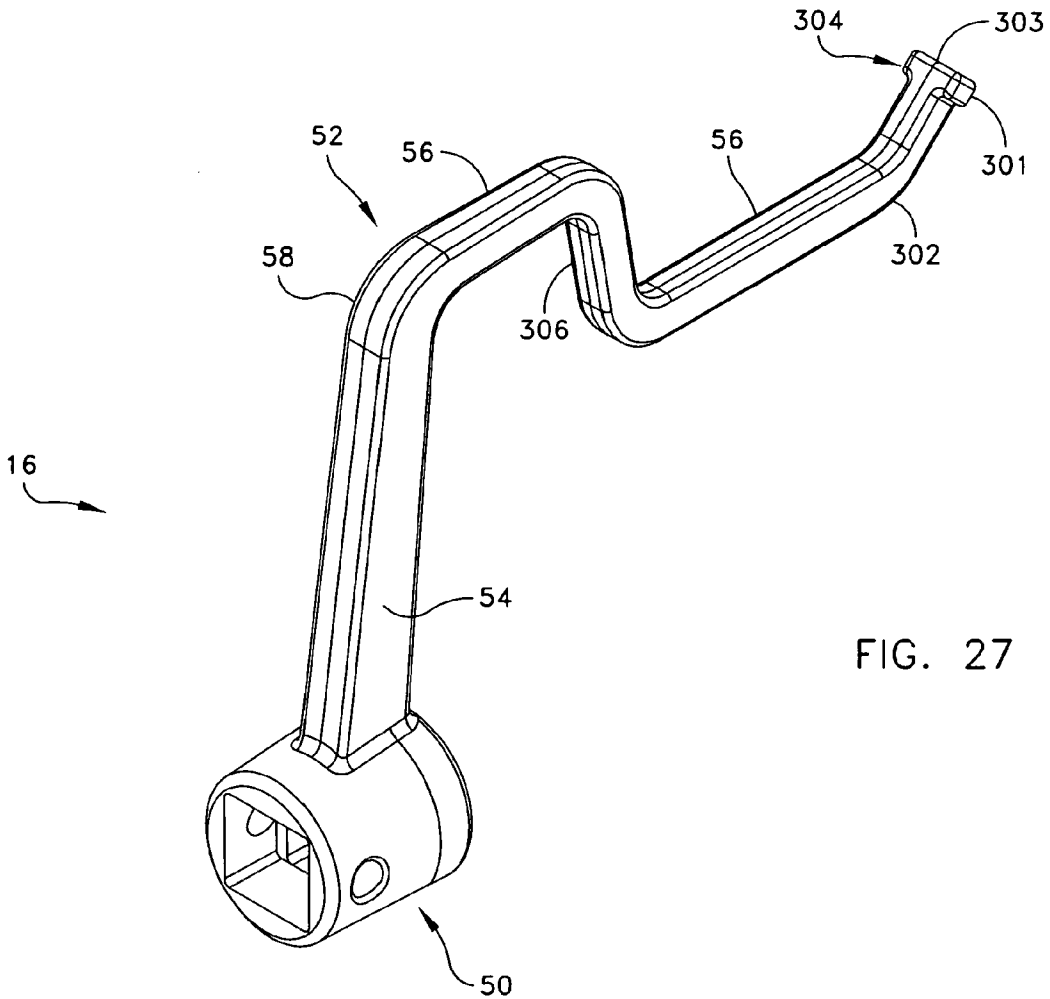
FIG. 27 is a front perspective view of a third embodiment of a lock of the display assembly.

FIG. 27 shows an alternative embodiment of a lock 16 with a lockbar 52 having a retaining member 304 that is essentially similar to that shown in FIGS. 25-26, with the exception that the lockbar contains a downward hook-shaped extension 306. This alternative design provided greater vertical clearance between lockbar 52 and horizontal supporting surface 100 of spine 20 on which the nose bridge 204 of the eyeglass frames 200 rests. This allows eyeglass frames having a taller or higher nose bridge 204 constructions and/or ornamentation to be accommodated.

Lockable Display System

According to another aspect of the present disclosure, a lockable object display system is provided that enables a plurality of individual eyewear and/or accessory object display supports to be mounted to a lockable display rod in a releasable and lockable secured manner. In some embodiments, removal of the object display supports is controlled via a key-operated cam lock that restricts access for removing the supports from the display rod to users possessing a specially configured key or tool necessary to operate the lock. This security feature is intended to eliminate unauthorized removal of the support frames and objects secured to the frames for theft reduction and/or to prevent the support frames from being accidentally dismounted from the display rod by users or customers when casually removing eyewear for closer inspection.

Figure 56A:
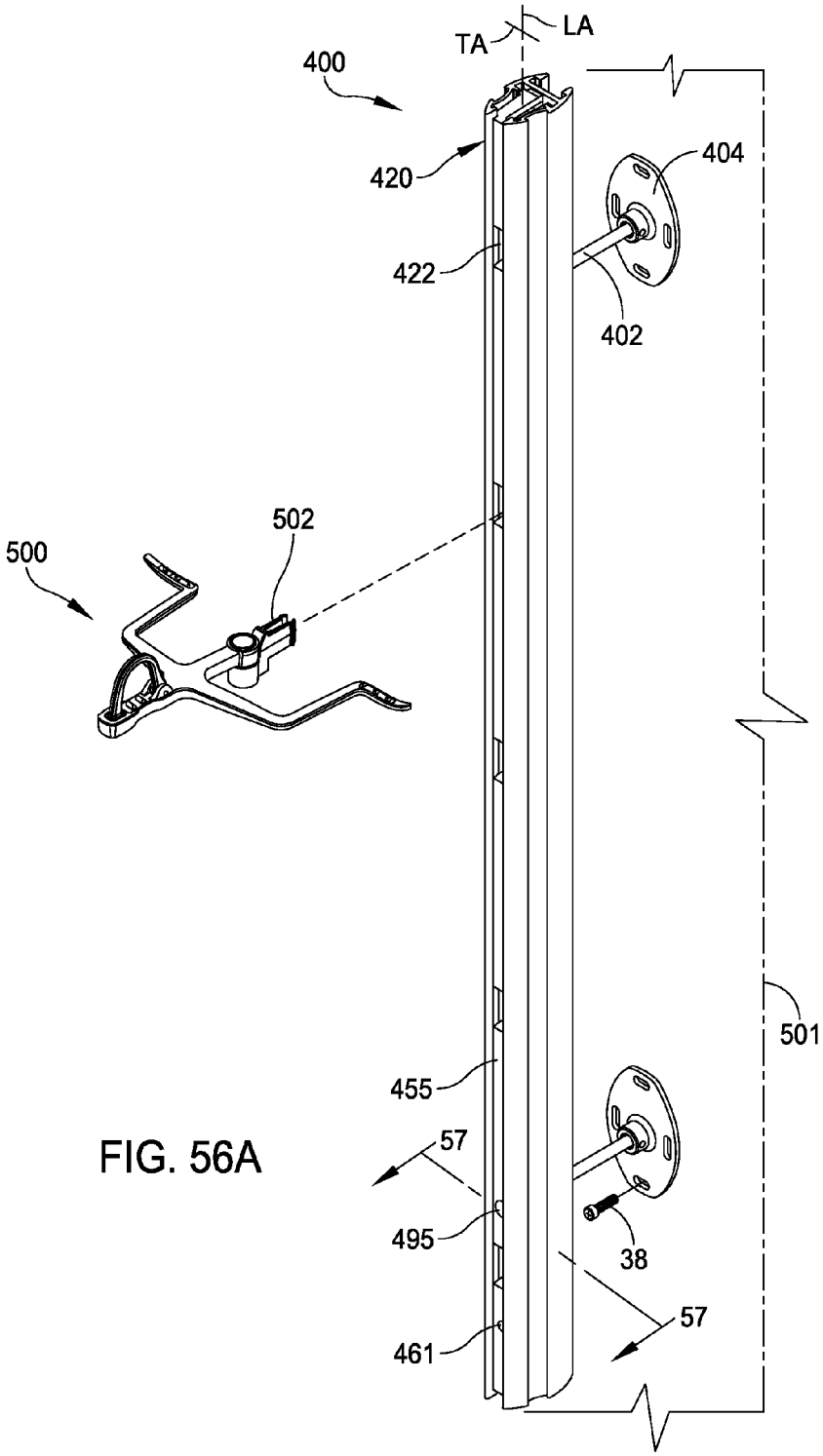
FIG. 56A is a partially exploded, perspective view of a display rod assembly including the outer member, inner member, and locking plate.

Referring initially to FIG. 56, a lockable object display system 400 in one embodiment includes an axially elongated lockable display rod 420, mounting rods 402, and mounting bases 404 configured for attachment to a display structure 501 such as a flat or curved panel, column, or other shaped structure having a surface suitable for supporting and mounting the display rod thereto. In one embodiment, display rod 420 includes a plurality of axially longitudinally spaced apart mounting receptacles 422 configured for inserting the anchor of an object display holder therein for a snap and/or frictional fit engagement with the display rod. In some embodiments, the object display holders may include one or more lockable frame holders 500 (as shown) for supporting eyewear frames having a releasable mounting anchor 502 disposed on one end of the frame.

Display rod 420 defines longitudinal axis LA which extends axially along the length of the rod and a transverse axis TA which defines a lateral or transverse direction generally but not necessarily perpendicular to the longitudinal axis LA.

Figure 56B:
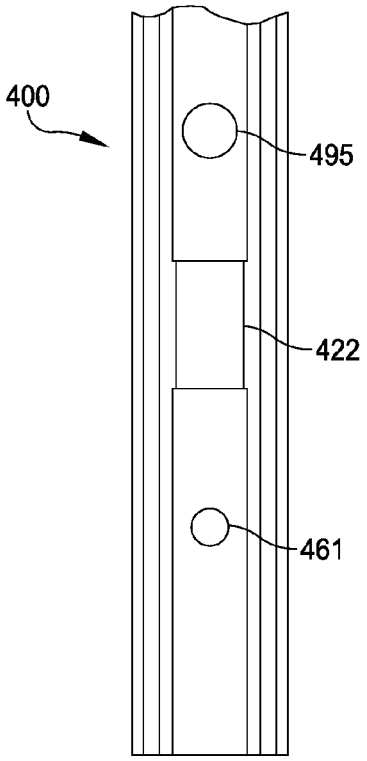
FIG. 56B is a broken away front plan view of the tubular-like outer member forming part of a lockable display rod system.
Figure 56C:
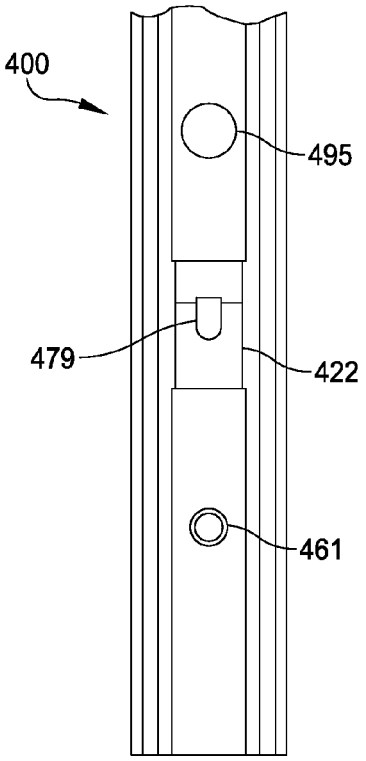
FIG. 56C is a broken away rear plan view of the tubular-like outer member shown in FIGS. 56A and 56B.
Figure 57:
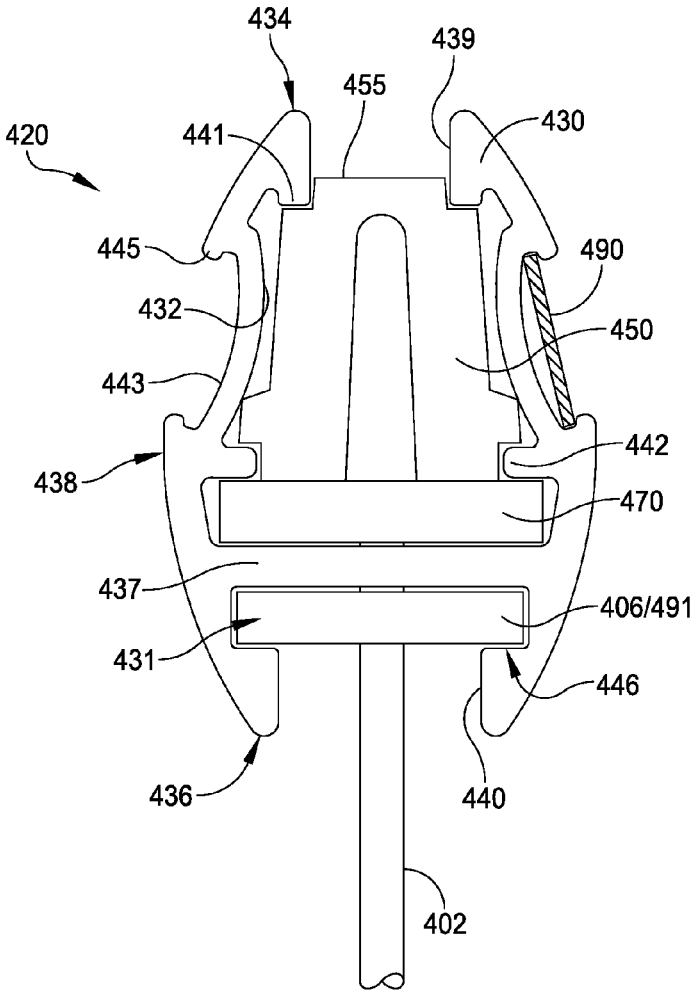
FIG. 57 is a cross-sectional view taken along line 57-57 in FIG. 56.

Referring to FIGS. 56 and 57, lockable display rod 420 in one embodiment is a nested structure comprised of a longitudinally-extending and elongated tubular-like outer member 430, longitudinally-extending tubular-like inner member 450 disposed inside the outer member, and longitudinally-extending slidable locking plate 470. Inner member 450 and locking plate 470 are configured and dimensioned to fit inside outer member 430 of display rod 420, as best illustrated by the cross-sectional view of FIG. 57. Cavity 432 extends axially completely through locking rod 420 from end to end in some embodiments as shown.

Figure 28:
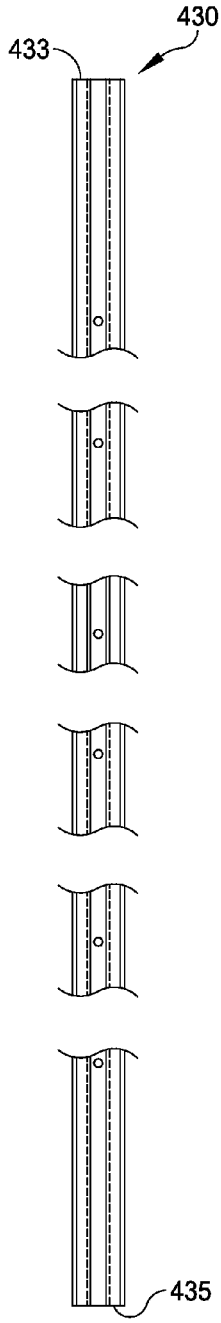
FIGS. 28 and 29 are front and side views respectively of a tubular-like outer member forming part of a lockable display rod system.
Figure 29:
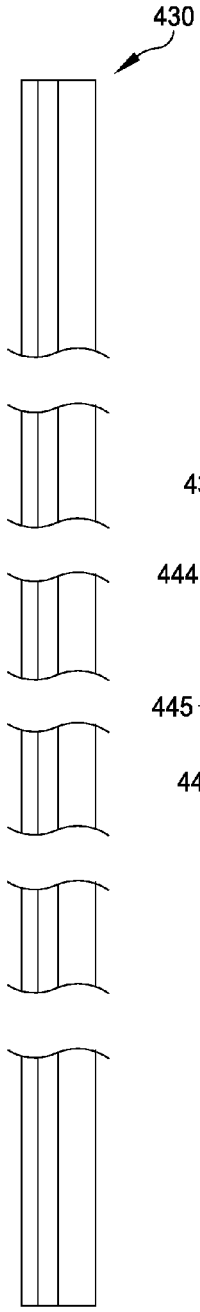
Figure 30:
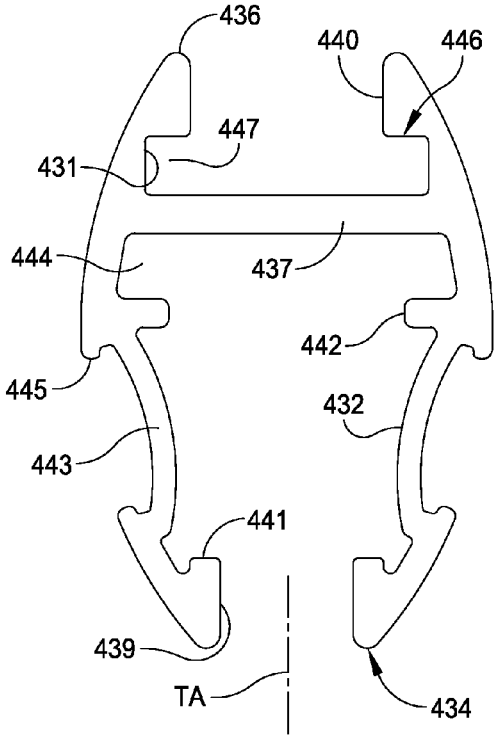
FIG. 30 is an end view thereof.
Figure 31:
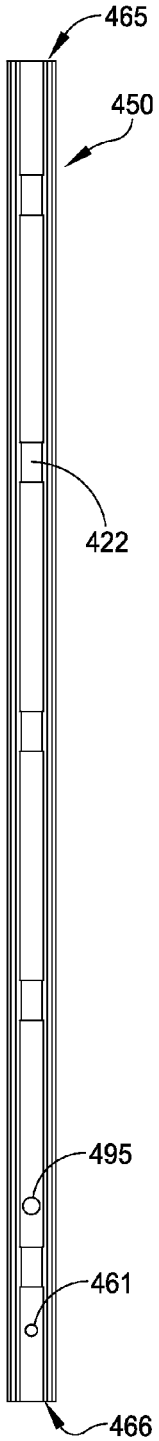
FIGS. 31-33 are front, side, and rear views respectively of a tubular-like inner member insertable into the outer member of FIGS. 28-30.
Figure 32:
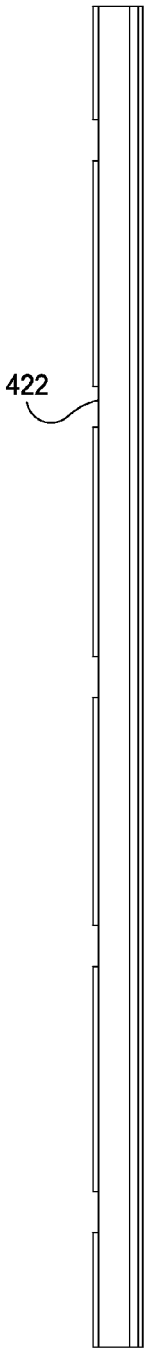

FIGS. 28-30 show tubular-like outer member 430 in further detail. In one embodiment, outer shell 430 has an axially elongated body defining a front wall 434, opposing rear wall 436, opposing lateral sidewalls 438, a first longitudinally-extending internal passageway 432, and a second longitudinally-extending internal passageway 431(see also FIG. 57). Front wall 434 defines an longitudinally-extending frontal opening and rear wall 436 defines a rear opening 440.

In one embodiment, the first and second passageways 431, 432 extend along the entire axial length of outer member 430 from end 433 to end 345, and may penetrate the ends to the exterior of the outer member thereby defining open ends. As best shown in FIG. 30, which is an end view of outer member 430, first and second passageways 431, 432 may be separated by an axially longitudinally-extending internal barrier wall 437 that bifurcates the interior space of outer member 430 into the two passageways which each serve different purposes, as further described herein. In one embodiment, as shown, wall 437 is disposed generally parallel to longitudinal axis LA and extends laterally (i.e. transverse to longitudinal axis LA) between the sidewalls 438 of tubular-like outer member 430.

With continuing reference to FIGS. 28-30, passageway 432 of tubular-like outer member 430 further includes a first laterally spaced apart pair of longitudinally-extending internal retaining rails 441 and a second laterally spaced apart pair of longitudinally-extending internal retaining rails 442. Rails 441 are spaced apart from rails 442 in a direction measured between the front and rear walls 434 and 436 along a transverse axis Ta oriented perpendicular to the longitudinal axis LA. Rails 441 and 442 are complementary configured and arranged to engage inner tubular-like member 450 as best shown in FIG. 57 for retaining the inner member in the desired position within outer member 430.

Figure 54:
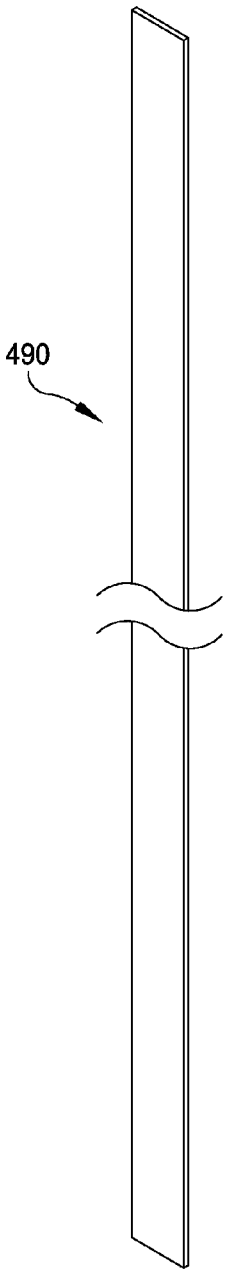
FIG. 54 is perspective view of a side filler strip insertable into the outer member of FIG. 28.

Referring to FIGS. 28-30 and 57, sidewalls 438 may be arcuately shaped in cross section as shown or have any other suitable configuration including without limitation straight and angled shapes. In one embodiment, a longitudinally-extending and externally accessible recess 443 is defined in each sidewall 438 and which is configured to receive an axially elongated side filler strip 490 as shown in FIG. 54 (see also FIG. 57 showing one filler strip 490 seated in one recess 443). Recess 443 is axially open and accessible through the ends 433 and 435 of outer member 430, and is open laterally through the sidewalls 438 as shown in FIG. 30. A longitudinally-extending lip 445 may be provided on either side of recess 443 to engage and retain filler strip 490 in the recess.

Filler strip 490 has the shape of a generally flat strap or plate with an axial length that is substantially larger than its lateral width as shown in FIG. 54, and may be substantially rigid or flexible in construction depending on the nature of the material used for the strip and its thickness. In one embodiment, filler strip 490 is axially insertable and slidable into recess 443 from either open ends 433 or 435 of the outer member 430. In other embodiments, filler strips 490 may be resiliently flexible in construction allowing the strips to be slightly deformed and inserted laterally into recess 443 by flexing the strips. Filler strip 490 may be made of any suitable material including without limitation metal, polymer, vinyl, melamine, wood, etc. Filler strip 490 may be used for ornamental or decorative purposes and can be provided in a variety of colors, patterns, and/or include advertising indicia (e.g. eyewear manufacturer or brand names) to enhance promotion of the eyewear. It should be noted that in some other possible embodiments, recess 443 and filler strips 490 may not be provided.

Figure 51:
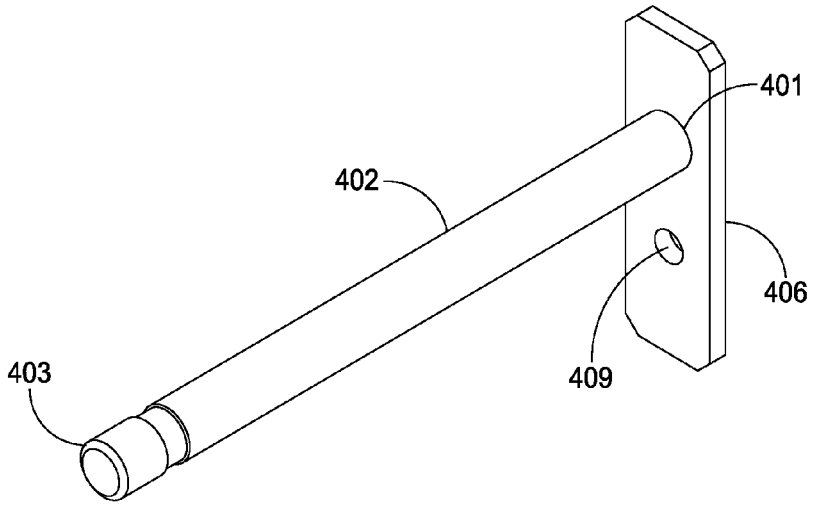
FIG. 51 is a perspective view of a mounting rod for the lockable display rod system.

With continuing description of tubular-like outer member 430, inner passageway 431 of the outer member defines steps 446 which are configured and arranged to engage and retain display rod mounting plates 406 connected to mounting rods 402 (see FIGS. 51 and 57). Steps 446 define a longitudinally-extending slot 447 that has a lateral width that is larger than rear opening 440 of outer member 430 so that the mounting plates cannot be laterally removed from the outer member 430. Accordingly, in preferred embodiments, the display rod mounting plates 406 are intended to be slidably inserted into slot 447 through the open axial ends 433 or 435 of outer member 430 (labeled in FIG. 28).

Figure 52:
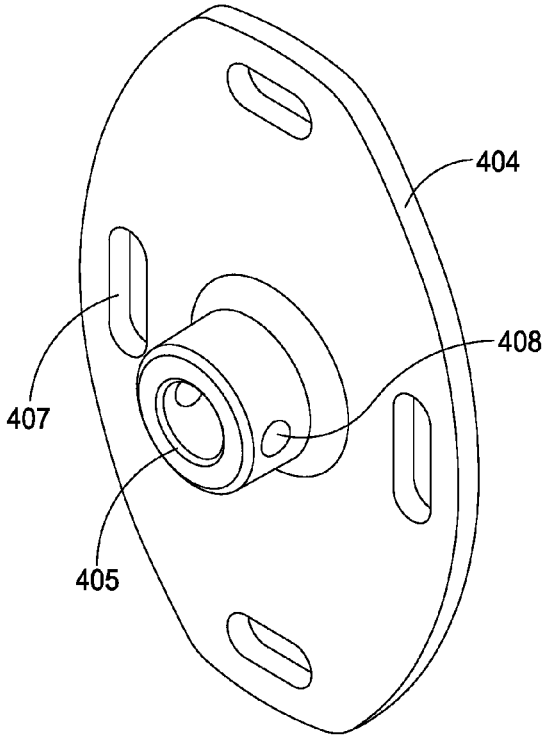
FIG. 52 is a perspective view of a mounting base connectable to the rod of FIG. 51.

As shown in FIGS. 51 and 57, mounting plates 406 may have a rectilinear shape such as be square or rectangular in configuration, and are connected to one end 401 of mounting rods 402 by any suitable manner so long as a rigid attachment is produced. The opposing end 403 of mounting rods 402 are removably coupled into sockets 405 disposed on mounting bases 404 (see also FIG. 52). Each end 403 may be retained in a corresponding socket 405 by any suitable method, such as inserting a screw (e.g. screw 38 shown in FIG. 6) through one or more lateral holes 408 disposed in the mounting base 404 as shown in FIG. 52 to engage the mounting rod. In other possible embodiments, mounting rods 402 may be permanently fixed to mounting bases 404 such as by welding or other methods. To assist with longitudinally fixing and retaining mounting plates 406 in position on display rod 420, one or more holes 409 may be provided for receiving a mounting screw (e.g. screw 38 shown in FIG. 6) therethrough which is ultimately received in corresponding screw sockets 458 (see FIGS. 33 and 34) provided in inner member 450. Sockets 458 may be threaded to complement the mounting screws or unthreaded in various embodiments. In other possible embodiments, sockets 458 may be eliminated and self-tapping screws can instead be screwed into a solid portion of inner member 450 to fix mounting plates 406 in longitudinal position on display rod 420.

As shown in FIG. 52, mounting bases 404 may further include one or more mounting holes 407 to attach the base to the display structure 501 (see FIG. 56) via screws (e.g. screw 38 shown in FIG. 6). In one embodiment, as shown, the holes may be slot-shaped to allow adjustment in position of the base with respect to structural surface on which it is mounted.

Figure 55:
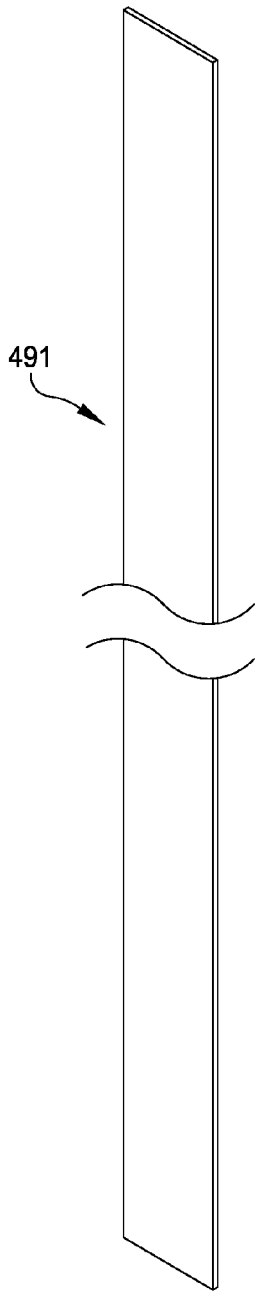
FIG. 55 is perspective view of a rear filler strip insertable into the outer member of FIG. 28.

In some embodiments, rear filler strips 491 (see FIG. 55) may optionally be provided that are configured for insertion into passageway 431 as shown in FIG. 57 to fill in gaps between mounting plates 406 of the display rod 420 mounts.

Tubular-like inner member 450 will now be described in further detail with primary reference to FIGS. 31-37. Inner member 450 has an axially elongated body and is substantially U-shaped in cross section in one embodiment as best shown in FIGS. 35, 36A-B, and 57. Inner member 450 defines a front wall 451, lateral sidewalls 452 connected to opposing sides of the front wall, a rear wall 453, an internal longitudinally-extending cavity 454, and opposing ends 465, 466. Cavity 454 extends completely through ends 465 and 466 in some embodiments. Front wall 451 includes a laterally extending plateau or protrusion 455 which extends into and is visible through frontal opening 439 of outer member 430 (see, e.g. FIGS. 56 and 57). The intersection of front wall 451 and protrusion 455 define a longitudinally-extending step 457 which engages rails 441 of outer member 430 (reference FIGS. 30 and 57) to assist with retaining inner member 450 in outer member 430.

For further assisting with mounting, and properly arranging and positioning inner member 450 in axial passageway 432 of outer member 430 during slideably inserting the inner member in outer member, embodiments of inner member 450 may include a pair of laterally spaced apart and opposing external mounting rails 456 that extend longitudinally along the longitudinal axis LA. Rails 456 protrude laterally outwards from sidewalls 452, and in various embodiments may be continuous in axial length or interrupted. In one preferred embodiment, rails 456 are continuous. Mounting rails 456 engage retaining rails 442 of outer member 430 as best shown in FIG. 57, and further hold and position the rear wall 453 of the inner member 450 in a spaced apart relationship from barrier wall 437 of the outer member for accommodating locking plate 470. When inner member 450 is mounted in outer member 430, an internal space 444 is produced as shown in FIGS. 30 and 57 that is configured and dimensioned to slidably receive the locking plate 470 therein (see FIG. 57), which can be inserted axially from either open end 433 or 435 of the outer member 430 of display rod 420.

Figure 33:
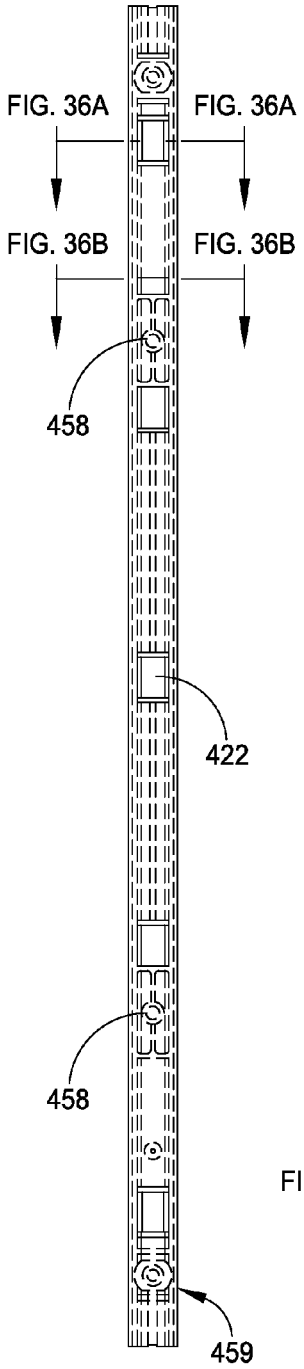
Figure 34:
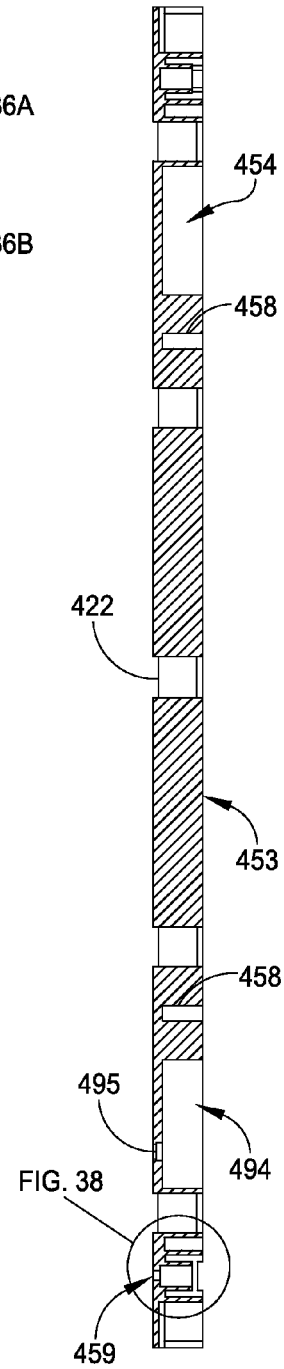
FIG. 34 is a side cross-sectional view thereof.
Figure 35:
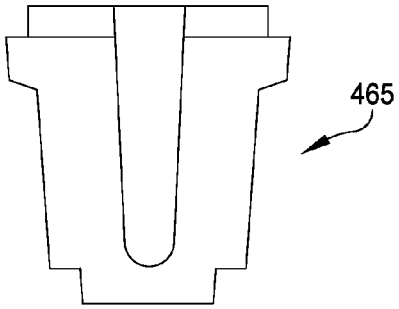
FIG. 35 is an end view thereof.
Figure 38:
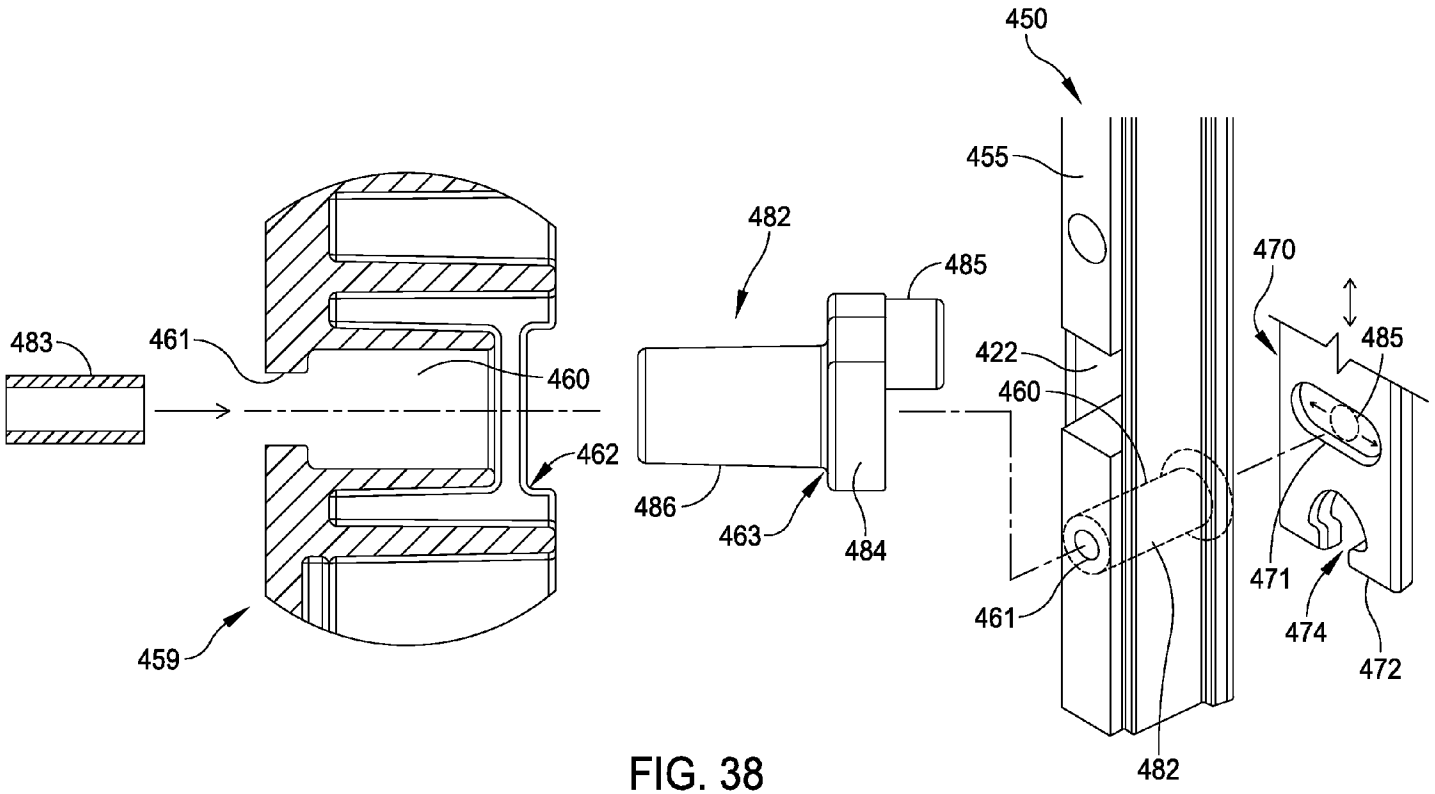
FIG. 38 is an exploded view of a cam lock assembly mounted in the inner member of FIGS. 31-38.
Figure 53:
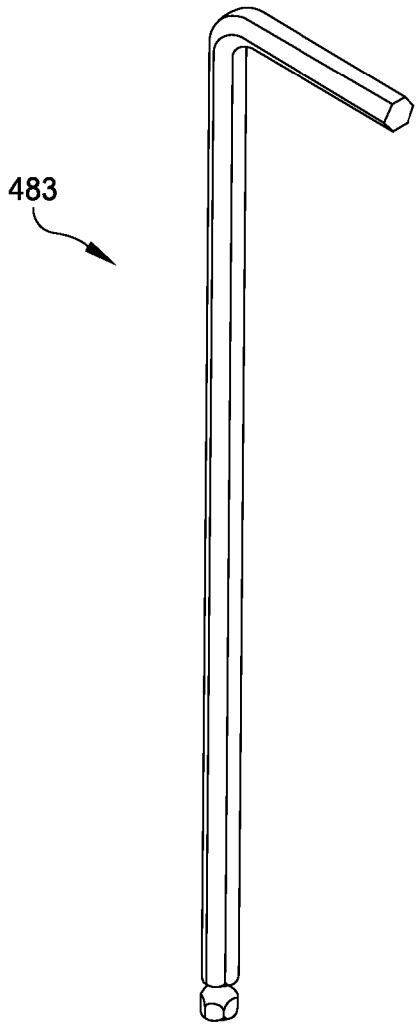
FIG. 53 is a perspective view of a key for operating the cam lock of FIG. 45.

Referring to FIGS. 33-34 and 38, inner member 450 defines a lock housing 459 comprised of a chamber 460 configured and dimensioned to rotatably receive cam lock 482 therein. Chamber 460 defines a front keyhole 461 to allow a user to access cam lock 482 via a specially configured key 483 (see FIG. 53) shaped to operate the lock. Keyhole 461 has a diameter smaller than the portion of chamber 460 wherein the cam lock 482 is disposed.

Referring to FIGS. 38 and 45-49, cam lock 482 includes a cam 484, a round or circular linkage pin 485 protruding outwards from one side of the cam, and an operating cylinder 486 protruding outwards from a second side of the cam as shown and defining a rotational axis RA of the cam lock. As best shown in FIG. 38, chamber 460 further defines an annular stepped surface 462 which engages a corresponding annular stepped surface 463 (see also FIG. 45) on cam lock 482 that limits the insertion depth of cylinder 486 in chamber 460. This positions the cam 484 outside of chamber 460 on one side of the stepped surface 462 (to the right, shown in FIG. 38) with the cylinder 486 being positioned on an opposing side of stepped surface 462 (to the left, in FIG. 38) when the cam lock 482 is full seated in lock housing 459 of the inner member 450.

Figure 39:
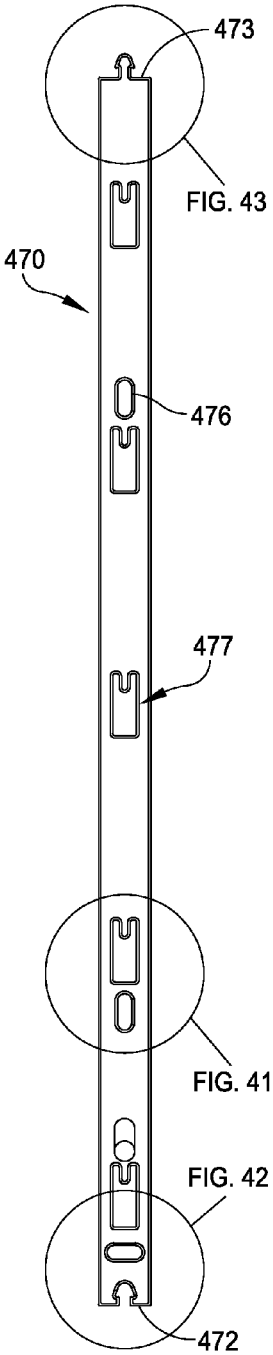
FIGS. 39-40 are front and side views of a slidable locking plate forming part of a lockable display rod system and insertable into the outer and inner members of FIGS. 28 and 31 respectively.
Figure 42:
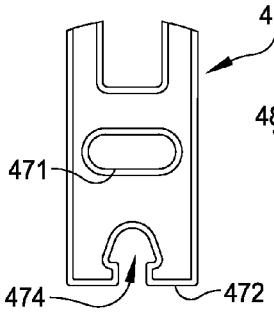
FIG. 42 is an enlarged front view of a locking element thereof.

Cylinder 486 defines a key socket 487 configured to receive a complementary configured key 483 therein for turning/rotating the cam lock 482. Linkage pin 485 is axially offset from the rotational axis defined by operating cylinder 486 so that rotation of the cylinder and cam via the key 483 causes the pin to travel through an arc of rotation or arcuate path with respect to the rotational axis of the cylinder. Linkage pin 485 engages the laterally oriented elongated operating slot 471 disposed proximate to the bottom end 472 of lock plate 470 (see FIGS. 38, 39 and 42). Rotation of cam lock 482 in opposing rotational directions moves linkage pin 485 laterally back and forth in slot 471 and operates to axially slide the lock plate 470 upwards and downwards with respect to the inner member 450 and outer member 430 of display rod 420 between locked and unlocked positions of the lock plate, as further described herein.

Referring to FIGS. 31-37 and 56, tubular-like inner member 450 in some embodiments defines the longitudinally spaced apart open mounting receptacles 422 for frictionally and/or snap-fit mounting object support frames therein. Receptacles define openings that extend through the front plateau or protrusion 455 on inner member 450 and open into cavity 454 in the inner member 450 (see FIG. 36A). As best shown in FIG. 56, mounting receptacles 422 are accessible through frontal opening 439 of outer member 430.

Figure 36B:
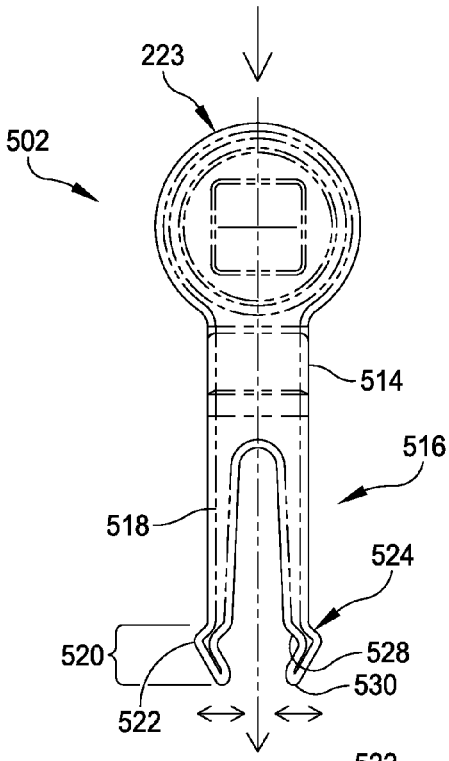
FIG. 36B is a cross-sectional view taken along line 36B-36B in FIG. 33.
Figure 36B:
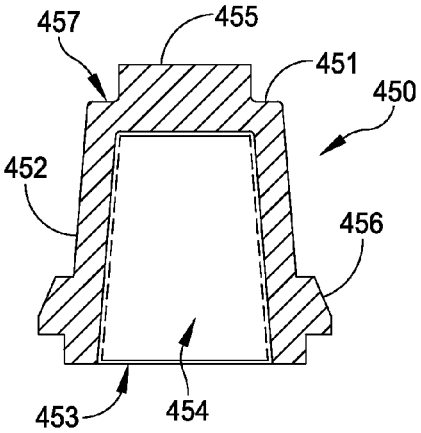
Figure 36A:
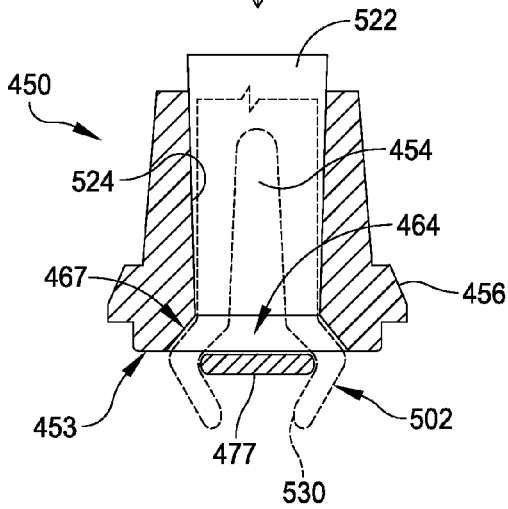
FIG. 36A is a cross-sectional view taken along line 36A-36A in FIG. 33.
Figure 37:
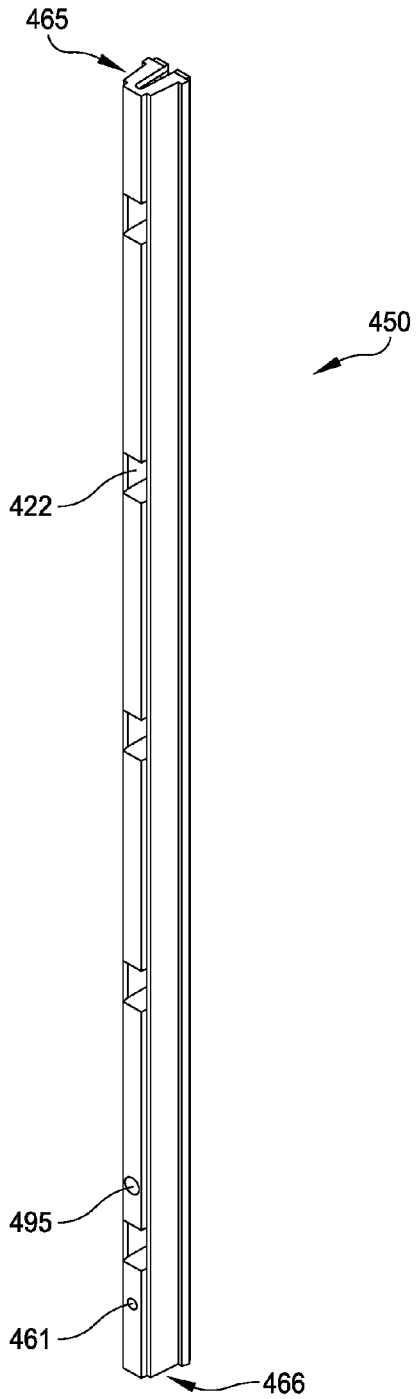
FIG. 37 is a perspective view thereof.

FIG. 36A is a cross-sectional view taken through inner member 450 at a mounting receptacle 422. At preferably each receptacle, inner member 450 defines a widened rear opening 464 adjacent a laterally spaced apart pair of axially extending angled engagement surfaces 467 configured to engage resiliently movable mounting members 516 of frame holder mounting anchor 502 (see also FIGS. 56 and 63). Rear opening 464 is wider than the width between lateral sidewalls 524 defined in the receptacle 422. Surfaces 467 are flared outwards from rear opening 464 in one embodiment as shown with the outermost edges of the angled surfaces being more divergent from a central axis extending laterally through the mounting receptacle 422 than the innermost edges, as shown.

FIGS. 39-44 show slidable locking plate 470, which will now be further described. Locking plate 470 is a generally elongated and flat structure having opposing ends 472 and 473, longitudinally spaced apart mounting slots 476 for receiving mounting screws (e.g. screw 38 shown in FIG. 6) from mounting plates 406 therethrough to engage screw sockets 458 in inner member 450 (see, e.g. FIG. 34), longitudinally spaced apart locking elements 477, and laterally oriented operating slot 471 that engages linkage pin 485 of cam lock 482 (shown in FIG. 38). To operably join two or more locking plates 470 together for sliding movement in unison when operated by cam lock 482, one end 473 include an arrow shaped protrusion 475 (see FIG. 43) and the opposing end 472 includes a complementary configured arrow shaped recess 474. To join two locking plates 470 together, the protrusion 475 on one plate 470 is laterally inserted into the mating recess 474 in the second plate 470, and the assembly is then slid into passageway 432 (e.g. internal space 444) of outer member 430 (see FIGS. 30 and 57). Additional locking plates 470 may be added in a similar fashion. The complementary arrow shaped protrusions 475 and recesses 474 function to prevent axial removal or separation of one locking plate 470 from the joined locking plate.

Figure 41:
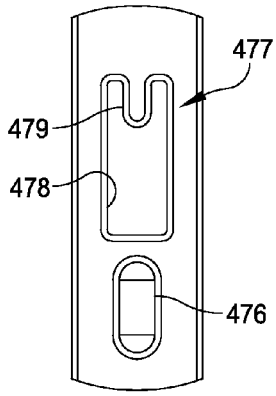
FIG. 41 is an enlarged front view of the bottom end thereof.

As further shown in FIG. 41, locking elements 477 include an open window 478 and locking tongue 479 extending into the window as shown. Locking tongues 479 extend in a longitudinal direction into the windows and are axially moveable with locking plate 470 up and down along the longitudinal axis LA. Locking tongues 479 are configured and dimensioned to axially slide into and out from mounting anchors 502 of frame holder 500 (see, e.g. FIG. 36A) to prevent or allow removal of the supports from the display rod 420, as further described herein. When locking plate 470 is mounted in display rod 420 (i.e. within outer member 430), the locking tongues are laterally and transversely aligned with frontally open mounting receptacles 422 in the inner member 450, and the tongues are axially movable in a longitudinal direction into and out from the receptacles via rotation of the cam lock 482 by a user with key 483.

Figure 40:
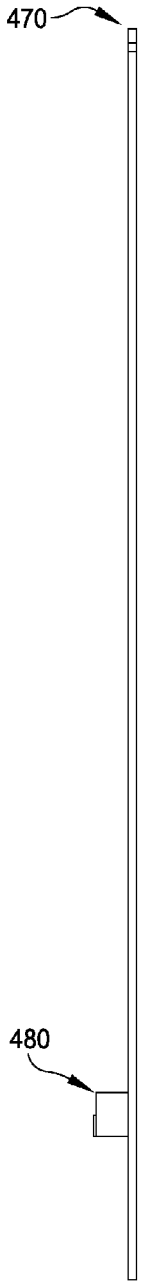
Figure 43:
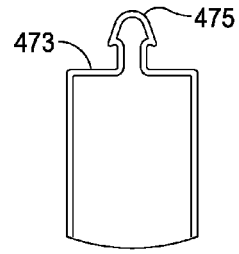
FIG. 43 is an enlarged front view of the top end thereof.
Figure 44:
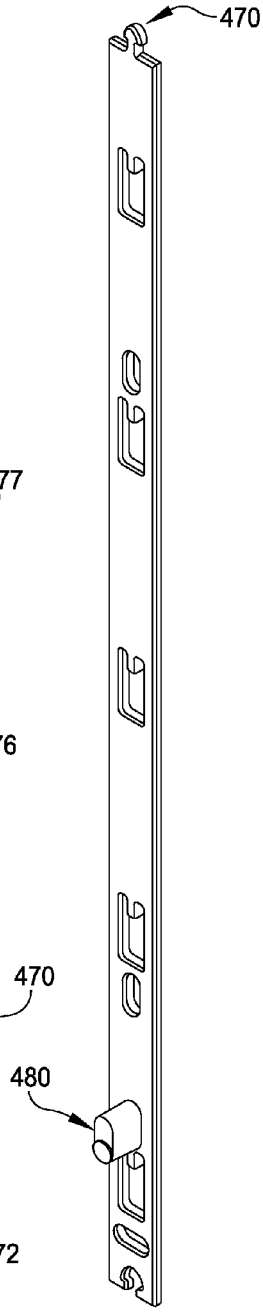
FIG. 44 is a perspective view thereof.
Figure 46:
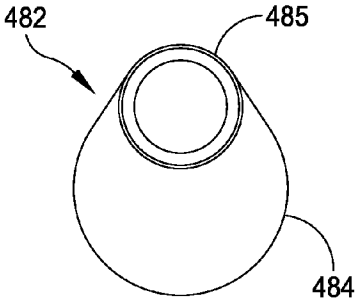
FIGS. 45-48 are perspective, rear, side, and front views respectively of a cam lock mounted in the inner member of FIGS. 31-38.
Figure 47:
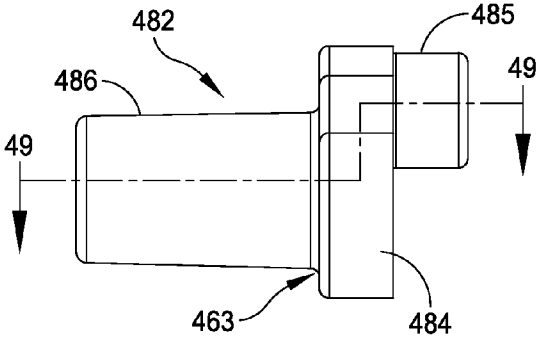
Figure 48:
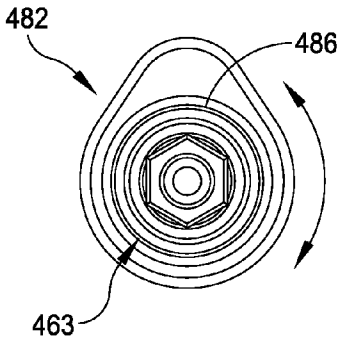
Figure 45:
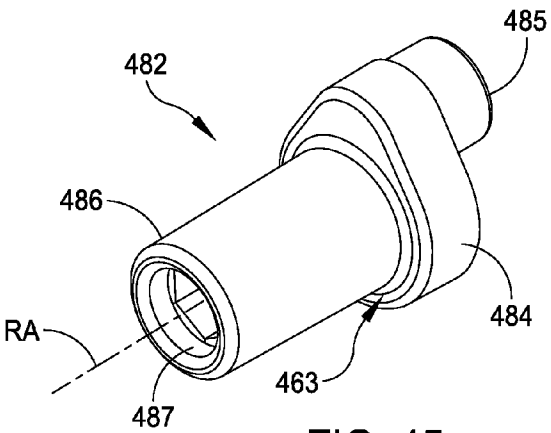
Figure 49:
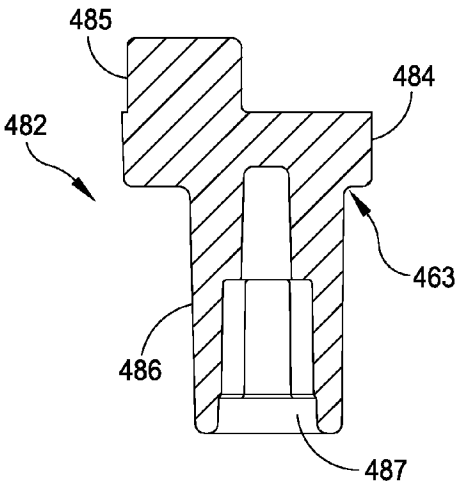
FIG. 49 is a cross-sectional view thereof taken along line 49-49 in FIG. 47.
Figure 50:
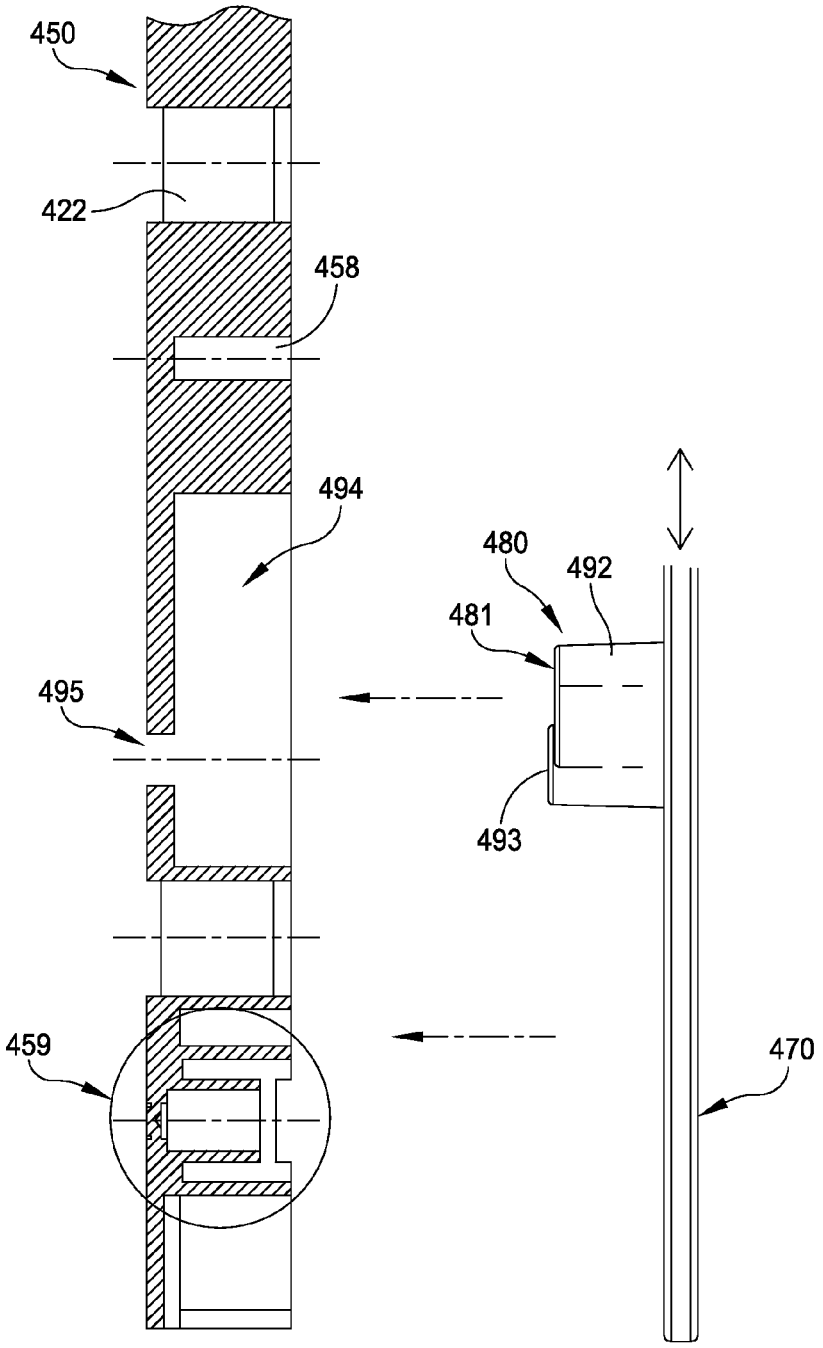
FIG. 50 is an exploded side cross-sectional view showing a visual operating mode indication system of the lockable display rod system.

With continuing reference to FIGS. 39-44 and particularly FIG. 50, locking plate 470 in some embodiments further includes a status or position indicator 480 including a visual indication surface 481 to allow a user to quickly determine whether the display rod 420 is in an unlocked or locked operating state. In some embodiments, indication surface 481 is formed on a raised projection 492 jutting laterally outwards from locking plate 470 as shown in FIGS. 40 and 44. A portion of indication surface 481 may include an status or position indicia 493, such as a color (e.g. green for "open" and red or no color for "closed") and/or alphabetical character(s) which is/are visible through a position indication hole 495 formed through inner member 450 (see FIGS. 31, 34, 38, and 56). In one embodiment, inner member 450 includes an axially elongated chamber 494 which communicates with indication hole 495 as best shown in FIG. 50. Chamber 494 has a sufficient axial length to allow projection 492 to move axially up and down therein for a sufficient length for indicating an "open" and "closed" position through indication hole 495.

Raised projection 492 with indication surface 481 therein moves simultaneously with the axial movement locking plate 470 from the locked position to the unlocked position because the projection is disposed on the locking plate. Accordingly, the position indicator 480 provides a quick visual indication to a user whether the locking tongues 479 of the locking plate are projected into their respective receptacles 422 (locked position) and engaged with an object holder such as frame holder 500 or retracted from the receptacles (unlocked position).

In some embodiments, outer member 430 may have a greater or larger axial length than inner members 450 and locking plates 470. For example, in some illustrative and non-limiting embodiments, outer member 430 may have a length of about 48 inches whereas inner members 450 and locking plates 470 may have respective lengths of about 16 inches. Accordingly, in this embodiment, three sections of abutting inner members 450 and locking plates 470 may be fitted into one 48 inch section of outer member 430. For shorter display lengths, outer member 430 can be cut to the desired length to accommodate one or two sections of the abutting inner members 450 and locking plates 470. When the inner members and locking plates are made of a molded material, this advantageously allows the machining and use of smaller metal molds. If the outer member 430 is made of extruded metal such as aluminum, the nature of the extrusion process as will be known to those skilled in the art allow extruded members to be made economically in longer lengths as the size of the extrusion equipment and cost is fixed.

Lockable Frame Holder

According to another aspect of an eyewear display system 400 shown in FIG. 56, a lockable frame holder 500 configured for holding and supporting eyewear frames. In this embodiment, frame holder 500 is generally analogous and similar in function to swiveling and articulating support frame 220 shown in FIG. 7, with differences lying in an alternative eyewear locking mechanism and mounting anchor compatible with display rod 420 of display system 400.

Figure 58:
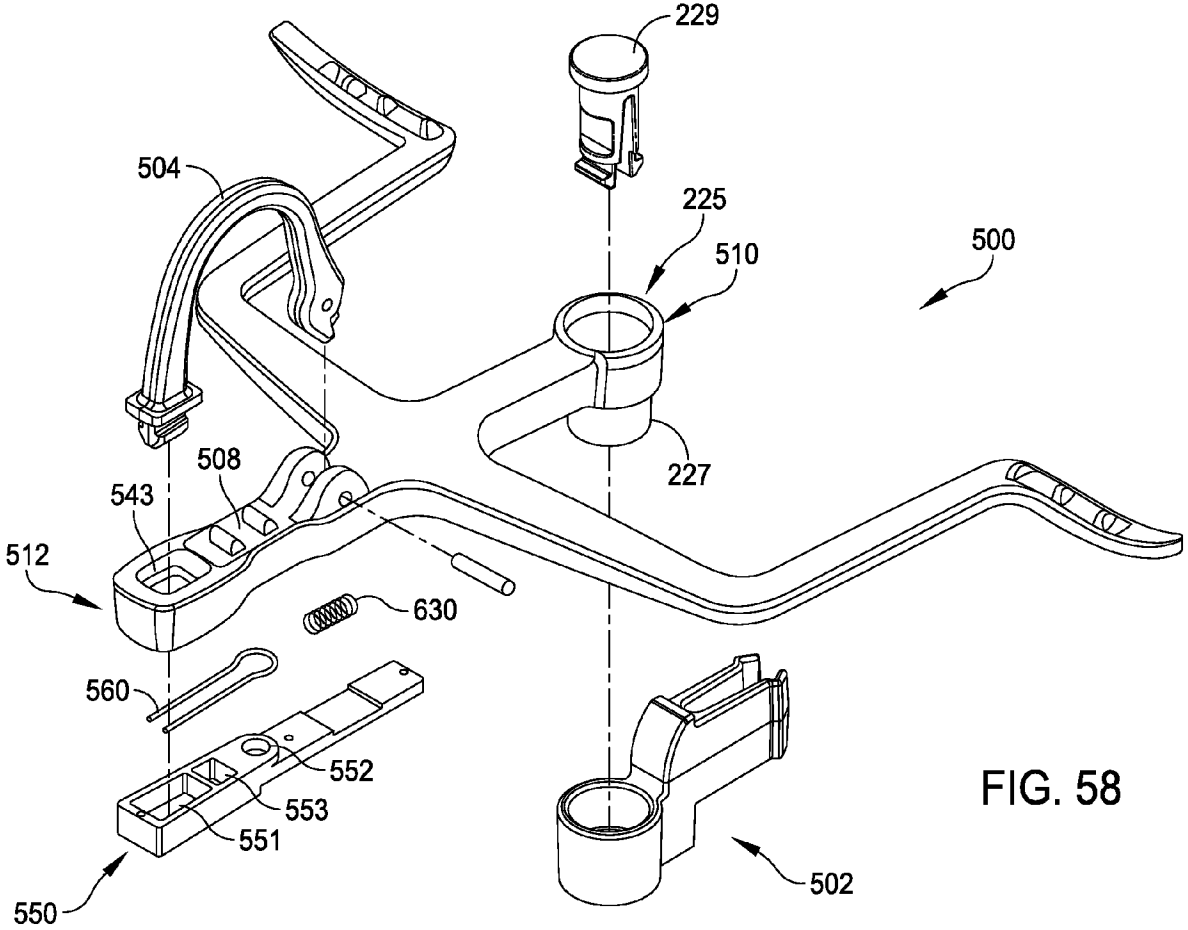
FIG. 58 is an exploded perspective view of one embodiment of a lockable eyeglass frame holder having an articulating swiveling joint.
Figure 59:
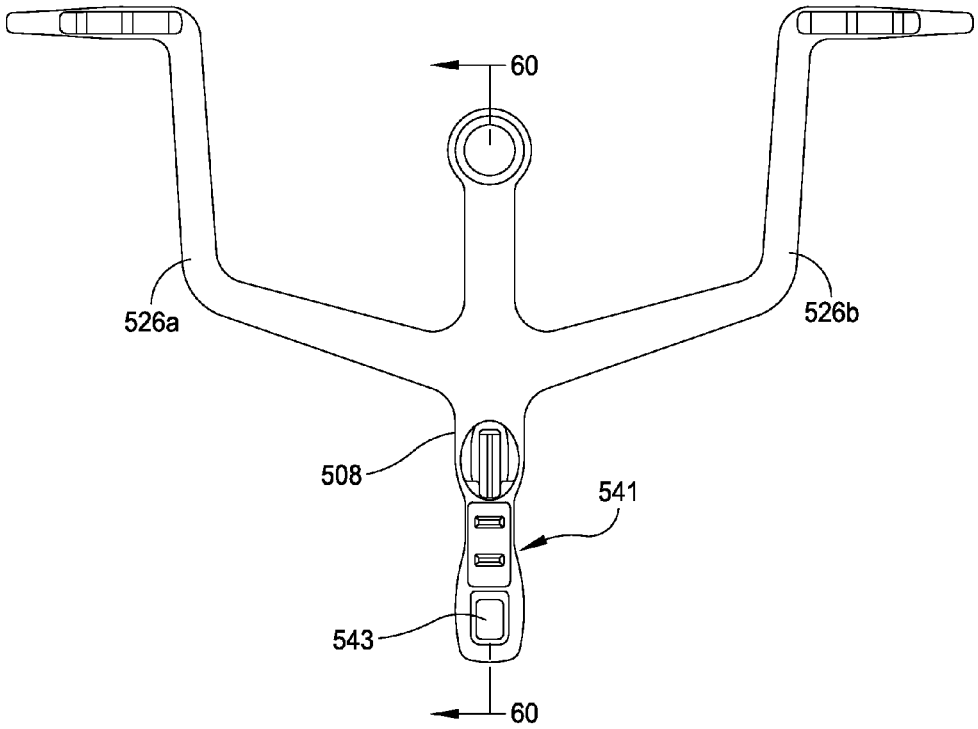
FIG. 59 is a top view of a spine of the frame holder of FIG. 58 configured for holding an eyeglass frame.
Figure 60:
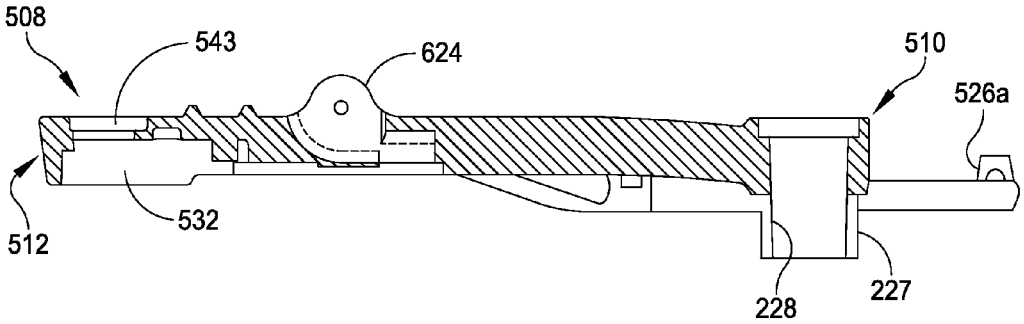
FIG. 60 is a longitudinal cross-sectional view thereof taken along line 60-60 in FIG. 59.
Figure 61:
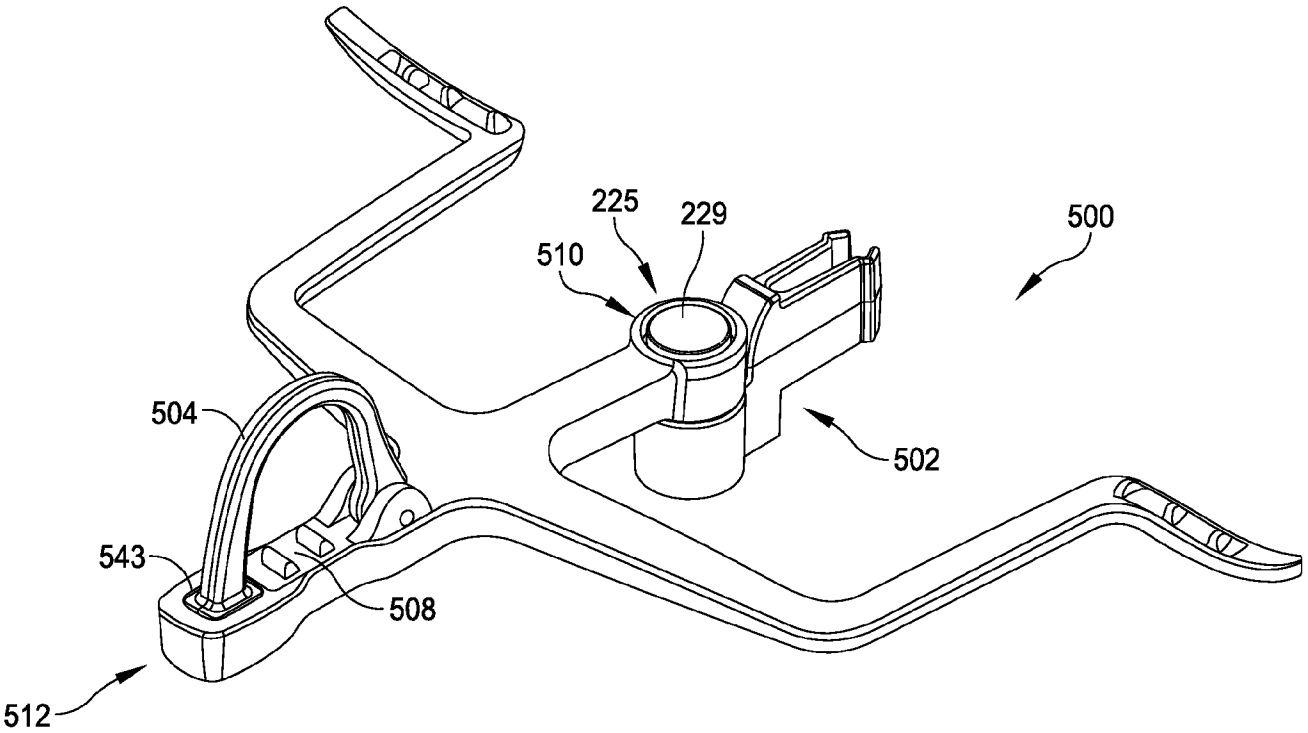
FIG. 61 is a perspective view of the fully assembled eyeglass frame holder of FIG. 58.

Referring now to FIG. 58, one embodiment of an articulating and lockable frame holder system generally includes lockable frame holder 500 having a swiveling longitudinally-extending spine 508, mounting anchor 502 attachable to a display object and rotationally coupled to spine 508, a lockable loop-shaped locking hook 504 engageable with spine 508, and a separate key 600 configured for unlatching and releasing the hook from engagement with the spine. Spine 508 includes a pair of laterally extending arms 526*a* and 526*b*, each arm projecting outwardly from the spine 20 in opposing transverse directions and configured for supporting the ear pieces 202 of eyeglass frames 200 (see FIG. 15). Arms 526*a* and 526*b* function similarly to arms 26*a* and 26*b* shown in FIG. 15, as further described and shown elsewhere herein. Arms 526*a* and 526*b* may have any suitable shape so long as at least a portion of the arms is arranged to engage the ear pieces 202 of the eyeglass frames.

Referring to FIGS. 58-61, an articulating joint such as articulating joint 225 as already shown and described is provided at a proximal end 510 of spine 508 for swiveling and rotating the spine with respect to mounting anchor 502. Articulating joint 225 includes collar 223 disposed on anchor 502, sleeve 227 disposed at end 510 of spine 508, and pin 229 insertable through the collar and sleeve to form a rotational coupling between the anchor and spine. The collar 223, sleeve 227, and pin 229 may be configured similarly, include the same appurtenances, and function in a similar manner these items already described herein and further shown in FIGS. 7-12 and 15-18.

Figure 62A:
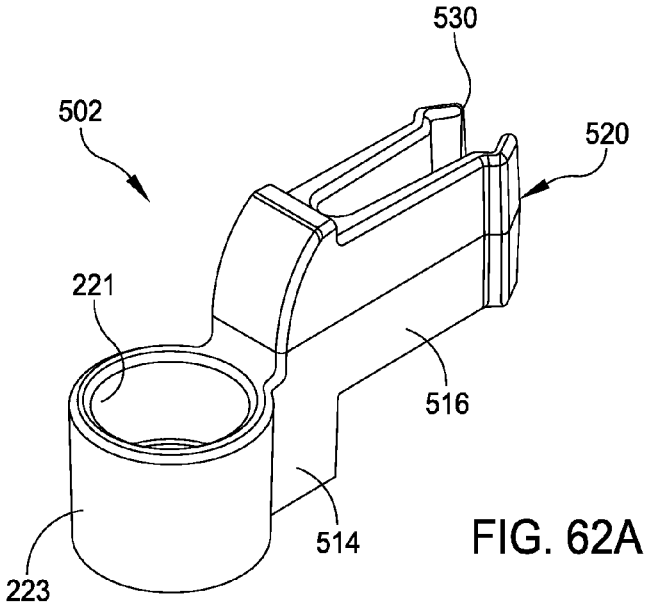
FIGS. 62A and 62B are perspective and top views respectively of a mounting anchor of the frame holder of FIGS. 58 and 61.
Figure 62B:
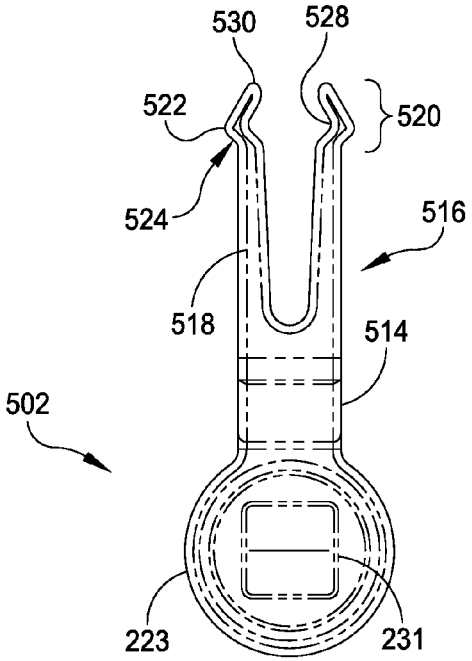
Figure 63:
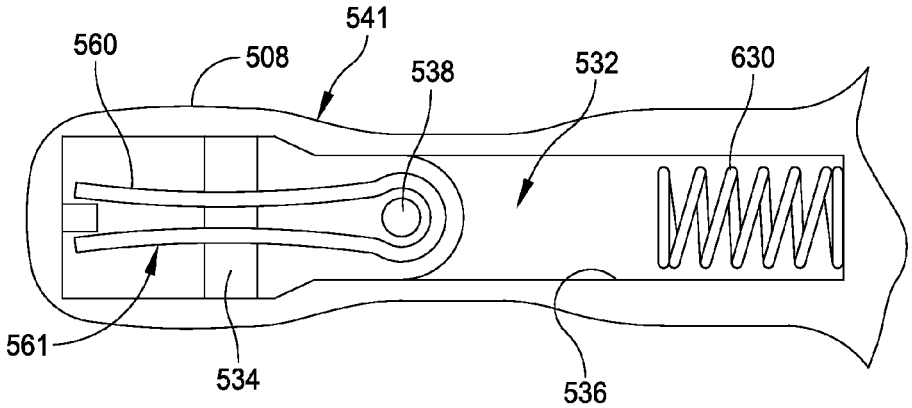
FIG. 63 is a bottom view of the front portion of the spine of the frame holder of FIG. 59.

As further shown in FIGS. 62A-B and 63, collar 223 on frame holder anchor 502 may be closely coupled to an anchor base 514 equipped with a pair of cantilevered resiliently movable mounting members 516 extending laterally outwards therefrom. In one embodiment, collar 223 and mounting members 516 are disposed on opposing sides of the anchor base 514. Preferably, mounting members 516 are elongated, flexible, and resiliently disposed on anchor 502 such that the members are (1) compressible and movable inwards towards each other to an unlocked position and (2) expandable and movable outwards away from each other to a locked position.

Each mounting member 516 includes a substantially straight shaft 518 with one fixed end on anchor base 514 and a second free end terminating in an angled V-shaped tip 520 that is configured to engage engagement surfaces 467 of inner member 450 of the display rod 420 (see FIG. 36A). In some embodiments, each tip 520 defines an angled surface 524 having a shape and angle that complements and engages a corresponding one of the angled engagement surfaces 467 of the inner member 450 at the bottom of receptacle 522. The V-shaped tips 520 each define an apex 522 arranged facing outwards from mounting members 516 to engage opposing interior lateral walls 524 in mounting receptacle 422 that operate to compress the members inwards or together. Each tip 520 has a terminal end 530, which in some embodiments is substantially axially aligned with its respective shaft 518.

As best shown in FIG. 36A, a laterally wide slot 528 is formed between confronting tips 520 of mounting anchor 502 which is configured and dimensioned to cooperate with and removably receive therein a locking tongue 479 on locking plate 470. Locking tongue 479 is axially insertable into and retractable from slot 528. In one embodiment, slot 528 has a width that is preferably larger than the spacing between shafts 518 adjacent to the V-shaped tips 520, and further preferably larger than the spacing between terminal ends 530 so that a locking tongue 479 cannot be transversely removed from slot 528 when the mounting members 516 are immobilized, as further described below.

In operation, when frame holder anchor 502 of frame holder 500 is installed on display rod 520 as shown in FIG. 56, the V-shaped tips 520 of resilient mounting members 516 are laterally and transversely inserted into mounting receptacles 422 formed in inner member 450. With additional reference to FIG. 36A, the apex 522 of tips 520 engages the laterally sidewalls 524 inside the receptacle which compresses members 520 inwards towards each other by virtue of the gap formed between the members. The mounting members 520 are held in a compressed state as the anchor is continued to be slid into the receptacle 422. When the tips 520 and particularly apex 522 eventually emerge from widened rear opening 464 of the receptacle 422, the resilient mounting members 516 are free to expand outwards. This engages angled surfaces 524 on tips 520 with mating angled engagement surfaces 467 on inner member 450 adjacent to receptacle 422 to form a frictional snap fit.

The frame holder anchor 502 is now supported by and mounted to the display rod, albeit releasably secured thereto via the snap fit. To prevent unauthorized and/or accidental removal or dislodgement of frame holder anchor 502 and frame holder 500 from display rod 520, the locking aspect of the display system 400 using locking plate 470 may be employed as further described elsewhere herein.

Figure 65:
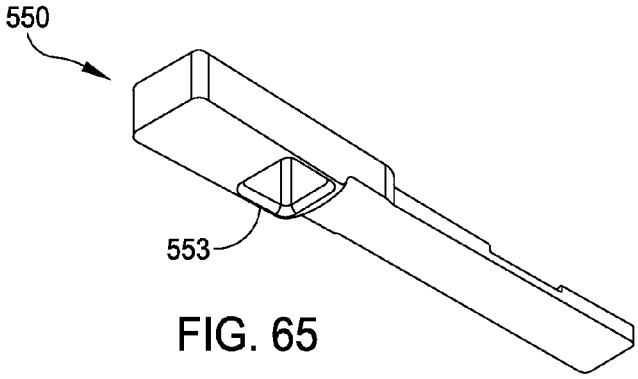
FIGS. 65-66 are bottom and top perspective views of the bottom cover.
Figure 66:
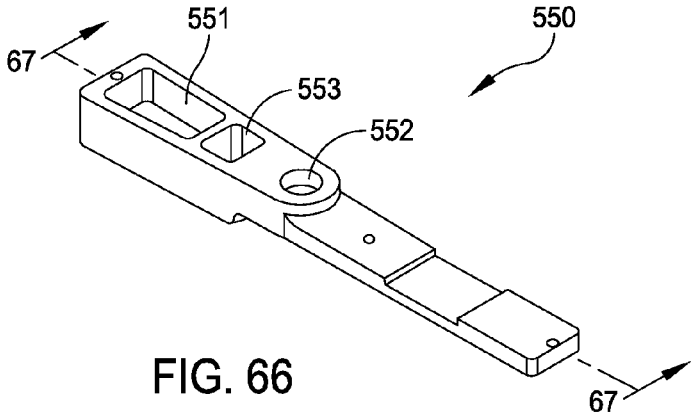
Figure 67:
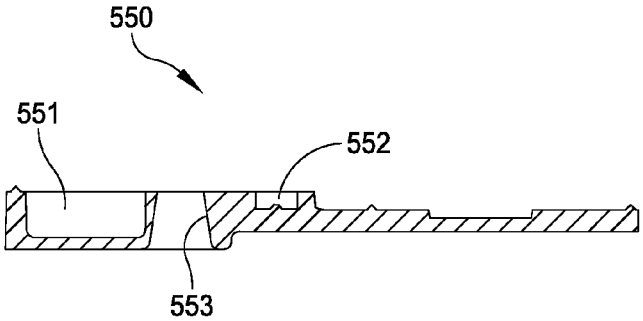
FIG. 67 is a side cross-sectional view of the bottom cover taken along line 67-67 in FIG. 66.

Returning now to support frame 500, the locking feature of the support frame 500 will be described in further detail Referring again to FIGS. 58-64, the distal portion of spine 508 generally proximate to distal end 512 includes internal channel 532 that extends axially from distal end 512 towards mounting anchor 502 for a predetermined length. Channel 532 has a front wall 544, rear wall 546, and a downwardly open bottom in some embodiments which is covered by a removable bottom cover 550 (see FIGS. 65-67) that attaches to spine 508. In one embodiment, cover 550 is at least partially insertable into channel 532 and has outer peripheral edges that are configured and dimensioned to match the shape of the perimeter of the channel 532, albeit slightly smaller, so that the channel is completely covered by the cover which rests substantially flushly mounted on the underside or bottom of spine 508.

Referring to FIGS. 64-67, bottom cover 550 has an axially elongated body and includes a rectilinear front recess 551 that is vertically aligned with top opening 543 in spine 508, round recess 552 that is vertically aligned with and receives retaining pin 538 in channel 532, and through hole 553 which is vertically aligned with deepened recess 534 in channel 532 configured for receiving release protrusion 602 of key 600

Figure 72:
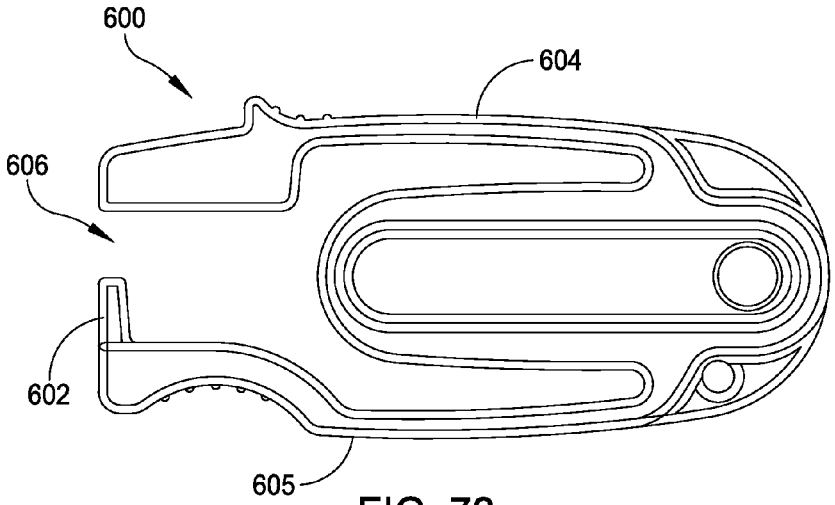
FIGS. 72-73 are side and perspective views of a specially configured key usable to unlatch the locking hook of FIG. 69 from the frame holder of FIG. 58.
Figure 73:
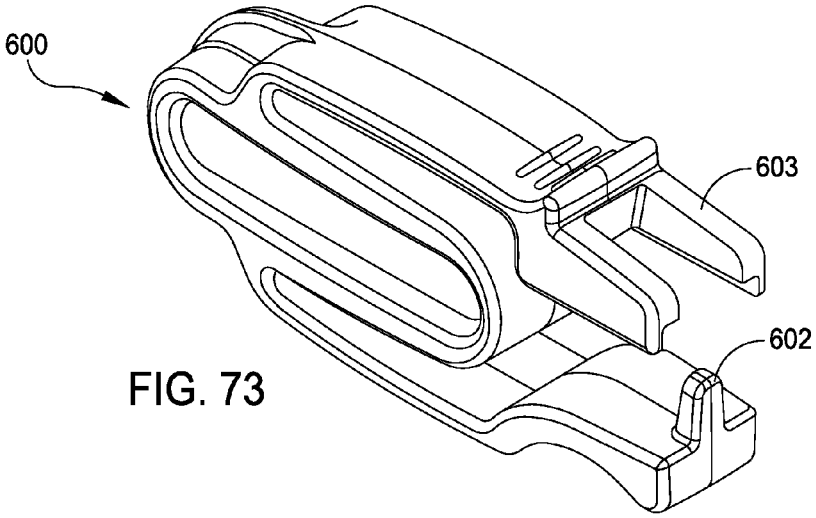

(see FIGS. 72-73). Through hole 553 allows protrusion 602 of key 600 to reach and engage legs 561 of retaining spring 560 (see also FIG. 68), as further described herein.

Figure 64:
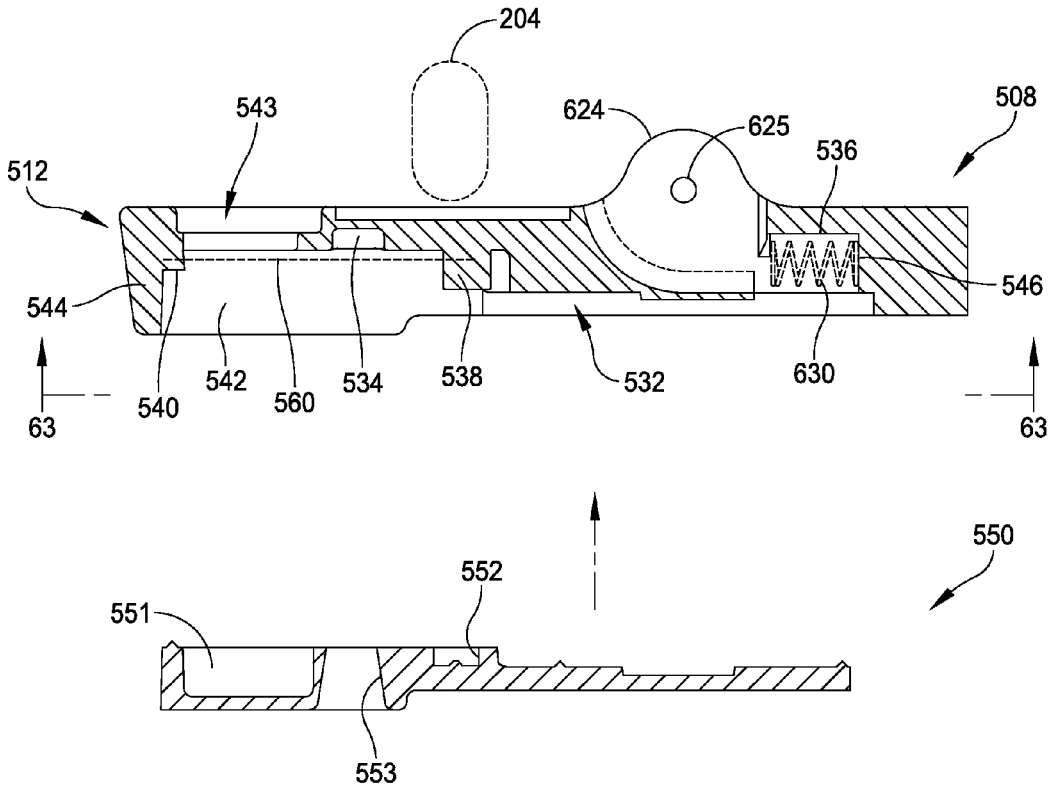
FIG. 64 is an exploded cross-sectional side view showing the front portion of the spine and bottom cover attachable to the spine.
Figure 68:
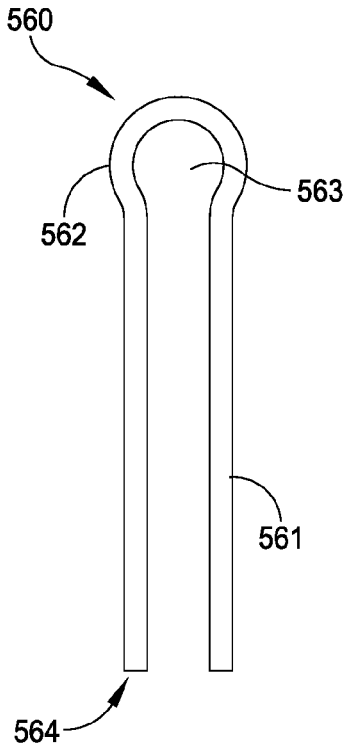
FIG. 68 is a top view of a retention spring insertable into the spine of the frame holder and forming part of an eyeglass frame locking feature.

Referring to FIGS. 63 and 64, channel 532 is configured and dimensioned to hold a U-shaped retention spring 560 for releasably securing locking hook 504 (see FIGS. 69-71) to the frame holder 500. Referring to FIG. 68, retention spring 560 in one embodiment is made of a continuous piece of metal wire (e.g. steel or zinc plated music wire) that is configured with two spaced apart and resiliently movable legs 561 have free ends 564 and a semi-circular head portion defining a return having a generally round opening 563 there through. The head portion 563 receives a retaining pin 538 in channel 532 through opening 563 for removably mounting the spring in spine 508. The free ends 564 of legs 561 are located on opposite sides of protrusion 540 in channel 532 to maintain a minimum spacing between the legs. Legs 561 are resiliently moveable in inward and outward lateral directions with respect to lateral sides 541 of spine 508 of frame holder 500 for locking/latching and unlocking/unlatching the locking hook 504. Locking hook 504 is therefore pivotally movable between locked/latched and unlocked/unlatched positions with respect to spine 508 of frame holder 500.

Figure 69:
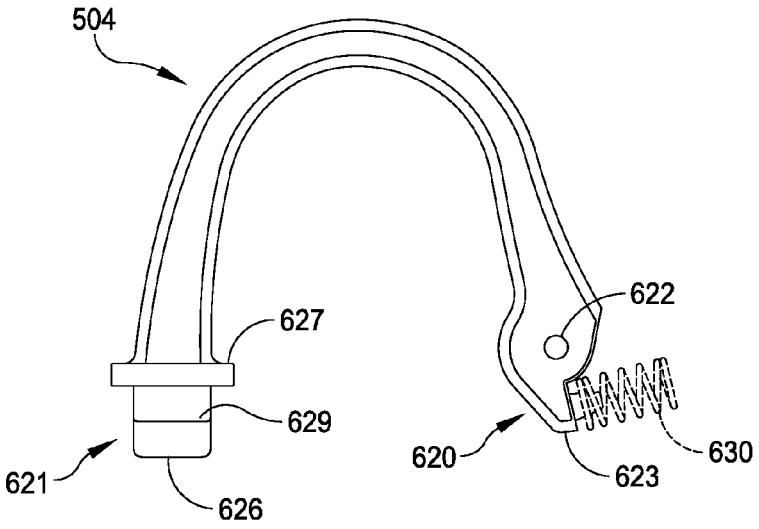
FIGS. 69-71 are side, front, and perspective views of a pivotable locking hook of the frame holder of FIG. 58 forming part of the eyeglass frame locking feature.
Figure 70:
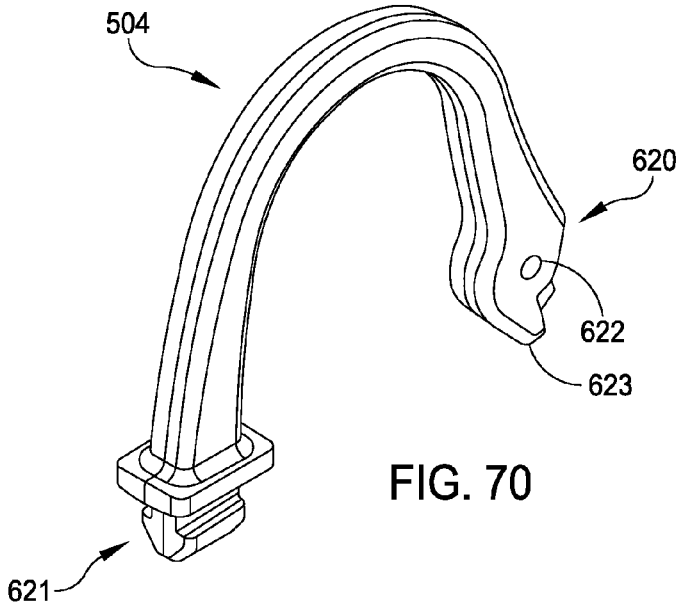
Figure 71:
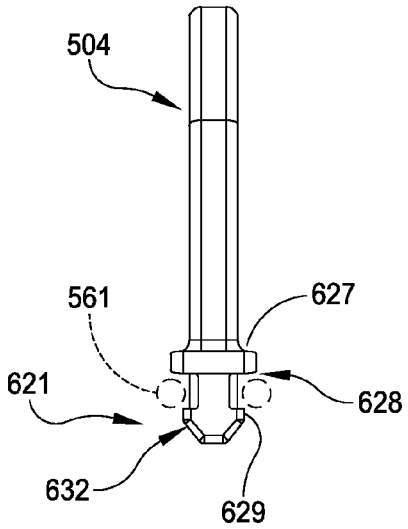

Referring to FIGS. 69-71, locking hook 504 includes a releasable locking or latching end 621 and mounting end 620. Mounting end 620 includes a through bore 622 configured for receiving a cross pin therethrough for pivotably mounting the locking hook 504 on spine 508. Mounting end 620 also includes a biasing extension 623 located below through bore 622 which is engaged by a biasing member such as spring 630 mounted in channel 532 for biasing the locking hook 504 into an unlocked or open position. Spring 630 is a helical coil spring in some embodiments as shown in FIGS. 63 and 64; however, any other suitable spring may be used. In one embodiment, mounting end 620 is disposed and pivotably mounted between two spaced apart flanges 624 disposed on spine 508; each flange having a through bore 625 (see FIG. 64) for receiving an end of the cross pin.

With continuing reference to FIGS. 69-71, latching end 621 of locking hook 504 includes an arrow or V-shaped shaped locking protrusion 626 (when viewed from the end as shown in FIG. 71). Locking protrusion 626 is configured and dimensioned for insertion into top opening 543 in spine 508 (see FIG. 64) which opens into channel 532 there below. Locking protrusion 626 is further configured to engage the laterally resilient legs 561 of retaining spring 560 (see also FIG. 68) which are disposed on opposing sides of the locking protrusion (see also FIG. 71) when locking hook 504 is locked into spine 508. In one embodiment, axially extending spaces 628 are formed on opposite sides of locking protrusion 626 between a laterally protruding flange 627 disposed on latching end 621 of locking hook 504 above the locking protrusion and the terminal end of the arrow shaped locking protrusion 626 as best shown in FIG. 71. Accordingly, the portion of locking protrusion 626 adjacent flange 627 is narrower than the terminal end portion more distal to the flange as shown, and forms a stepped portion 629 that engages and holds legs 561 of spring 560 in place to maintain locked engagement.

In one embodiment, locking hook 504 has a semi-circular shaped body forming an open loop as best shown in FIGS. 69 and 70; however, other suitable shaped hooks may be provided. Locking hook 504 and spine 508 are mutually configured and dimensioned so that the nose piece 204 of eyeglass frames 200 (eyeglass frame shown in FIG. 15) can be removably inserted through the locking hook and trapped between the hook and spine when in the locked or closed position.

To facilitate releasing the locking end 621 of locking hook 504 from spine 508 of frame holder 500, a deepened recess 534 as shown in FIGS. 63 and 64 is provided within channel 532 to provide ample insertion space for receiving a release protrusion 602 of key 600 (see FIGS. 72-73). Recess 534 is located along and between legs 561 of retention spring 560 when the spring is mounted in channel 532.

Referring to FIGS. 72 and 73, key 600 is provided for latching and unlatching locking hook 504 from spine 508. In one embodiment, key 600 has an elongated body and includes a flexible and resilient upper and lower levers 604 and 605 which are vertically moveable together and apart with respect to each other. Upper lever 604 defines a pair of laterally spaced apart arms 603 configured for engaging a top surface of spine 508 on opposite sides of opening 534 through which locking protrusion 621 of locking hook 504 (see FIG. 71) is inserted. Lower lever 605 includes upwardly projecting release protrusion 602 which is insertable through hole 553 in bottom cover 550 (see also FIG. 64). In one embodiment, the upper and lower levers 604, 605 are operated by grasping the levers by hand and squeezing the levers together as further described herein.

Operation of the lockable frame holder 500 will now be described. Starting with locking hook 504 in a raised open and unlocked position (i.e. locking protrusion 626 disengaged from spine 508 and pivotably moveable), the nose piece 204 of eyeglass frames 200 is placed on a top surface of frame holder 500 between top opening 543 in spine 508 and mounting end 620 of locking hook 504 pinned to the spine at flanges 624 (see, e.g. FIGS. 58, 61, and 64). It will be noted that in the present embodiment, the locking hook 504 is biased into the raised open position by spring 630 acting on mounting end 620 of the locking hook (see, e.g. FIGS. 63 and 69).

Next, the locking hook 504 is then rotated or pivoted forward to insert the locking protrusion 621 through top opening 543 in the distal end portion of spine 508. Angled surfaces 632 on locking protrusion 626 facing downwards and outwards (see FIG. 71) engage and temporarily spread apart legs 561 of retaining spring 560 held in channel 532 within the spine 508. After overcoming some initial resistance, the locking protrusion 626 snaps into spine 508 as the legs 561 spring back inwards towards each other and enter axial spaces 628 between flange 627 and stepped portion 629. The lateral distance between legs 561 is less than the width of locking protrusion 626 at stepped portion 629. The legs of spring 560 are engaged by stepped portion 629 if a user or another attempts to pull the locking hook 504 back out of spine 508 without using key 600 shown in FIG. 72. The locking hook 504 is therefore now in a lower closed and locked position. Eyeglass frames 200 are now secured in place on frame holder 500 and prevented from unauthorized removal.

To remove eyeglass frames 200 from holder 500, a user axially slides the distal end 512 of spine 508 through front opening 606 of key 600 and between levers 604 and 605 (sees FIGS. 72-73). Arms 603 are placed on and engaged with top surface of spine 508 on opposite sides of top opening 543 (see, e.g. FIGS. 59 and 64). Release protrusion 602 is positioned immediately below and aligned with through hole 553 in bottom cover 550 (see FIGS. 64 and 65). The user next squeezes levers 604 and 605 of key 600 together. Release protrusion 602 enters the gap or space between legs 561 of spring 560 (see FIGS. 63 and 68) which act to spread the legs back apart from underneath the spine 508 using key 600. The release protrusion 602 enters deepened recess 534 in spine 508 (see FIG. 64) to allow the spring legs 561 to be sufficiently spread wide enough part to disengage stepped portion 629 on locking protrusion 626 from the legs. The locking hook 504 is then rotated upward and rearwards which vertically withdraws the locking protrusion 626 on the locking hook from top opening 543 and spine 508. The locking hook 504 is now returned to the unlocked raised and open position, and eyeglass frame 200 may now be removed from frame holder 500.

Operation of Lockable Eyewear Display System

A method for using the locking feature of eyewear display system 400 will now be described in additional detail. Frame holder anchor 502 of frame holder 500 is first installed and snap-fitted into display rod 420 (see FIG. 56A) in a manner already described above. In summary, angled surfaces 524 on tips 520 of the resilient mounting members 516 are fully engaged with mating angled engagement surfaces 467 on inner member 450 adjacent to receptacle 422 at rear opening 464 which forms the frictional snap as shown in FIG. 36A.

Figure 74:
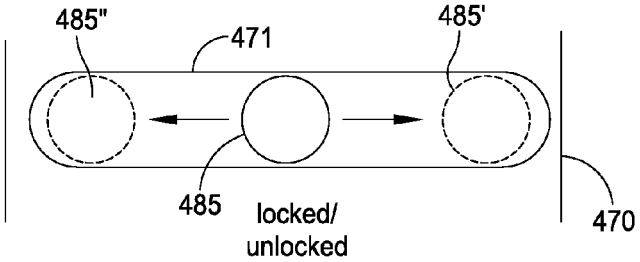
FIG. 74 is an end view illustrating a linkage pin positioned initially in the middle of an operating slot of a locking plate, in accordance with one embodiment of the invention.

Display rod 420 is initially in the unlocked position as shown in FIG. 56B, wherein locking tongues 479 on locking plate 470 are withdrawn or retracted from receptacles 422. Accordingly, the frame holders 500 may be freely withdrawn from receptacles 422 by pulling the frame holders laterally outwards. The locking plate 470 is in an upper unlocked position. As shown in FIG. 74, linkage pin 485 of cam lock 482 is positioned near the middle of the operating slot 471 in locking plate 470 (see also FIGS. 39 and 42) when locking tongues 479 are retracted from receptacle 422 and display rod 420 is unlocked.

To lock frame holder 500 to display rod 420, a user first axially inserts key 483 (FIG. 53) through front keyhole 461 into cam lock 482 as shown in FIG. 38. The key 483 engages key socket 487 formed in the lock operating cylinder 486 of the cam lock 482. Next, the user rotates or turns cam lock 482 through 180 degrees using key 483. This rotational motion simultaneously moves linkage pin 485, positioned initially in the middle of operating slot 471 of locking plate 470 (see FIG. 74), through a corresponding 180 degree arc of rotation about the lock operating cylinder 486. This arcuate motion of the pin 485 slidably pushes the locking bar downward as the pin travels and reciprocates in slot 471 from the initial middle position, to an interim position at one end of the slot (e.g. right at 485' or left at 485" in FIG. 74 depending on whether the key 483 is turned clockwise or counter-clockwise), and then back again to the middle. Locking plate 470 has now been moved into a lower locked position wherein locking tongues 479 are projected into receptacle 422 (see FIG. 56C) and enter slot 530 formed between the V-shaped tips 520 of resilient mounting members 516 on frame holder mounting anchor 502 (see also FIG. 63). Because tips 520 must be able to deform inwardly to remove the frame anchor 502 from the display rod receptacle 422, the presence of locking tongue 479 between the tips engages and blocks their movement. The mounting members 516 accordingly cannot be withdrawn from receptacles 422 (e.g. upward direction shown in FIG. 36A) and are locked in place.

As shown in FIG. 74, it will be appreciated that the middle position of the cam lock linkage pin 485 in operating slot 471 in locking plate 470 (see also FIGS. 39 and 42) coincides with both a locked and unlocked position of the display rod 420 and locking tongues 479. The linkage pin 485 travels in slot 471 to either interim end positions 485' or 485" when the cam lock 482 is mid-way between a locked or unlocked operating position of the locking plate 470.

It should be noted that as locking plate 470 slides downwards into the locked position, visual indication surface 481 simultaneously moved downwards into a lower position. The portion of visual indication surface 481 visible through indication hole 495 formed in inner member 450 (see FIGS. 31, 34, 38, and 56) would display that the display rod 420 is in the locked position (e.g. red or no color). Initially, the visual indication surface 481 would have previously been in an upper position indicating that the display rod was locked (e.g. green) when viewed through indication hole 495.

To unlock display rod 420, the foregoing process and steps are essentially reversed. Basically, key 483 is inserted into lock operating cylinder 486 and rotated 180 degrees in an opposite rotational direction than before. Locking rod 470 is returned to its upper unlocked position and locking tongues 479 are retracted from receptacles 422 and tips 520 of the frame holder mounting anchor 502 (see FIG. 36A). The tips 520 can now again deform inwardly to allow removal of the frame anchor 502 and frame holder 500 in some embodiments attached thereto from the display rod receptacle 422.

It will be appreciated that other configurations of removable frame holders (e.g. non-swiveling and/or non-locking), object or eyewear accessory supports, shelves, advertising or brand name signage, etc. may be used and provided with the same or similar resilient anchor mounting members 516 as shown in FIGS. 36A, 62A-B, and 63 which cooperate with display rod 420 in a similar manner to frame holder 500 described herein. Accordingly, embodiments of an eyewear display system are expressly not limited to those embodiments of some exemplary examples described and shown herein.

Any suitable materials and method of fabrication may be used for the components identified herein, including metal and non-metallic materials. A few non-limiting representative examples of suitable materials will be given recognizing that the material selection will be based in part on manufacturability, aesthetics, strength, and other factors. In some embodiments, outer member 430 may be made of metal such as extruded aluminum for strength since it is the primary load bearing member of the display system 400. Inner member 450 and locking plate 470 may be made of Acrylonitrile Butadiene Styrene (ABS), although these components may also be formed of metal. Cam lock 482 may be made of ABS in some embodiments. Mounting bases 404 and the mounting plate 406-mounting rod 402 assemblies may made of metal for strength such as steel or aluminum. Key 483 may be made of metal such as steel or aluminum. Other suitable materials may be used for any of the foregoing components.

While the foregoing description and drawings represent the preferred embodiments of the present invention, it will be understood that various additions, modifications and substitutions may be made therein without departing from the spirit and scope of the present invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

What is claimed is:

1. A method for operating a lockable eyewear display system comprising:

providing a display rod comprising an outer member, an inner member, and a locking plate slidably disposed in the outer member;

providing an object display holder that includes a mounting anchor;

providing a cam lock and a key that matingly engages a key hole within said cam lock; wherein said cam lock is positioned within a chamber defined within said inner member; wherein said cam lock includes an operating cylinder having a first diameter, the operating cylinder being located at a front portion of the cam lock; and a linkage pin having a second diameter, the linkage pin being located at a rear portion the cam lock and at a generally higher height than the operating cylinder; the first diameter being larger than the second diameter; wherein one end of the linkage pin is inserted within a horizontal slot defined within the locking plate; inserting the key into the cam lock;

rotating the key which in turn rotates the linkage pin of the cam lock and causes the linkage pin to slide within the horizontal slot of the locking plate;

projecting a locking tongue on the locking plate into a receptacle disposed in the display rod by slidably moving the locking plate in a vertical direction in response to the linkage pin sliding within the horizontal slot of the locking plate; and engaging the locking tongue with the mounting anchor of the object display holder positioned in the receptacle.

2. The method of claim 1, further comprising axially inserting the locking tongue in a slot formed in the mounting anchor of the object display holder.

3. The method of claim 1, further comprising snap fitting the mounting anchor of the object display holder into the receptacle, the mounting anchor having a pair of resilient mounting members engaged with the receptacle.

4. A method for locking eyewear display comprising:

providing a display rod assembly having an elongated outer member defining a longitudinal axis and axially extending cavity; and an elongated inner member; wherein a plurality of receptacles are formed in the display rod;

positioning said elongated inner member in said cavity of the outer member;

providing a locking plate;

positioning the locking plate in said cavity of said outer member, the locking plate being slidably moveable in said cavity between a locked position and an unlocked position;

providing a plurality of object display holders, each object display holder including a mounting anchor;

coupling a corresponding mounting anchor of a corresponding object display holder to a corresponding receptacle of the plurality of receptacles formed in said display rod;

providing a key and a cam lock;

the cam lock being rotatably disposed in said display rod, wherein said cam lock includes a linkage pin and an operating cylinder configured to receive the key;

rotating the operating cylinder with the key in order to move the locking plate between the lock and unlocked positions; wherein the locking plate includes a plurality of spaced apart locking tongues oriented axially along and coplanar with the locking plate, each locking tongue corresponding with one of the receptacles;

removably inserting corresponding locking tongues within a slot formed in each said corresponding mounting anchor of said corresponding object display holders when the locking plate is in the locked position.

5. A method according to claim 4 including engaging said linkage pin with a laterally extending slot formed in said locking plate.

6. A method according to claim 5 including reciprocating said linkage pin in opposing directions within said slot by rotating said cam lock thereby moving said the locking plate between the locked and unlocked position.

7. A method according to claim 6, including rotating said cam lock in opposing directions thereby simultaneously projecting and retracting said locking tongues into and out from said receptacles.

8. A method according to claim 4, including forming said receptacles within the inner member of the display rod and forming a plurality of openings in said outer member, accessing a corresponding receptacle in the inner member so as by inserting a corresponding mounting anchor of a corresponding object display holder through a corresponding front opening formed in the outer member.

9. A method according to claim 4 including providing a second axially cavity within outer member;

providing a mounting plate and a mounting rod that extends perpendicularly from the mounting plate; inserting the mounting rod to a fixture with the second cavity of the outer member in order to attach the mounting plate to the display rod; and mounting the display rod to a mounting surface by affixing the mounting plate to said mounting surface.

10. A method according to claim 3 including providing an indicator which is formed on a protrusion extending outwards from the locking plate, wherein the indicator allows a user to determine whether the display rod is in an unlocked or locked operating state.

11. A method according to claim 4 including inserting slidably the inner member and locking plate into said outer member through an open end of said outer member.

* * * * *